US008857349B2

(12) United States Patent
Peery et al.

(10) Patent No.: US 8,857,349 B2
(45) **Date of Patent: *Oct. 14, 2014**

(54) TABLE

(71) Applicant: Lifetime Products, Inc., Clearfield, UT (US)

(72) Inventors: Wendell Peery, Kaysville, UT (US); David C. Winter, Layton, UT (US); Mitch Johnson, South Weber, UT (US)

(73) Assignee: Lifetime Products, Inc., Clearfield, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/735,913

(22) Filed: Jan. 7, 2013

(65) Prior Publication Data

US 2013/0118387 A1 May 16, 2013

Related U.S. Application Data

(63) Continuation of application No. 13/455,066, filed on Apr. 24, 2012, now Pat. No. 8,347,795, and a (Continued)

(51) Int. Cl.

| | |
|---|---|
| ***A47B 7/02*** | (2006.01) |
| ***A47B 13/08*** | (2006.01) |
| ***A47B 3/091*** | (2006.01) |
| ***A47B 3/08*** | (2006.01) |

(52) U.S. Cl.

CPC ..... *A47B 13/08* (2013.01); *A47B 3/0912* (2013.01); *A47B 7/02* (2013.01); *A47B 3/08* (2013.01)

USPC ..... 108/91

(58) Field of Classification Search

CPC ..... A47B 3/0912; A47B 13/08; A47B 3/087; A47B 13/003; A47B 7/02; A47B 87/02; A47B 87/0246; B29L 2031/448

USPC ..... 108/91, 129–132, 125, 126, 901, 53.1, 108/53.3

See application file for complete search history.

(56) References Cited

U.S. PATENT DOCUMENTS

| | | | |
|---|---|---|---|
| 1,593,975 | A | 7/1926 | Karstens |
| 1,856,935 | A | 5/1932 | Turner |

(Continued)

FOREIGN PATENT DOCUMENTS

| | | | |
|---|---|---|---|
| CN | 2556996 | Y | 6/2003 |
| CN | 1627908 | | 6/2005 |

(Continued)

OTHER PUBLICATIONS

Notice of Allowance from U.S. Appl. No. 13/604,557 dated Jul. 30, 2013.

(Continued)

*Primary Examiner* — Janet M Wilkens
(74) *Attorney, Agent, or Firm* — Maschoff Brennan

(57) ABSTRACT

A table may be sized and configured to nest with one or more adjacent tables to reduce a height of the table in a nested configuration. The table may include a table top constructed from molded plastic and the table top may include a receiving portion sized and configured to receive an engaging portion of a frame of an adjacent table in the nested configuration. The table may also include a metal frame connected to the table top and the frame may include an engaging portion sized and configured to be disposed in a receiving portion of an adjacent table in the nested configuration. If desired, an outer surface of the engaging portion may be visible and exposed in the recess in the lip.

39 Claims, 32 Drawing Sheets

Related U.S. Application Data continuation of application No. 29/390,471, filed on Apr. 25, 2011, now Pat. No. Des. 659,450.

(60) Provisional application No. 61/478,786, filed on Apr. 25, 2011, provisional application No. 61/478,879, filed on Apr. 25, 2011, provisional application No. 61/531,081, filed on Sep. 5, 2011, provisional application No. 61/543,277, filed on Oct. 4, 2011.

(56) References Cited

U.S. PATENT DOCUMENTS

| | | | | |
|---|---|---|---|---|
| 2,540,849 | A | | 2/1951 | Walker |
| 2,889,185 | A | | 6/1959 | Heisler |
| 3,389,511 | A | | 6/1968 | Drehobl |
| 3,917,108 | A | | 11/1975 | Thurman |
| 4,570,993 | A | | 2/1986 | Widerker |
| 4,841,877 | A | | 6/1989 | Virtue |
| 5,009,170 | A | * | 4/1991 | Spehar ..... 108/36 |
| 5,381,740 | A | | 1/1995 | Johnston |
| 5,421,272 | A | | 6/1995 | Wilmore |
| 5,505,142 | A | | 4/1996 | Fink |
| 5,664,934 | A | | 9/1997 | Schaede et al. |
| 5,775,655 | A | | 7/1998 | Schmeets |
| 5,960,720 | A | | 10/1999 | Borland et al. |
| 5,983,807 | A | | 11/1999 | Tarnay et al. |
| 6,058,853 | A | | 5/2000 | Pinch |
| 6,112,674 | A | | 9/2000 | Stanford |
| 6,199,487 | B1 | | 3/2001 | Coddington |
| 6,394,004 | B1 | | 5/2002 | Lynn |
| 6,722,293 | B2 | | 4/2004 | Lee |
| 6,732,663 | B2 | | 5/2004 | Tsai |
| 6,752,091 | B2 | | 6/2004 | Glover et al. |
| 6,772,700 | B2 | | 8/2004 | Wong |
| 7,069,865 | B2 | | 7/2006 | Strong et al. |
| 7,073,450 | B2 | | 7/2006 | Tsai |
| 7,096,800 | B2 | | 8/2006 | Stanford |
| 7,100,518 | B2 | | 9/2006 | Strong |
| 7,111,563 | B2 | | 9/2006 | Strong |
| 7,150,237 | B2 | | 12/2006 | Lin et al. |
| 7,171,910 | B2 | | 2/2007 | Neunzert et al. |
| 7,278,361 | B2 | | 10/2007 | Zhurong et al. |
| 7,428,872 | B2 | | 9/2008 | Strong et al. |
| 7,634,969 | B2 | | 12/2009 | Neunzert et al. |
| 7,634,970 | B2 | | 12/2009 | Strong et al. |
| 7,640,870 | B2 | | 1/2010 | Strong et al. |
| 7,707,947 | B2 | | 5/2010 | Winter et al. |
| 7,752,982 | B2 | | 7/2010 | Lin |
| 7,799,482 | B2 | | 9/2010 | Cho et al. |
| 7,905,185 | B2 | | 3/2011 | Peery et al. |
| 8,006,630 | B2 | | 8/2011 | Strong et al. |
| 8,033,228 | B2 | | 10/2011 | Haney |
| 8,042,475 | B2 | | 10/2011 | Larcom et al. |
| 8,042,476 | B2 | | 10/2011 | Stanford |
| 8,074,582 | B2 | | 12/2011 | Stanford |
| 8,091,289 | B2 | | 1/2012 | Mower et al. |
| 8,161,711 | B2 | | 4/2012 | Steed et al. |
| D658,912 | S | | 5/2012 | Winter et al. |
| D659,450 | S | | 5/2012 | Winter et al. |
| D662,738 | S | | 7/2012 | Winter et al. |
| D667,659 | S | | 9/2012 | Winter et al. |
| 8,267,018 | B2 | | 9/2012 | Gunn |
| 8,347,795 | B2 | | 1/2013 | Peery et al. |
| 8,397,652 | B2 | | 3/2013 | Peery et al. |
| 8,408,146 | B2 | | 4/2013 | Peery et al. |
| 8,578,863 | B2 | | 11/2013 | Peery et al. |
| 8,622,007 | B2 | | 1/2014 | Peery et al. |
| 8,683,929 | B2 | | 4/2014 | Peery et al. |
| 2003/0167981 | A1 | | 9/2003 | Cai et al. |
| 2003/0217676 | A1 | | 11/2003 | Strong et al. |
| 2003/0221595 | A1 | | 12/2003 | Reinsch et al. |
| 2003/0233968 | A1 | | 12/2003 | Strong et al. |
| 2004/0031422 | A1 | | 2/2004 | Wong |
| 2005/0005826 | A1 | | 1/2005 | Strong et al. |
| 2005/0045074 | A1 | | 3/2005 | Jin |
| 2005/0098068 | A1 | | 5/2005 | Tsai |
| 2005/0155531 | A1 | | 7/2005 | Chang |
| 2005/0268827 | A1 | | 12/2005 | Stanford |
| 2006/0019776 | A1 | | 1/2006 | Mower |
| 2006/0230989 | A1 | | 10/2006 | Haney et al. |
| 2007/0101910 | A1 | | 5/2007 | Halmoff et al. |
| 2007/0199483 | A1 | | 8/2007 | Peery et al. |
| 2007/0272128 | A1 | | 11/2007 | Lin |
| 2008/0060563 | A1 | | 3/2008 | Yang |
| 2008/0264307 | A1 | | 10/2008 | VanNimwegen et al. |
| 2009/0114131 | A1 | | 5/2009 | Haney et al. |
| 2012/0266790 | A1 | | 10/2012 | Peery et al. |

FOREIGN PATENT DOCUMENTS

| | | | |
|---|---|---|---|
| CN | 201265212 | Y | 7/2009 |
| CN | 202739180 | | 2/2013 |
| CN | 202820137 | | 3/2013 |
| DE | 102007041234 | A1 | 3/2009 |

OTHER PUBLICATIONS

U.S. Appl. No. 13/455,041, filed Apr. 24, 2012, Peery, et al.
U.S. Appl. No. 13/455,055, filed Apr. 24, 2012, Peery, et al.
U.S. Appl. No. 13/455,066, filed Apr. 24, 2012, Peery, et al.
U.S. Appl. No. 13/455,073, filed Apr. 24, 2012, Peery, et al.
U.S. Appl. No. 13/455,076, filed Apr. 24, 2012, Peery, et al.
U.S. Appl. No. 13/455,081, filed Apr. 24, 2012, Peery et al.
U.S. Appl. No. 13/559,062, filed Jul. 26, 2012, Jin, et al.
U.S. Appl. No. 13/592,230, filed Aug. 22, 2012, Peery, et al.
U.S. Appl. No. 13/604,557, filed Sep. 5, 2012, Peery, et al.
U.S. Appl. No. 13/846,648, filed Mar. 18, 2013, Peery, et al.
Office Action from U.S. Appl. No. 13/455,041 dated Jun. 27, 2012.
Office Action from U.S. Appl. No. 13/455,055 dated Jun. 27, 2012.
Office Action from U.S. Appl. No. 13/455,076 dated Sep. 4, 2012.
Office Action from U.S. Appl. No. 13/455,081 dated Sep. 4, 2012.
Office Action from U.S. Appl. No. 13/592,230 dated Nov. 6, 2012.
Office Action from U.S. Appl. No. 13/559,062 dated Dec. 19, 2012.
Office Action from U.S. Appl. No. 13/604,557 dated Dec. 20, 2012.
Office Action from U.S. Appl. No. 13/455,073 dated Feb. 28, 2013.
Office Action from U.S. Appl. No. 13/455,076 dated May 13, 2013.
Notice of Allowance from U.S. Appl. No. 13/455,041 dated Oct. 23, 2012.
Notice of Allowance from U.S. Appl. No. 13/455,055 dated Oct. 17, 2012.
Notice of Allowance from U.S. Appl. No. 13/455,055 dated Feb. 14, 2013.
Notice of Allowance from U.S. Appl. No. 13/455,066 dated Sep. 10, 2012.
Notice of Allowance from U.S. Appl. No. 13/559,062 dated Jun. 12, 2013.
Notice of Allowance from U.S. Appl. No. 13/604,557 dated Jul. 12, 2013.
European Search Report from EPO Application No. EP12183082 dated Nov. 20, 2012.
International Search Report and Written Opinion from PCT/US2012/035058 dated Jul. 13, 2012.
International Search Report and Written Opinion from PCT/US2012/035054 dated Jul. 17, 2012.
International Search Report and Written Opinion from PCT/US2012/035055 dated Jul. 17, 2012.
International Search Report and Written Opinion from PCT/US2012/035056 dated Jul. 17, 2012.
International Search Report and Written Opinion from PCT/US2012/035059 dated Jul. 17, 2012.
International Search Report and Written Opinion from PCT/US2012/035061 dated Jul. 17, 2012.
International Search Report and Written Opinion from PCT/US2012/048485 dated Oct. 15, 2012.
U.S. Appl. No. 14/077,147, filed Nov. 11, 2013, Peery, et al.
U.S. Appl. No. 14/231,283, filed Mar. 31, 2014, Peery, et al.

(56) References Cited

OTHER PUBLICATIONS

Office Action from U.S. Appl. No. 13/455,076 dated Nov. 29, 2013.
Office Action from U.S. Appl. No. 14/077,147 dated Mar. 17, 2014.
Notice of Allowance from U.S. Appl. No. 13/846,648 dated Feb. 26, 2014.
Office Action from U.S. Appl. No. 13/455,076, dated May 12, 2014 (copy.
Office Action from U.S. Appl. No. 14/231,283 dated May 19, 2014 (copy.
U.S. Appl. No. 14/312,396, filed Jun. 23, 2014, Peery, et al.
European Search Report from EPO Application No. EP12777035 dated Jul. 10, 2014.
European Search Report from EPO Application No. EP12777332 dated Jul. 10, 2014.

* cited by examiner

TABLE

CROSS-REFERENCE TO RELATED APPLICATIONS

The present application is a continuation of U.S. patent application Ser. No. 13/455,066, entitled TABLE, filed Apr. 24, 2012, now U.S. Pat. No. 8,347,795.

The U.S. patent application Ser. No. 13/455,066, entitled TABLE, filed Apr. 24, 2012, now U.S. Pat. No. 8,347,795, claims priority to and the benefit of U.S. provisional patent application Ser. No. 61/478,786, entitled TABLE, which was filed on Apr. 25, 2011; U.S. provisional patent application Ser. No. 61/478,879, entitled TABLES AND CHAIRS, which was filed on Apr. 25, 2011; U.S. design patent application Ser. No. 29/390,471, entitled PORTION OF A TABLE TOP, which was filed on Apr. 25, 2011; U.S. provisional patent application Ser. No. 61/531,081, entitled TABLE, which was filed on Sep. 5, 2011; and U.S. provisional patent application Ser. No. 61/543,277, entitled TABLE, which was filed on Oct. 4, 2011; each of which is hereby incorporated by reference in its entirety.

BACKGROUND

1. Field of the Invention

The present invention generally relates to structures including at least a portion constructed from plastic and, in particular, to furniture, such as tables and chairs, that may include molded plastic components.

2. Description of Related Art

Many different types of tables are well known and used for a variety of different purposes. For example, conventional tables may include legs that are pivotally attached to a table top and the legs may be movable between a use position in which the legs extend outwardly from the table top and a storage position in which the legs are folded against the table top. Conventional tables with relatively large table tops and folding legs are often referred to as "banquet tables" and these tables are frequently used in assembly halls, banquet halls, convention centers, hotels, schools, churches and other locations where large groups of people meet. These types of tables can often be positioned in an assortment of different configurations and used in a variety of settings. When the banquet tables are no longer needed, the table legs can be moved into the storage position and the tables may be more easily moved or stored.

Because most banquet tables have a length between six and ten feet and a width between three and four feet, the required storage area for such tables is quite large even with the legs in the collapsed position. This large storage area may be problematic for businesses or facilities such as hotels, schools and churches because a considerable number of these tables may have to be stored.

Conventional tables often include table tops constructed from materials such as wood, particle board or metal. Table tops constructed from wood, particle board or metal, however, are often relatively heavy and this may make the table awkward or difficult to move. Table tops constructed from wood or metal are also relatively expensive and these types of table tops must generally be treated or finished before use. For example, table tops constructed from wood must generally be sanded and painted, and metal table tops must be formed into the desired shape and painted. In addition, because these wooden and metal table tops are relatively heavy, that may increase the cost of shipping and transportation of the tables. The weight of the table top may make the tables more difficult to move and store.

In order to decrease the weight of conventional tables, table tops may be constructed from relatively light-weight materials such as plastic. Disadvantageously, table tops constructed from light-weight materials may require large reinforcing members or other structural parts such as braces, brackets, support members and the like to strengthen the table top. While these additional parts may increase the strength of the table top, the added parts may also increase the weight of the table. These additional parts may result in increased manufacturing costs and require more time to assemble the table. In addition, extra fasteners may be required to assemble and connect these parts to the table, which may require extra time and labor during the manufacturing process. The additional parts and fasteners may further increase the cost of the table and make the table more difficult to manufacture. Moreover, these additional parts and fasteners may have sharp edges that can injure a user's legs or arms.

Conventional tables may include a frame that is connected to the table top. The frame may include a pair of side rails that are connected to sides of the table top using fasteners. Multiple fasteners may be required to securely connect the frame to the table top and transmit forces applied to the table top to the frame. Undesirably, when a large load or force is applied to some known tables, the frame may bend, deform and/or detach from the table top. In addition, the fasteners used to connect the frame to the table top may detach or separate from the table top. The fasteners may even damage and tear through the table top if the load or force exceeds a certain amount. Further, the frames or fasteners of some known tables may collapse in some circumstances.

The table tops of some known tables may undesirably bend or deform if a relatively large load or force is applied to a portion of the table top. For instance, if a load or force is applied to an outer portion of a conventional table top, that portion of the table top may undesirably move or bend. In particular, that portion of the table top may deflect downwardly when a load or force is applied to the upper surface of the table top.

The large size of conventional banquet tables may require a large amount of storage space for manufacturers, retailers and consumers. The large amount of storage space may be particularly problematic for manufacturers, retailers and consumers that have a need to store, transport and/or display large numbers of tables.

BRIEF SUMMARY

A need therefore exists for a table that eliminates or diminishes the above-described disadvantages and problems.

One aspect is a table that may include a table top and one or more legs sized and configured to support the table top above a surface such as the floor or ground. The table may also include a frame and legs connected to the frame. The legs may be movable relative to the table top between a collapsed or storage position and an extended or use position. In particular, the legs may be pivoted between a collapsed position in which the legs are disposed at least proximate a lower surface of the table top and an extended position in which the legs extend outwardly from the table top. If desired, the legs may at least partially contact or abut the lower surface of the table top when the legs are in the collapsed position. In addition, the lower surface of the table top may include one or more recesses sized and configured to receive at least a portion of the legs when the legs are in the collapsed position. Advantageously, this may decrease the amount of space required to store and/or transport the table.

Another aspect is a table that may be relatively lightweight, which may allow the table to be more easily transported and moved. For example, the table may include a lightweight table top and that may reduce the overall weight of the table. The table may also be constructed from a limited number of parts or components, which may allow the weight of the table to be reduced. Further, a limited number of fasteners may be required to assemble the table, which may also reduce the weight of the table. The limited number of fasteners may also allow the table to be more quickly and easily assembled.

Yet another aspect is a table that may include a table top constructed from plastic. For example, the table top may be constructed from molded plastic using blow-molding, injection molding, rotary molding or other suitable molding processes. The molded plastic table top may provide a relatively rigid, high-strength structure that is capable of withstanding repeated use and wear. The molded plastic table top may also be relatively quickly, easily and efficiently manufactured. In addition, the molded plastic table top may be readily molded into the desired size and shape, such as a utility table, card table, personal table and the like. The molded plastic table top may be relatively lightweight because, for instance, it may include a hollow interior portion that is formed during the molding process. The molded plastic table top may further include two opposing walls, which may be spaced apart by a generally constant and/or predetermined distance, and that may help increase the strength and rigidity of the table top. Additionally, the molded plastic table top may be generally weather resistant and temperature insensitive. Further, the molded plastic table top may not corrode, rust or otherwise deteriorate over an extended period of time, which may help create a long-lasting table.

Still another aspect is a table top that may be constructed from molded plastic and one or more features may be integrally formed during the molding process as part of a unitary, one-piece construction. For example, the molded plastic table top may include one or more depressions (also referred to as "tack-offs") and the depressions may be designed to increase the strength of the table top and/or interconnect the spaced apart walls. The depressions may also be sized and configured to create a structure with particular characteristics and qualities, such as a table top with generally uniform strength, rigidity and/or structural integrity. The molded plastic table top may also include other features such as structures that increase the strength, rigidity and/or torsion resistance of at least a portion of the table top.

Still yet another aspect is a table that may include components that can be quickly and easily manufactured. For example, the legs and/or side rails of the frame may be relatively straightforward to manufacture. In addition, the legs and/or side rails of the frame may be quickly and easily attached to the table top, which may reduce manufacturing costs. The table may also be constructed from only a few parts and a limited number of fasteners may be required, which may allow the table to be quickly and easily assembled by the manufacturer, retailer and/or consumer.

Another aspect is a table that may facilitate stacking of a plurality of tables. Advantageously, the stacked tables may be disposed in an aligned configuration. For example, one table may be easily aligned with an adjacent table, which may facilitate shipping, storage and/or display of multiple tables. Significantly, the aligned tables may be disposed vertically, horizontally, or at suitable angles depending, for instance, if the tables are to be shipped, stored, displayed, or the like. If desired, the stacked tables may lock or have a tendency to stay together. For instance, a friction or interference fit between adjacent stacked tables may tend to maintain the tables in a stacked configuration. If the tables have a penchant to stay together, this may help reduce damage to the tables during shipping, storage and/or display.

Still another aspect is a table that may be nested with an adjacent table to reduce space. Significantly, the nested tables may allow the tables to be stored in a smaller area, which may substantially reduce storage and shipping costs. The nested tables may also allow a greater number of tables to be stored in the same area as conventional tables that do not nest together. In addition, the nested tables may help protect the tables from damage. For example, because an upper portion of a table may be disposed within a lower portion of an adjacent table, that may help prevent the table from being damaged. The nested tables may further have table tops that are the same or substantially the same size as conventional tables, which may indicate the tables have similar appearances and characteristics such as strength, structural integrity and the like. The nested tables may also have the same general footprint as a conventional table, but the nested tables may allow significantly more tables to be disposed on a pallet or in a shipping container, and/or allow the same number of tables to be disposed in a significantly smaller space.

Yet another aspect is a table that may be nested with an adjacent table in a stacked configuration. Advantageously, the nested tables may have a significantly reduced height in comparison to conventional tables that do not nest together. For example, known tables may have a table top with a height of about 2.125 inches and thirty (30) of these known tables could be stacked with a height of at least 63.75 inches. An exemplary embodiment of a nested table may have a table top with a thickness of about 2.0 inches, but may overlap with an adjacent table by about 0.25 inches so the height of the nested table may only be about 1.75 inches when nested with another table. Thus, the height of thirty nested tables may be only about 52.75 inches because adjacent tables may nest together. In particular, because a portion of a table may be disposed within or overlap with an adjacent table in the nested configuration, that may allow the overall height of the nested tables to be decreased. Therefore, in this exemplary configuration, the height of the table in the nested configuration may only be about 1.75 inches. Consequently, the nested tables may have a reduction in height of between about 0.375 and 0.25 inches per stacked table in comparison to previously known tables. This may allow more tables to be disposed in a stacked configuration, which may greatly increase the number of tables that can be stacked on a pallet or shelf, or disposed in a shipping container or truck.

Still yet another aspect is a table that may be nested together with an adjacent table to reduce the overall height of the stacked tables. For example, a conventional table may have a blow-molded plastic table top with a height of about 2.0 inches and a frame with a height of about 1.625 inches. The height of the frame for this type of conventional table is more than eighty percent (80%) of the height of the table top in order to create a table with the needed strength and rigidity. The frame for this type of conventional table may have a rectangular cross-sectional configuration, which may help create a beam-type structure with two opposing walls that are separated by a generally constant distance. It was known that a decrease in the height of the frame may result in a decrease in strength of the table. It was also known that a decrease in the width of the frame may allow the table to undesirably twist and/or bend. In contrast to these known tables, the nested tables may have the same general height and appearance as a conventional table, and the same general strength and structural integrity as a conventional table, but the tables may nest together. The similar size and footprint of the tables may allow consumers to immediately deduce the nested tables have the same general strength, rigidity and torsion resistance as conventional tables. The nested tables, however, significantly decrease the height of two or more stacked tables. Because the nested tables may have a significant decrease in height in the nested configuration, this may result in considerable space savings that may be very important to the manufacturer during the manufacturing and shipping process; to the retailer when storing or displaying multiple tables; and/or to a consumer purchasing, transporting or storing more than one table.

A further aspect is a table that may be sized and configured to be nested such that the height of the nested tables is decreased by more than ten percent (10%). For example, the height of a single table may be about 2.0 inches. When the table is nested with another table, the height of the table may be about 1.75 inches because a portion of the tables are nested together. In this embodiment, the nested tables result in a decrease in height of each stacked table by about 0.25 inches. Therefore, the height of a table in the stacked configuration may be about twelve and one-half percent (12.5%) less than in the non-stacked configuration. Advantageously, this may allow tables to be more efficiently stored, transported and displayed because less space may be required. In another example, a standard pallet or shipping configuration may include twenty-one (21) conventional tables, but the tables with the nesting features disclosed herein may allow twenty-seven (27) or twenty-nine (29) tables to be disposed on a standard pallet or in a typical shipping configuration. If twenty-seven tables are disposed on a pallet or in a standard shipping configuration rather than twenty-one tables, then approximately twenty-eight percent (28%) more tables can be stored, transported or displayed. If twenty-nine tables rather than twenty-one tables are disposed on a pallet or in a standard shipping configuration, then a thirty-eight percent (38%) increase in the number of tables may be realized. Advantageously, this may result in significant savings and cost advantages because, for example, considerably more tables may be stored, transported or displayed in the same area; or the same number of tables may be stored, transported or displayed in an area that is at least twenty-five percent (25%) smaller. When large volumes of tables are being transported, such as in a standard or high-capacity shipping container, this may result in sizeable cost savings and advantages.

A still further aspect is a table that may be nested with an adjacent table such that the height of a nested table is decreased by approximately twenty percent (20%). For example, the height of a conventional blow-molded plastic table top is typically 2.0 or more inches. The table top height of a nested table may be about 2.0 inches when it is not nested with another table, but the height of the table may only be between about 1.5 and 1.75 inches when nested with another table. This may result in a significant reduction in height between twelve and one-half percent (12.5%) and twenty-five percent (25%) when two or more tables are nested together. In particular, if the nested tables are decreased in height by about twenty percent (20%), then the tables may have a height of about 1.6 inches in the nested configuration.

Another further aspect is a table that may include a receiving or nesting portion, such as a groove, channel or recessed portion, in an upper portion of the table top sized and configured to receive a portion of an adjacent table to facilitate nesting of the tables. For example, the receiving portion may be disposed about an upper surface and/or outer perimeter of the table top. In greater detail, the receiving portion may have a generally L-shaped configuration with a lower surface generally parallel to the upper surface of the table top and a side wall generally perpendicular to the upper surface of the table top. A portion of an adjacent table may be disposed in the receiving portion to allow the tables to be nested together. In particular, a portion of the frame, such as a projection or flange, and/or a portion of the table top, such as an edge or corner, may be disposed in the receiving portion. In greater detail, a portion of the side rails of the frame may be disposed in the receiving portion along the sides of an adjacent, nested table. A lower portion of a lip and/or the corners of the table top may be disposed in the receiving portion of the adjacent, nested table.

Yet another further aspect is a table that may include a frame sized and configured to facilitate stacking of the tables. For example, the frame may include an upper portion generally aligned with a lower portion of the table top. The upper portion of the frame may be disposed in a frame receiving portion in the lower portion of the table top and this may help maintain the frame in the desired position. The frame may also include a lower portion sized and configured to contact an upper portion of an adjacent, stacked table. The frame may further include an engaging portion sized and configured to be disposed in the receiving portion of an adjacent, nested table. The engaging portion may include a downwardly extending flange or projection sized and configured to fit within a receiving portion, such as a groove or cutout, of the adjacent, nested table. Advantageously, the frame may directly support at least a portion of the weight and/or forces applied to the tables in the nested configuration, which may help prevent damage to the tables. For example, when the tables are stacked in a horizontal configuration, the frame of one table may contact the adjacent, stacked table in a manner that allows the stacked tables to support a significant amount of weight without damage to the tables. This may allow ten, twenty, thirty or more tables to be disposed in a stacked configuration without damaging any of the tables. In addition, if the engaging portion of the frame is disposed in a receiving portion of an adjacent table, that may facilitate stacking, storing and/or shipping of the tables because that may help maintain the tables in the stacked configuration and ensure the weight is properly and/or evenly distributed.

Still yet another further aspect is a table that may be sized and configured to nest with an adjacent, stacked table in which a weight or load is supported in multiple areas, in different locations and/or by different surfaces. Advantageously, the multiple contact areas may allow stresses and forces to be disposed over a larger area and that may help prevent damage to the tables. For example, the table may include one or more contact areas sized and configured to contact the upper surface of the adjacent table top. In greater detail, the side rails of the frame may include a lower portion, such as a planar contact surface or load bearing surface, disposed generally parallel to an upper surface of the table top. In addition, the side rails of the frame may include an engaging portion, such as a downwardly extending flange or projection, sized and configured to be disposed in a receiving portion of the adjacent, stacked table. A lower portion of the flange may contact a lower surface of the receiving portion, which may be another load bearing surface. Additionally, the table may include other portions, such as corners or lips, sized and configured to be disposed in the receiving potion of the adjacent, stacked table. For instance, the corners and/or lips may include a compression edge that contacts the lower surface of the receiving portion, which may also be load bearing surfaces. When two or more tables are nested together, the multiple contact areas may facilitate stacking of the tables without marring or otherwise damaging the tables.

Another aspect is a table that may include a table top with one or more portions formed from compression molded plastic. For example, a portion of the corners and/or lip may be compression molded during the blow-molding process. Advantageously, the compression molded corners and/or lip may help create stronger, more rigid and/or more impact resistant structures, which may increase the durability and usefulness of the table. Significantly, compression molding may allow a portion of the corners and/or lip to be relatively thin because there is little or no gap or space between the walls of the compression molded plastic structure. The compression molded corners and/or lip may also be sized and configured to fit within a receiving portion of an adjacent, stacked table, which may facilitate stacking and nesting of the tables. The compression molded portions may further be sized and configured to contact a portion of the frame. For instance, a compression molded portion may be disposed along at least a portion of the lip and the side rail of the frame may contact or abut the compression molded portion, which may help position and maintain the frame in the desired position.

Still another aspect is a table that may include a compression edge. For example, if the table top is constructed from blow-molded plastic, the compression edge may be formed by the outer wall being folded onto itself such that the compression edge has a thickness approximately equal to twice the outer wall thickness. The compression edge may be disposed about all or a portion of the perimeter of the table top, such as the edges and/or corners. Advantageously, the compression edge may help provide increased strength, stiffness, structural integrity and/or impact resistance. The compression edge may also be sized and configured to be at least partially disposed in the receiving portion of an adjacent, nested table.

Yet another aspect is a table that may include a compression edge with different sizes. For example, the corners of the table top may include a compression edge that has a different size than a compression edge extending along the sides and/or ends of the table top. In particular, the table top may include a downwardly extending lip and the corners may include a compression edge that has a height generally equal to or greater than a majority of the height of the lip. The corners may also include a compression edge with a height generally or at least substantially equal to the height of the lip. The sides of the table top could include a compression edge that is smaller than the compression edge in the corners. For instance, the sides of the table top could include a compression edge with a height that is generally equal to or less than the height of the lip. The height of the compression edge disposed along the sides and/or ends of the table top may also be significantly smaller than the height of the lip. In an exemplary embodiment, the compression edge disposed along the sides of the table top may have a height between about 0.125 inches and about 0.25 inches, and the corners may include a compression edge with a height between about 0.25 inches and about 0.5 inches. The compression edge along the ends of the table top may have a height between about 0.125 inches and about 0.5 inches. Thus, the compression edge in the corners and/or ends of the table top may be two times or more times larger than the compression edge along the sides. The compression edges in the corners may be much larger, if desired, such as three, four, five or more times the height of compression edge along the sides and/or ends.

Still yet another aspect is a table that may include a handle or grip disposed in one or both ends of the table top. The handle may consist of a recess or opening in the downwardly extending lip of a table top and the handle may be integrally formed with the table top as part of a unitary, one-piece construction. Preferably, the handle is sized and configured to facilitate moving and transporting the table. In addition, the handle may assist in separating the tables in a stacked configuration. The table top may further include recesses or openings that may allow a portion of the frame to be disposed along the sides of the table top. For example, the sides of the table top may include openings that allow at least a portion of the frame to be exposed. Therefore, the ends of table may include openings in the lip that form the handles and openings in the sides that allow a portion of the frame to be exposed. Other portions of the frame may be inset and/or disposed inwardly from an outer perimeter of the table top, which may help protect the frame from damage.

Another aspect is a table that may include a frame with a first portion disposed along one side of the table top and a second portion disposed along a second side of the table top. In particular, the frame may include a first side rail disposed along a first side of the table top and a second side rail disposed along a second side of the table top. The side rails may extend along the length and/or width of the table top and the side rails may help support the table top and/or facilitate connection of the legs to the table top. Each side rail may include a body and the body may be elongated, have one or more engagement surfaces, and may be constructed from relatively strong materials such as metal. In greater detail, the body of the side rails may be disposed at least proximate a downwardly extending lip of the table top and the body of the side rails may be disposed generally vertically relative to the table top. The side rails may also include an upper portion and a lower portion. For example, the upper portion of the side rail may include a flange that extends inwardly at an angle, such as a right angle, to the body. The upper portion of the side rail may also include a second flange, such as an inner flange, that may extend downwardly. This inner flange may be disposed at least proximate the end of the upper portion of the side rail and it may be disposed generally parallel to the body of the side rail. The lower portion of the side rail may include a flange that extends outwardly towards an outer portion of the table top. The lower portion may also include a downwardly extending portion, such as a flange or projection, which may be disposed perpendicular to the lower portion of the side rail. If desired, the downwardly extending portion may have twice or double the thickness in comparison to other portions of the frame. In particular, the downwardly extending portion may be folded or bent back upon itself and include an upwardly extending portion sized and configured to contact a portion of the table top, such as a lower surface of the downwardly extending lip.

Yet another aspect is a table that may include a table top with one or more receiving portions sized and configured to receive a portion of the frame. For instance, the table top may include a frame receiving portion sized and configured to receive an upper portion of the side rail of the frame. In addition, the table top may include a sidewall sized and configured to contact the body of the side rail and a lip sized and configured to contact the lower portion of the side rail. If desired, an inner wall of the lip may form at least a portion of the sidewall and a lower portion of the lip may contact the lower portion of the frame. Advantageously, the table top may be sized and configured to help position and/or maintain the side rail in a desired position. Additionally, the table top may be sized and configured to help prevent the side rail from bending, twisting or otherwise moving, which may help create a stronger and sturdier table.

Still another aspect is a table that may include a frame with one or more generally L-shaped and/or U-shaped sections. For instance, the side rails of the frame may include an upper portion with a generally inverted U-shaped configuration and a lower portion with a generally U-shaped configuration. The upper portion of the frame may be sized and configured to be disposed in a frame receiving portion in a lower or underneath portion of the table top. The lower portion of the frame may be sized and configured to contact an adjacent table in a stacked, nested configuration. In particular, the lower portion of the frame may include a lower surface sized and configured to contact an upper surface of adjacent table in the nested configuration. The lower portion of the frame may further include an engaging portion sized and configured to be disposed in a receiving portion of an adjacent table in the nested configuration.

Still yet another aspect is a table that may include a frame that facilitates nesting and stacking of a plurality of tables. The frame may also help support a downwardly extending lip of the table top. For example, the frame may support an inner surface, lower surface and/or outer portion of the lip. In addition, the frame may provide multiple contact areas, such as a planar engagement surface and an engaging portion or flange, which may allow a load to be distributed over multiple areas when multiple tables are nested together. This may allow more tables to be disposed in a stacked configuration and/or help prevent damage to the tables.

A further aspect is a table that may include a frame with an inwardly disposed portion and an outwardly disposed portion. For example, the frame may include a first portion disposed towards an inner portion of the table top and a second portion disposed towards an outer portion of the table top. The inwardly disposed portion may be at least partially or substantially disposed inwardly from a downwardly extending lip of the table top while the outwardly disposed portion may contact and/or enclose at least a portion of the lip.

Another further aspect is a table that may include a frame and a portion of the frame may be disposed along an edge or perimeter of the table top. For example, the table top may include a lip with an opening and an outer portion of the frame may be disposed in or at least proximate the opening. Advantageously, this may allow a portion of the frame to be exposed and the exposed portion of the frame may indicate to consumers the table is strong, high-strength and durable. The exposed portion of the frame may be generally aligned with and/or spaced inwardly from an outer perimeter of the table top. The exposed portion of the frame may also be generally aligned with a lower portion of the table top, such as a lower surface of the corners, lip and/or ends. In greater detail, an opening may be disposed in the lip along the sides of the table top and the exposed portion of the frame may be disposed in and/or generally aligned with the openings. The lower portion of the frame may be aligned with a lowermost portion of the table top or it could extend outwardly more than other portions of the table top. Thus, in this configuration, the lower portion of the frame may form the lowermost portion of the table top. The exposed frame may also create a table with improved aesthetics and/or style. For instance, the exposed frame may provide a color contrast with the table top. That is, the table top may be one or more colors and the frame may have one or more different colors to create a table with a stylized appearance or an aesthetically pleasing design.

Yet another further aspect is a table that may include a table top with openings to allow a portion of a frame to be exposed and/or disposed proximate a perimeter of the table top. For example, the table top may include one or more openings that allow at least a portion of the frame to be exposed and disposed at least proximate the perimeter of the table top. These openings may extend along at least a majority of the length of the table top. The table top may also include one or more openings for a handle in the ends of the table top. The openings along the sides of the table top are preferably much larger than the openings in the ends of the table top, by a factor such as five, ten, twenty or more times the length of the opening for the handle.

A still further aspect is a table that may include a frame that contacts, engages and/or supports a lip and/or outer perimeter of the table top. Advantageously, if the frame is disposed along the outer edges of the table top, then the frame may provide increased support for the edges or extremities of the table top. In addition, if a portion of the frame is disposed below or proximate the lip, then the frame may help prevent the table top from being damaged. For example, the frame may absorb impacts or forces that otherwise may damage the table top.

Still yet another further aspect is a table that may include a frame with an engaging portion, such as a protrusion or flange, which facilitates nesting and stacking of the tables. The protrusion may be generally aligned with and/or disposed proximate a lower portion of the lip, such as a compression edge. Because the protrusion and compression edge may have double wall thicknesses, this may help prevent the table from being damaged. In greater detail, the protrusion may be formed by bending or folding the frame back upon itself so that it includes two adjacent, parallel walls and a rounded end. The compression edge may include an inner wall and an outer wall that are adjacent, parallel and preferably in contact. If desired, the protrusion and compression edge may include lower surfaces that are generally aligned and disposed in the same plane. Advantageously, the double wall thicknesses of the frame and lip may help prevent that table top from being damaged. Additionally, the double wall thicknesses may promote stacking and nesting of the tables because, for example, it may allow a strong, thin, resilient and/or damage resistant portion of a table to be disposed in a receiving portion of an adjacent table.

Another aspect is a frame for a table that may be less likely to undesirably bend or deform. For example, the frame may have a configuration that resists twisting or rotating when a load or force is applied to the frame. In addition, the frame may provide more balanced loading on the table when a load or force is applied. For instance, the frame could include multiple bends or angles, such as a plurality of right or 90° angles. Advantageously, the multiple angles may help increase the strength of the frame, resist twisting or rotating when a load or force is applied to the frame, and/or provide more balanced loading. The frame could also include one or more portions that are bent back or folded with a 180° angle such that portions of the frame have twice the thickness. This may also help increase the strength of the frame, resist twisting or rotating when a load or force is applied to the frame, and/or provide more balanced loading.

Yet another aspect is a table that may include a frame at least partially disposed in one or more receiving portions in the table top. The table top may also include one or more receiving portions that are sized and configured to receive other components of the table such as cross members, cross bars and the like. For example, the table top may include receiving portions that are sized and configured to receive an upper portion of a support structure. The table top may also include receiving portions that are sized and configured to receive a portion of the legs when the legs are in the collapsed position. In addition, the frame may include one or more openings that are sized and configured to facilitate attachment of the legs to the table. For instance, the frame may include openings that are sized and configured to receive the ends of a cross member and/or upper portion of a support structure. Depending upon the shape and arrangement of the frame, the openings in the frame may be circular or non-circular configuration. By extending the ends of the cross tube through openings in the frame, the legs may be securely connected to the table top.

Still another aspect is a table that may include a frame and leg assemblies that are constructed from relatively strong and durable materials such as metal, steel and the like. It will be appreciated, however, the frame and leg assemblies may be constructed from other materials with suitable properties and characteristics. In addition, the table, frame, leg assemblies and the like may have a variety of other suitable shapes, sizes, configurations and arrangements depending, for example, upon the intended use of the table.

Another aspect is a table that may include a frame and the frame may include side rails with a generally V-shaped cross-section or configuration. In greater detail, the V-shaped side rails may include first and second portions that are generally disposed between a 30° and 90° angle, such as about a 45° or 60° angle. The first and second portions of the side rails may also be disposed at different angles depending, for example, upon the intended use of the table.

Yet another aspect is a table that may include a frame with side rails that have different lengths. For example, an upper portion of the side rail may be larger than a lower portion of the side rail. In particular, an inwardly extending portion of the upper portion of the side rail may be larger than an outwardly extending portion of the lower portion of the side rail. Additionally, the ends of the side rails may have different configurations. For instance, the end of the upper portion of the side rail may be downwardly extending relative to a lower surface of the table top and the end of the lower portion of the side rail may be upwardly extending. In addition, a portion of the side rail may have twice the thickness compared to other portions of the side rail. Advantageously, the increased thickness may provide greater strength, stiffness, impact resistance, and/or rigidity, and it may be created by folding or bending a portion of the frame back upon itself to double the thickness.

Still another aspect is a frame for a table that may include an engaging portion with a rounded or curved end. The rounded end may have a generally circular configuration and it may prevent the engaging portion from having an exposed sharp edge. The engaging portion may be sized and configured to be disposed in a receiving portion of an adjacent, stacked table. For example, the rounded end of the engaging portion may be sized and configured to the receiving portion, which may create a relatively large area of contact between the adjacent, stacked tables.

Still yet another further aspect is a frame for a table that may include a side rail that is at least partially exposed. For example, an outer portion or edge of the side rail may be generally spaced apart from other portions the table top and not connected to other structures. This exposed portion of the side rail may be generally aligned with an outer portion of the table top or it may be inset or inwardly disposed from the outer perimeter of the table top, which may help protect the table from damage. The exposed portion of the side rail may also be disposed at an angle relative to an outer wall of the table top. In addition, the exposed portion of the frame may extend inwardly or outwardly relative to a lower surface of the table top and the exposed portion of the side rail may be generally aligned with and/or spaced inwardly from the bottom or lower surface of the lip.

A further aspect is a table that may include a table top with receiving portions sized and configured to receive at least a portion of the frame. For example, the table top may include a receiving portion, such as a groove or channel, which is sized and configured to receive at least a portion of the frame. In particular, the receiving portions may include walls that are sized and configured to contact or abut corresponding portions of the frame. For instance, the table top may have a generally U-shaped receiving portion with walls that are sized and configured to contact and abut corresponding portions of the frame. On the other hand, the receiving portions could have other suitable configurations, such as generally V-shaped, that are sized and configured to contact and abut the side walls of a generally V-shaped frame. If desired, the generally V-shaped groove may include a first side that is shorter than a second side, which may allow a portion of the frame to be exposed and/or unsupported. The second side of the generally V-shaped groove may be at least partially formed by one or more protuberances or portions that extend downwardly from the lower surface of the table top.

Another further aspect is a table that may include a frame with side rails that have a generally symmetric configuration. For example, the side rails may have a generally Z-shaped configuration with an inner portion disposed proximate the lower portion of the table top and an outer portion disposed proximate an outer edge of the table top. In greater detail, the inner portion may be sized and configured to be at least partially disposed in a receiving portion in the lower portion of the table top. The outer portion of the side rail may include a portion that is generally aligned with and/or parallel to the lip. In particular, the outer portion of the side rail may be disposed parallel to a lower portion of the lip. The lowermost portion of the side rail may include a generally planar surface sized and configured to contact an adjacent table in a stacked configuration. The lowermost portion of the side rail may be spaced inwardly from the perimeter of the table top and a portion of the lip, such as a compression edge, may extend beyond the lowermost portion of the side rail.

Another aspect is a frame that may be directly connected to a table top. For example, the frame may include one or more key-shaped openings and the table top may include one or more corresponding engaging portions. The engaging portions may be designed to be inserted into a larger portion of the key-shaped openings and then moved or slid into a smaller portion of the openings to help connect the frame to the table top. In addition, the engaging portions may be independent of and spaced apart from other structures of the table top and may allow the frame to be directly connected to a table top at several discrete locations. The engaging portions may also be formed in a frame receiving portion of the table top, such as the sidewall of a groove. The engaging portions may include a receiving portion, such as an undercut, and a portion of the frame may be disposed in the receiving portion to help connect the frame to the table top. Significantly, this may allow the frame to be directly connected to the table top and it may allow the frame to be connected to the table top without requiring any additional structures or components, such as fasteners. One or more fasteners, however, may be used to help prevent the frame from moving relative to the table top and/or help maintain the engagement of the frame and the engaging portion. Advantageously, if the frame is connected to the table top by the engaging portions, then the fasteners may not be used to primarily secure the frame to the table top. Instead, the fasteners may simply prevent the frame from moving relative to the table top. Accordingly, fewer fasteners may be required and the fasteners may be less likely to damage the table top because the fasteners may not be load bearing or supporting members. In addition, if the table top is constructed from molded plastic, then the engaging portions may be integrally formed during the molding process as part of a unitary, one-piece structure. One or more fasteners or other suitable structures, however, could be used to connect the frame and the table top.

Yet another aspect is a table that may be quickly and easily manufactured and assembled. For example, the side rails of the frame may be disposed in frame receiving portions formed in the table top and engaging portions may be disposed in openings in the frame. The frame may then be slid or moved so the engaging portions engage the frame to connect the frame to the table top. One or more fasteners may then be used to prevent the frame from moving relative to the table top. Advantageously, this may allow the table to be shipped in an unassembled configuration and consumers may be able to assemble the table, which may decrease manufacturing and shipping costs.

Another aspect is a table that may include a table top with a plurality of depressions. The plurality of depressions may be closely spaced and may cover at least a majority, substantially all, virtually all or all of a lower surface of the table top. The plurality of depressions may be disposed in a generally uniform pattern in which the depressions have generally the same size, shape configuration, orientation and arrangement. In addition, at least a majority of the depressions in the plurality of depressions may be spaced apart from one or more adjacent depressions by a generally consistent or uniform distance. Advantageously, the depressions may help create a table top with increased strength, rigidity and/or structural integrity. In addition, if the depressions in the plurality of depressions are generally uniformly spaced and disposed in a generally uniform pattern, that may help create a table top with generally uniform characteristics.

Yet another aspect is a table top that may include strengthening members, such as depressions, ribs, channels and the like, disposed proximate and/or adjacent structural support members or features of the table. For example, the table top may include a plurality of strengthening members disposed proximate and/or adjacent the frame. In greater detail, the table top may include one or more frame receiving portions that are sized and configured to receive the side rails of the frame and the frame receiving portions may include a plurality of strengthening members. When the frame is connected to the table top, the frame may cover all or a portion of the strengthening members in the frame receiving portion. The strengthening members in the frame receiving portions may be disposed in different arrangements and/or configurations, which may be used to create areas of increased strength and/or different characteristics. For instance, the strengthening members may be disposed in first and second configurations. In particular, the first configuration of strengthening members may be generally aligned in a first direction, such as along the length of the table top, while the second configuration of strengthening members may be generally aligned in a second direction, such as along a width of the table top. The first configuration of strengthening members may provide greater strength in one direction or location and the second configuration of strengthening members may provide greater strength in a second direction or location. Because the strengthening members can provide additional strength in different directions and/or locations, that may allow relatively strong, sturdy, stiff and/or rigid structures to be constructed.

A further aspect is a table top that may include strengthening members with different configurations and/or disposed in different locations to prevent or minimize potential points of weakness, stress concentrations and the like. For example, the strengthening members may be sized and configured to support areas of the table top disposed outside of the frame. The strengthening members may also be sized and configured to help prevent the table top from bending, collapsing or deflecting when a load or force is applied to the table top. Further, the strengthening members may be sized and configured to help prevent the table top from twisting or rotating relative to the frame. Advantageously, because the strengthening members may help support portions of the table top disposed above the frame and/or the edges; a strong, sturdy and well-supported table may be created. This may further facilitate stacking and nesting of the tables because, for example, the lower tables in the stack of tables may be unlikely to be damaged by the weight of the stacked tables.

Still another aspect is a table top that may include one or more strengthening members disposed between and/or connecting a frame receiving portion and an outer portion of the table top such as a lip. In particular, one or more strengthening members may connect the frame receiving portion and a portion of the lip, such as an inner wall or sidewall of the lip. In greater detail, one or more strengthening members may be at least partially disposed in the upper surface and/or sidewalls of the frame receiving portion and in at least a portion of a sidewall of the lip. Because the strengthening members may connect the frame receiving portion and the lip, the strengthening members may increase the strength and/or structural integrity of the frame receiving portion and/or the lip. Additionally, because the frame may cover at least a portion of the frame receiving portion and the sidewall of the lip, these strengthening members may be generally hidden from view.

Still yet another aspect is a table top that may include a plurality of strengthening members that are generally aligned. For instance, the strengthening members may include a body that is generally aligned with an axis and each strengthening member of the plurality of strengthening members may be generally aligned along the same axis or parallel axes. Advantageously, because the strengthening members generally aligned with an axis may have increased strength, structural integrity and/or other characteristics in a particular direction, such as along the axis, aligning the strengthening members along the same axis or parallel axes may help create a table top with generally uniform properties and characteristics. The table top may further include another plurality of strengthening members that are generally aligned along a different axis. For example, the strengthening members disposed along the different axis may provide increased strength, structural integrity and/or other characteristics along this axis. Therefore, the strengthening members disposed along different axes may be used to created portions of the table top with different characteristics. This may allow, for example, some of the strengthening members in the frame receiving portion to be disposed along a first axis, such as generally aligned with a length of the table top, and other strengthening members to disposed along a second axis, such aligned with a width of the table top. If desired, one or more of the strengthening members may be sized and configured to help support the outer edges or sides of the table top. For instance, the strengthening members may help prevent the outer edges of the table top, which may not be directly supported by the frame, from unintentionally bending, twisting or deflecting.

A further aspect is a table top may include strengthening members, such as ribs, disposed in an outer edge or lip of the table top. For example, the table top may include a lip or edge and a plurality of strengthening members may be formed in the lip. In particular, the inner surface of the lip, such as a sidewall, may include a plurality of inwardly extending strengthening members. In addition, these strengthening members may be at least partially disposed in a frame receiving portion. Significantly, the strengthening members may provide increased strength, stiffness, rigidity and/or structural integrity to portions of the table top such as the portion of the table top disposed above the frame and portions of the table top that extend beyond the frame such as the lip. Advantageously, the strengthening members may also help prevent undesired bending, twisting or deflecting of the table top.

Another further aspect is a table top that may include strengthening members and depressions with different shapes, sizes, arrangements, orientations and/or configurations. For example, the majority or substantially the entire center portion of the table top may include depressions with generally uniform shapes, sizes, arrangements, orientations and configurations. This may help create a table top with generally constant characteristics. The side or edges of the table top, however, may include depressions or strengthening members with different shapes, sizes, arrangements, orientations and/or configurations. For instance, the edges of the table top may include a first group of depressions generally aligned in a first direction and a second group of depressions generally aligned in a second direction. If desired, the first direction may be generally perpendicular, or at an angle such as about 30°, 45° or 60°, to the second direction. Because the depressions or strengthening members may be aligned in different directions, portions of the table top may have different characteristics. The strengthening members proximate the edges of the table top may also have different configurations. For example, a first group of strengthening members may be disposed in frame receiving portion and a second group of strengthening members may be disposed in at least a portion of the frame receiving portion and the lip. These strengthening members may support the portion of the table top disposed above the frame and/or the portion of the table top extending beyond the frame.

Another aspect is a table that may include a leg clip sized and configured to secure a leg or support structure in a fixed position relative to the table top when the support structure is in a collapsed position. For example, the leg clip may include a base attached to the table top. The base may be at least partially attached to and/or disposed in a depression or receiving portion in a lower surface of the table top. The base may also be disposed at an angle relative to the depression and/or one or more of the adjacent or surrounding depressions. In addition, the base may include an upper surface that is generally aligned within or disposed below the lower surface of the table top. If desired, the leg clip may be at least partially disposed within a groove or channel in the lower surface of the table top. For instance, a channel may be formed in the lower surface of the table top to receive a portion of the support structure in the collapsed position and the leg clip may be at least partially disposed within the channel. Additionally, one or more depressions may be formed in the channel and the leg clip may be at least partially disposed in a depression in the channel.

Yet another aspect is a table that may include spacers, inserts or pads, which may facilitate stacking of the tables. For example, when tables are stacked and/or nested for manufacturing, transportation, storage, display and the like, a significant amount of weight or force may be applied to the tables. The weight or force may be particularly significant for the tables disposed towards the lower portion of the stack. In addition, because the features disclosed herein may allow significantly more tables to be stacked (such as stacking twenty-seven (27) or twenty-nine (29) tables on a pallet rather than the traditional stacking of twenty-one (21) tables on a pallet), a considerable amount of weight or force may be applied to the tables. The spacers, inserts or pads may be used to prevent damage to the tables. For instance, a pad may include a clip sized and configured to be attached to a portion of the frame, such as a cross member, support structure or other suitable portion of the frame. The pad may include a generally planar surface sized and configured to contact an upper surface of an adjacent table. The pad may help distribute the weight or force more equally, evenly and over a larger surface area on the adjacent table. Advantageously, because the pad may be attached by a clip, that may allow the pad to be easily and quickly attached and/or removed by the manufacturer, retailer, consumers and the like. In addition, the number of pads may depend upon the number of tables to be stacked. For instance, a larger number of pads may be used if a greater number of tables are to be stacked.

Still another aspect is a table that may include one or more foot caps attached to the feet of the legs. For example, the table may include legs or a support structure with two elongated members connected by a connecting member. The elongated members may be constructed from tubular pieces of metal with a generally circular, oval, oblong or rectangular cross-sectional configuration. The elongated members may be bent or curved such that the upper portions of the elongated members are spaced closer together than the lower portions of the elongated members. This may help create, for example, a more stable table with increased leg room. The foot caps may include an upper portion securely connected to the ends of the elongated members and a lower portion that contacts a support surface such as the ground or floor. Because the ends of the elongated members may be disposed at an angle, such as about 8°, which may be caused by bending the elongated members into the desired shape or configuration, the foot caps are preferably designed to include a lower surface that is disposed parallel to the floor. In addition, the elongated members and the foot caps may include alignment members. For instance, the elongated members may include a notch, cutout, groove, indentation or the like; and the foot caps may include a corresponding projection, protrusion, protuberance or the like. These alignment members may help ensure the elongated members and foot caps are correctly attached in the desired positions and configurations.

Still yet another aspect is a table that may include a combination of features, aspects and the like, such as one or more of those discussed above. For example, the table can include a frame with engaging portions that are sized and configured to be disposed in a receiving portion of an adjacent table when the tables are nested together. The table can also include one or more compression edges sized and configured to be disposed in the receiving portion of the adjacent, nested table. Thus, the frame and compression edges may facilitate alignment and nesting of the tables in a stacked configuration. Further, the table may include depressions or strengthening members disposed proximate or adjacent portions of the frame, such as the side rails, and these structures may be sized and configured to increase the strength, rigidity and/or structural integrity of the portion of the table top disposed above and/or proximate the frame, and/or portions of the table top that are not directly supported by the frame. In addition, the table may include depressions and/or strengthening members disposed at an angle relative to the bottom surface of the table top. For instance, the table may include strengthening members in the lip disposed perpendicular to the lower surface of the table top. Additionally, the table may include openings or recesses in the sides that allow a portion of the frame to be exposed and readily visible when the table is being used or stored, and openings in the ends to create handles.

A further aspect is a table that may be constructed from one or more materials and processes. For example, the table top may be constructed from molded plastic, such as blow-molded plastic. The frame and legs may be constructed from high-strength materials such as steel. In particular, the frame and/or legs may be constructed from high-strength, low-alloy (HSLA) steel rather than traditional carbon steel. Importantly, HSLA steel may be twenty to thirty percent (20 to 30%) lighter than carbon steel with the same strength. Therefore, a table constructed with HSLA steel may be lightweight and have the same strength as a conventional table constructed with a carbon steel frame because a smaller gage of HSLA steel can be used. For example, sixteen (16) or eighteen (18) gage HSLA steel may be used to construct the table, which is smaller than traditional steel. HSLA steel, however, has not been previously used in this or other related industries because it is much more expensive than traditional steel. That is, HSLA steel is cost prohibitive. The reduction in the amount of steel required to manufacture the table with one or more of the features disclosed herein, however, may be more than sufficient to offset or justify the price of the more expensive HSLA steel. In particular, because the amount of steel required to create the table with the disclosed features may be significantly less than the amount of steel required to create a corresponding traditional table, HSLA steel may no longer be cost prohibitive. Thus, because less steel may be required and/or HSLA steel may be stronger and lighter weight, the table can be manufactured with HSLA steel.

These and other aspects, features and advantages of the present invention will become more fully apparent from the following brief description of the drawings, the drawings, the detailed description of preferred embodiments and appended claims.

BRIEF DESCRIPTION OF THE DRAWINGS

The appended drawings contain figures of exemplary embodiments to further illustrate and clarify the above and other aspects, advantages and features of the present invention. It will be appreciated that these drawings depict only exemplary embodiments of the invention and are not intended to limits its scope. Additionally, it will be appreciated that while the drawings may illustrate preferred sizes, scales, relationships and configurations of the invention, the drawings are not intended to limit the scope of the claimed invention. The invention will be described and explained with additional specificity and detail through the use of the accompanying drawings in which:

DETAILED DESCRIPTION OF PREFERRED EMBODIMENTS

The present invention is generally directed towards tables. The principles of the present invention, however, are not limited to tables. It will be understood that, in light of the present disclosure, the tables disclosed herein can have a variety of shapes, sizes, configurations and arrangements. In addition, while the tables shown in the accompanying figures are banquet or utility tables, it will be appreciated the tables may have any suitable style or configuration such as round, personal, conference or card tables. Further, the invention disclosed herein may be successfully used in connection with other types of furniture and/or structures.

Additionally, to assist in the description of preferred embodiments of the tables, words such as top, bottom, front, rear, right and left may be used to describe the accompanying figures which may be, but are not necessarily, drawn to scale. It will further be appreciated the tables can be disposed in a variety of desired positions or orientations, and used in numerous locations, environments and arrangements. A detailed description of preferred embodiments the table now follows.

Figure 1:
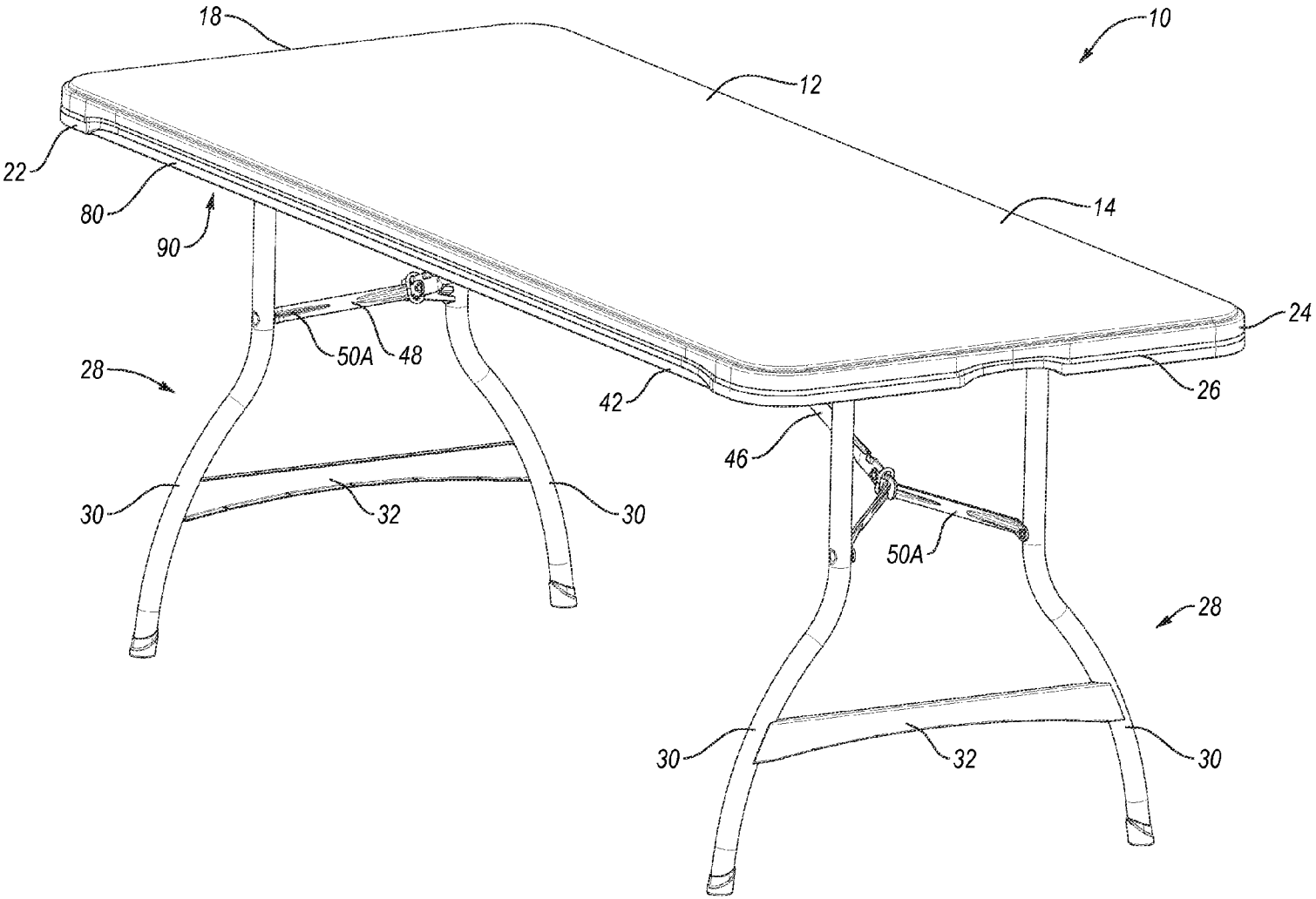
FIG. 1 is an upper perspective view of an exemplary table.
Figure 2:
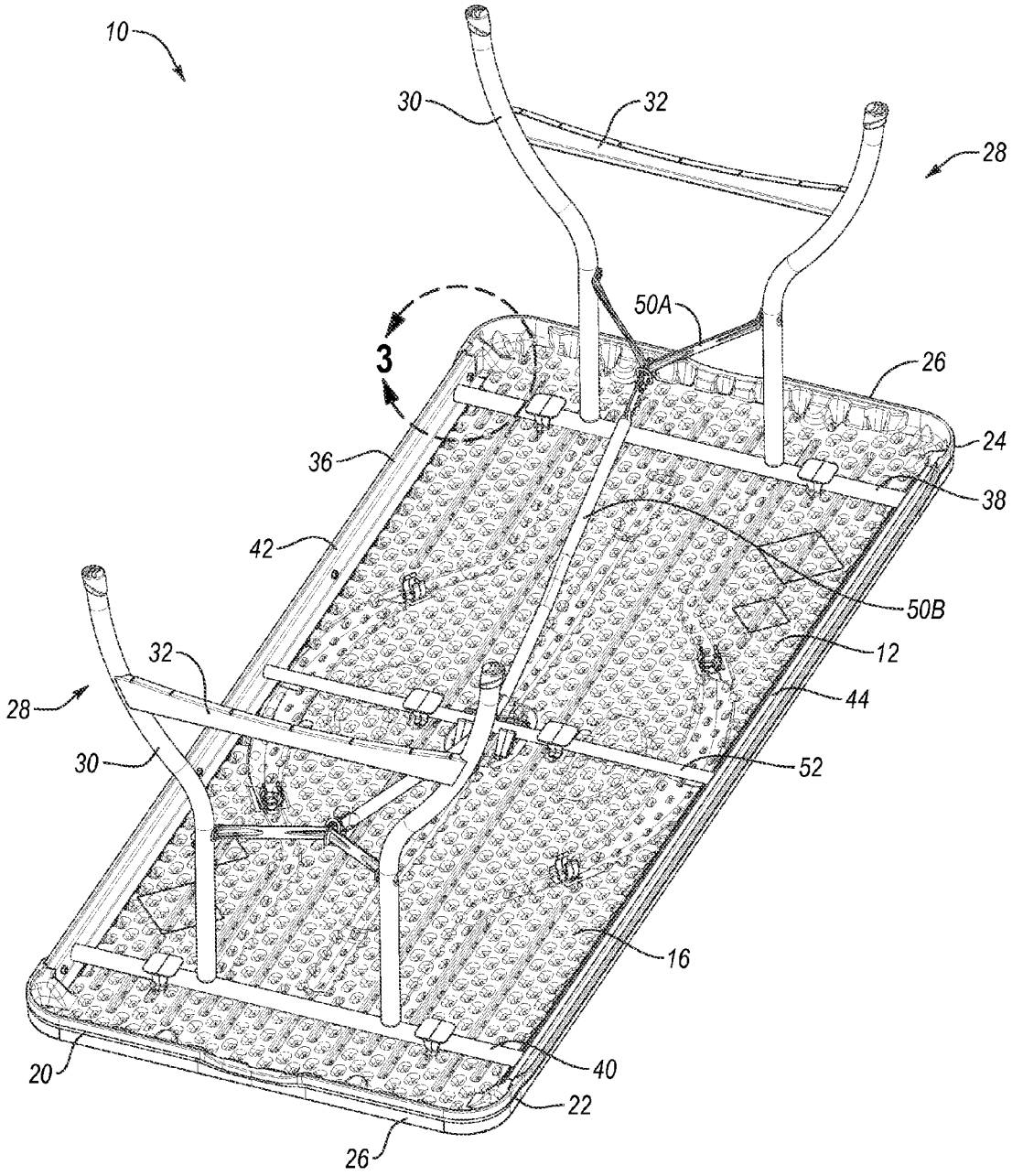
FIG. 2 is a lower perspective view of the table shown in FIG. 1.

As shown in FIGS. 1 and 2, an exemplary table 10 may include a table top 12 and the table top may be constructed from molded plastic. The table top 12 may include an upper portion 14, such as an upper surface; a lower portion 16, such as a lower portion, and a perimeter 18. As shown in the accompanying figures, a sidewall may be disposed about the perimeter 18 of the table top 12. The upper portion 14 may be spaced apart from the lower portion 16 of the table top 12 by a distance, which may be a generally constant distance. The table top 12 may also include a hollow interior portion disposed between the upper and lower portions 14, 16 of the table top. In addition, the table top 12 may include a lip 20, which may extend downwardly from the lower portion 16 of the table top. The table top 12 may further include one or more sides 22, corners 24 and ends 26. The table top 12, including the upper portion 14, the lower portion 16, the hollow interior portion, the lip 20, the sides 22, the corners 24 and/or the ends 26, may be integrally formed as part of unitary, one-piece structure during the molding process. If the table top 12 is constructed from plastic, it may be formed in the desired shape by blow-molding, injection molding, rotary molding, and/or other suitable processes. It will also be appreciated that the table top 12 may be constructed using various materials such as wood, metal and the like.

The table 10 may also include a one or more support structures 28, which may be sized and configured to support the table top 12 above a surface such as the floor or ground. The support structures 28 may include one or more legs or supports 30 and the support structures may be movable between an extended or use position and a collapsed or storage position relative to the table top 12. As shown in the accompanying figures, the support structures 28 may include a pair of legs or supports 30 and a connecting member 32 may interconnect the supports.

The table 10 may include a frame 36 that is connected to the table top 12. If desired, the support structures 28 may be connected to the frame 36. In addition, the support structures 28 may be movably connected to the frame 36 to allow the legs 30 to move between an outwardly extending or use position and a collapsed or storage position. For example, the support structures 28 may include or be connected to cross members 38, 40 and the legs 30 may be connected to the cross members. The cross members 38, 40 may then be connected to the frame 36. In particular, the frame 36 may include elongated support members or side rails 42, 44 and the cross members 38, 40 may be connected to the side rails. It will be appreciated that the cross members 38, 40 may also be part of the frame 36. The side rails 42, 44 may extend along the length and/or width of the table top 12 and the side rails may help support the table top and/or facilitate connection of the support structures 28 and/or cross members 38, 40 to the table top.

The support structures 28 and/or the legs 30, however, do not have to be connected to the cross members 38, 40 or the frame 36. Instead, the support structures 28 and/or the legs 30 may be connected to any suitable portions of the table 10. It will also be appreciated that the table 10 may include any suitable number of support structures 28 and/or legs 30 depending, for example, upon the intended use of the table. It will also be appreciated that the table top 12, the support structures 28 and the legs 30 may have various sizes, shapes, configurations and arrangements depending, for example, upon the intended use of the table 10. It will further be appreciated that the frame 36, the side rails 42, 44 and/or the cross members 38, 40 are not required; and the table 10 may have other components, features, aspects, characteristics and the like, if desired.

The table 10 may also include first and second brace assemblies 46, 48, which may be connected to the support structures 28. In particular, the brace assemblies 46, 48 may be connected to the legs 30 and may be sized and configured to allow the legs to move between the use and storage positions. As shown in FIG. 2, the brace assemblies 46, 48 may include a first portion 50A connected to the legs 30 and a second portion 50B connected to a cross member 52 and/or the table top 12. The first and second portions 50A, 50B may be interconnected to form the brace assemblies 46, 48.

The table 10 is preferably sized and configured to be stacked with one or more additional tables. In particular, the stacked tables 10 are preferably nested together to reduce the height of the stacked tables, which may allow the tables to be shipped, stored and transported in a smaller area. This may result in significant cost savings to the manufacturer, for example, because less storage space may be required and a substantial reduction in transportation costs may be achieved.

The frame 36 may be sized and configured to facilitate nesting of the tables 10. For example, as shown in FIG. 2, the side rails 42, 44 of the frame 36 may be disposed along the sides 22 of the table top 12. Advantageously, if the side rails 42, 44 are disposed proximate the sides 22 of the table top 12, then the sides of the table top may be supported by the frame 36, which may help create a strong and sturdy table 10. In addition, the side rails 42, 44 may be sized and configured to help transfer forces towards a center portion of the table and away from the perimeter 18, which also help create a strong and sturdy table 10.

Figure 3:
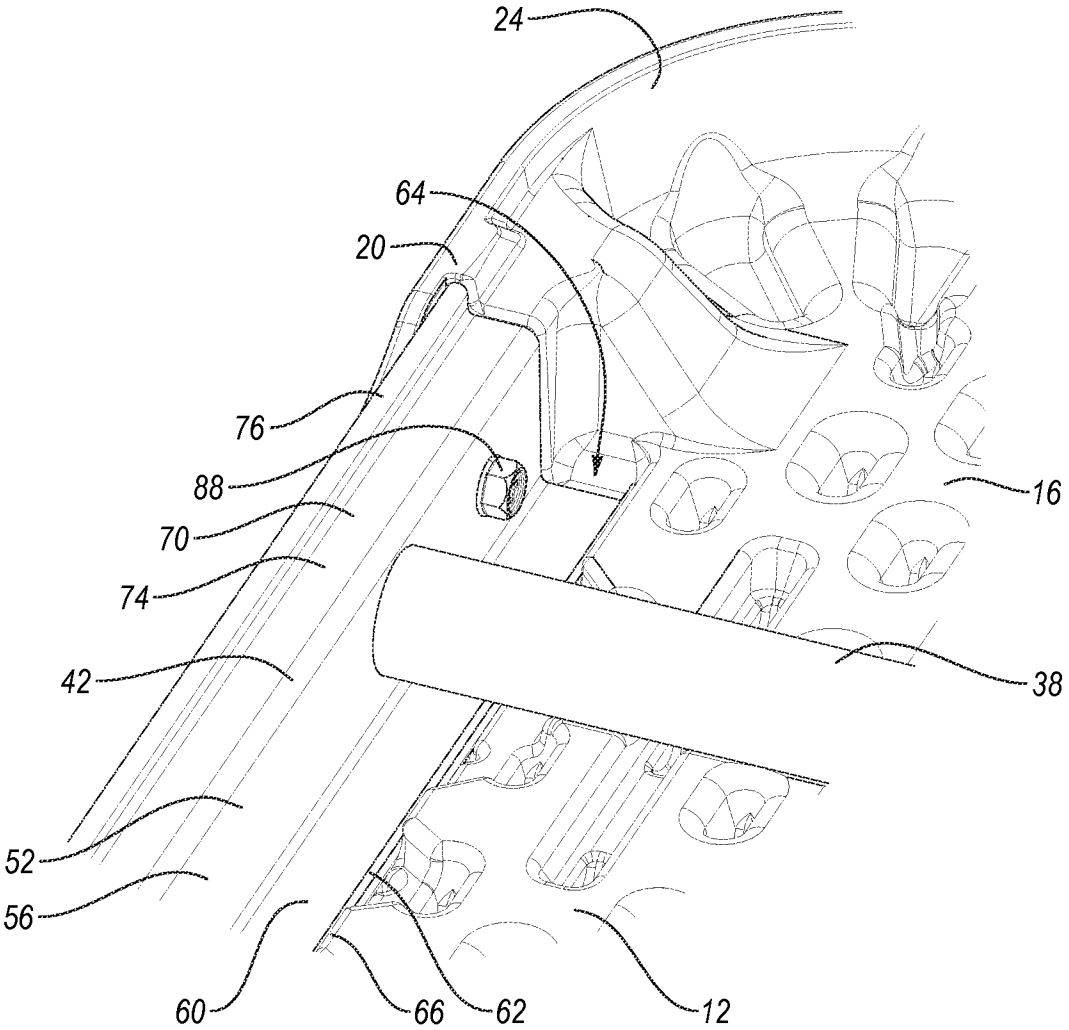
FIG. 3 is an enlarged perspective view of a portion of the table shown in FIG. 2.

As best seen in FIGS. 3-6, the exemplary side rail 42 may have a body 54 with an inner surface 56 and an outer surface 58. The side rail 44 preferably has a similar or complementary configuration, as shown in the accompanying figures. The body 54 may have a generally planar configuration and it may extend almost the entire length of the table top 12. The body 54 may also be disposed generally vertically and perpendicular to the lower portion 16 of the table top 12. The side rail 42 preferably includes multiple angled portions or flanges, which may help increase strength, rigidity and torsion resistance. For example, the side rail 42 may include an upper portion 60 that is disposed generally perpendicular or at a right angle with respect to the body 54. The upper portion 60 may include a downwardly extending flange 62 and the upper portion preferably extends inwardly towards a center portion of the table top 12. As shown in FIG. 3, the upper portion 60 of the side rail 42 may have a generally U-shaped configuration and it may be disposed within a frame receiving portion 64 in the lower portion 16 of the table top 12. In particular, an upper surface of the upper portion 60 of the side rail 42 may contact or abut a lower surface of the frame receiving portion 64 and an outer surface of the flange 62 may contact an inner sidewall 66 of the frame receiving portion.

The side rail 42 may also include a lower portion 68 that extends outwardly towards an outer portion of the table top 12. The lower portion 68 may include a connecting portion 70 that is disposed at an angle, such as a right angle, to the body 54 of the side rail 42. The connecting portion 70 may have a generally planar configuration with an upper surface 72 that is disposed towards a lower surface of the lip 20 and a lower surface 74. The lower portion 68 of the side rail 42 may also include an engaging or engagement portion 76, such as a projection or flange, which may extend downwardly and at a right angle relative to the lower surface 74. The engaging portion 76 may have an engagement surface 78, which may be rounded or curved surface. The lower portion 68 of the side rail 42 may also have an upwardly extending portion 80 with an end 82. As shown in FIG. 1, for example, an outer surface of the upwardly extending portion 80 may be exposed and visible when the table 10 is viewed from the side.

If a portion of the frame 36, such as the side rails 42, 44, is disposed below or proximate the lower portion of the lip 20, then the frame may help prevent the table top 12 from being damaged. This may allow the frame 36 to absorb impacts or forces that otherwise may damage the table top 12. For instance, as shown in FIG. 1, the lower portion of the side rail 42 may extend below the lower portion of the lip 20 along the sides 22 of the table top 12. In addition, the lower portion of the side rail 42 may be aligned with and coplanar with a lower portion of the corners 24 and the ends 26.

Figure 4:
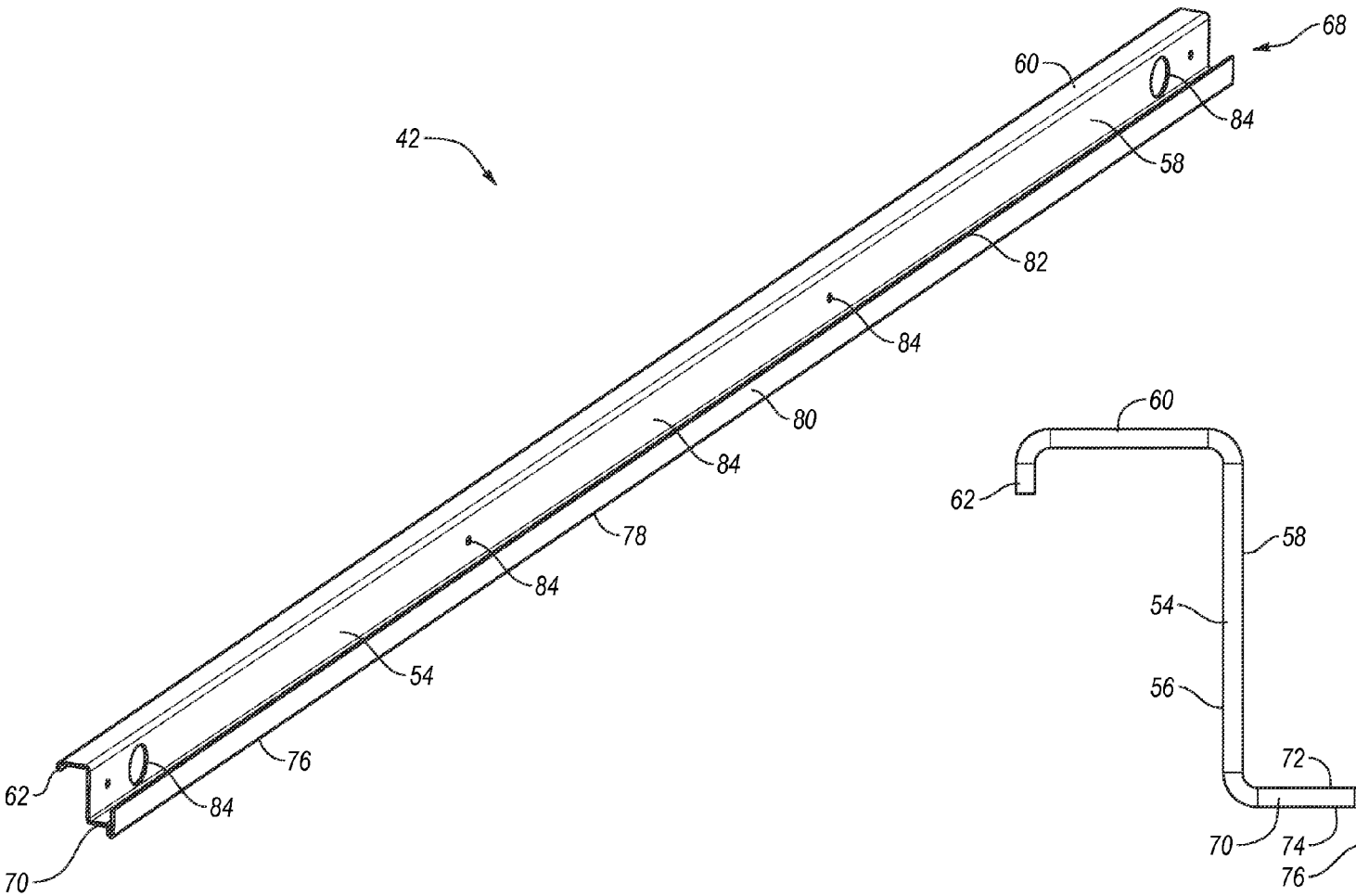
FIG. 4 is a perspective view of a portion of the table shown in FIG. 1, illustrating a side rail of a frame.
Figure 5:
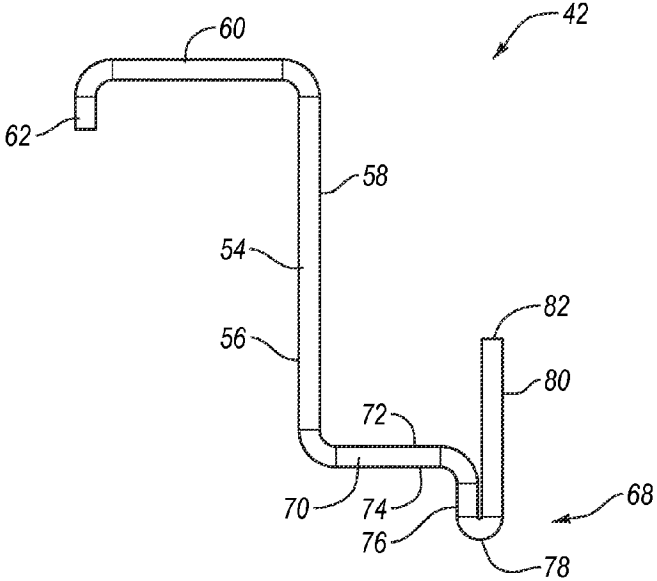
FIG. 5 is an enlarged side view of the side rail of the frame shown in FIG. 4.

As shown in FIG. 4, the side rail 42 may include apertures 84 and the apertures may be sized and configured to allow the cross members 38, 40 to be connected to the frame 36. The apertures 84 may also allow the cross member 52 to be connected to the frame 36. Further, as shown in FIG. 3, the apertures 84 may facilitate the use of fasteners 88 to attach the side rails 42, 44 of the frame 36 to the table top 12. In particular, the apertures 84 may facilitate attachment of the side rails 42, 44 of the frame 36 to the lip 20 of the table top 12.

Figure 6:
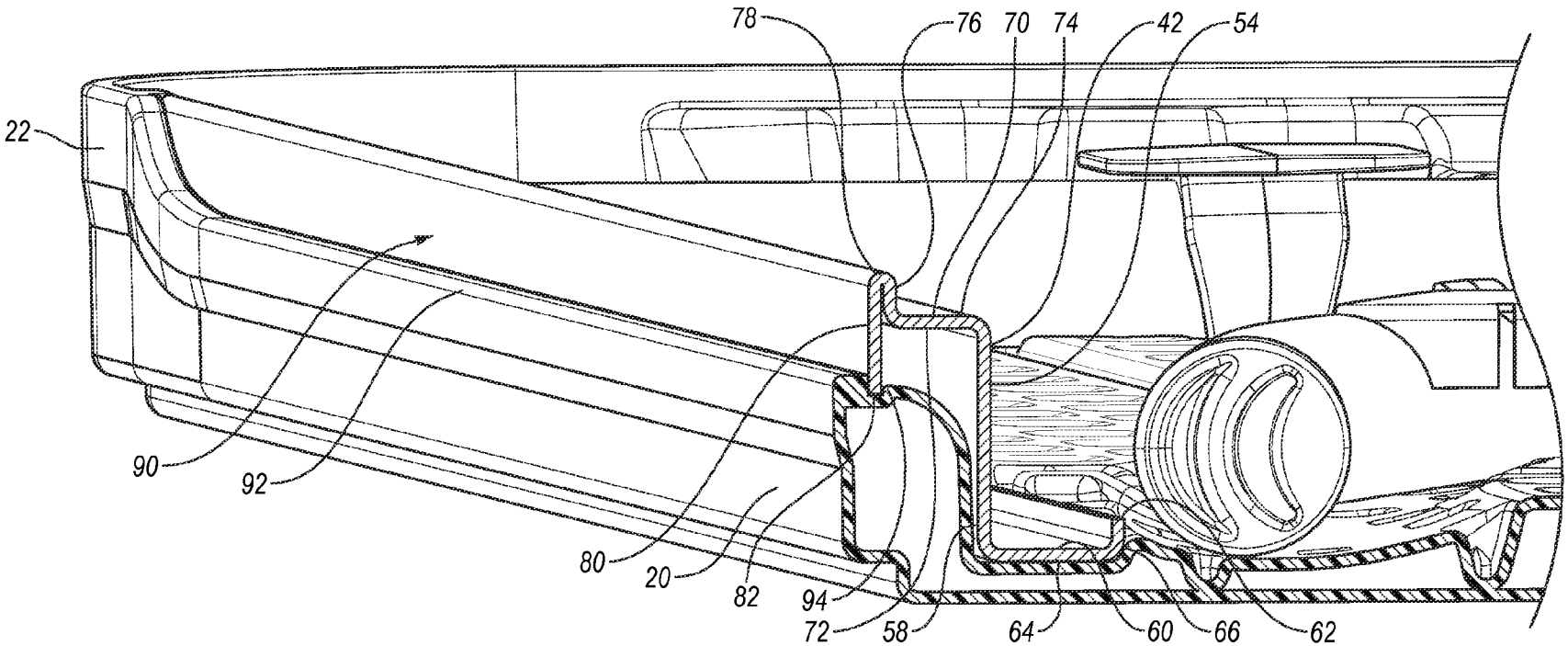
FIG. 6 is a cross-sectional side view of a portion of the table shown in FIG. 1.

As shown in FIG. 6, the side rail 42 may be disposed proximate the lip 20 and the outer surface 58 of the body 54 may contact or abut an inner wall of the lip. Advantageously, this may allow the frame 36 to help support the lip 20. The upper portion 60 of the side rail 42 may be disposed in the frame receiving portion 64, which may be integrally formed in the table top 12 as part of a unitary, one-piece construction. In particular, an upper surface of the upper portion 60 may contact or abut a lower surface of the frame receiving portion 64 and an outer surface of the flange 62 may contact or about the sidewall 66. The positioning of the frame receiving portion 64 adjacent to the lip 20 may help facilitate positioning of the side rail 42 and may help prevent the frame 36 from undesirably moving or bending when a load or force is applied to the table 10.

The lower portion 68 of the side rail 42 may be at least generally disposed below a lower portion of the lip 20. For example, the connecting portion 70 may be spaced apart from the lower portion of the lip 20 by a distance. In particular, the upper surface 72 of the connecting portion 70 may be spaced apart from the lower surface of the lip 20 and the connecting portion may be disposed generally parallel to the lower portion of the lip. The engaging portion 76 may extend downwardly and the engagement surface 78 may be generally aligned with or disposed in generally the same plane as a lowermost portion of the table top 12, such as a lower surface of the corners 24. The upwardly extending portion 80 of the side rail 42 is preferably disposed in or proximate an opening or recess 90 in the lip 20, which may allow a portion of the side rail to be visible or exposed. The end 82 of the side rail 42 may contact or abut the lower surface of the lip 20. In addition, the end 82 of the side rail 42 may contact or abut an inner surface of an edge 92, such as a compression edge, of the lip 20. As shown in FIG. 6, an alignment member 94 may be disposed in the lower surface of the lip 20 and the end 82 of the side rail 42 may be disposed between the compression edge 92 and the alignment member 94, which may help position the frame 36 and/or prevent the side rail from undesirably moving or bending.

Advantageously, the compression edge 92 and the alignment member 94 may be integrally formed with the table top 12 as part of a unitary, one-piece construction. In addition, if the table top is constructed from blow-molded plastic, the compression edge may be formed by the outer wall being folded onto itself such that the compression edge has a thickness approximately equal to twice the outer wall thickness. The compression edge may help provide increased strength, stiffness, structural integrity and/or impact resistance.

The side rail 42 may be quickly and easily formed into the exemplary configuration shown in the accompanying figures. For instance, a sheet of material, such as steel, may be shaped into the desired configuration. In addition, the side rail 42 may be quickly and easily disposed in a desired position because the upper portion 60 may be disposed in the frame receiving portion 64, the outer surface 58 of the body 54 may engage the inner surface of the lip 20, and the end 82 may be disposed between the compression edge 92 and the alignment member 94. Also, because only one or more fasteners may be required to connect the side rail 42 to the table top 12, this may expedite the manufacturing process. Additionally, the engaging portion 76 may have increased strength because it may have double or twice the thickness as other portions of the side rail 42. Thus, the engaging portion 76 may have increased strength, rigidity and/or impact resistance.

Figure 7:
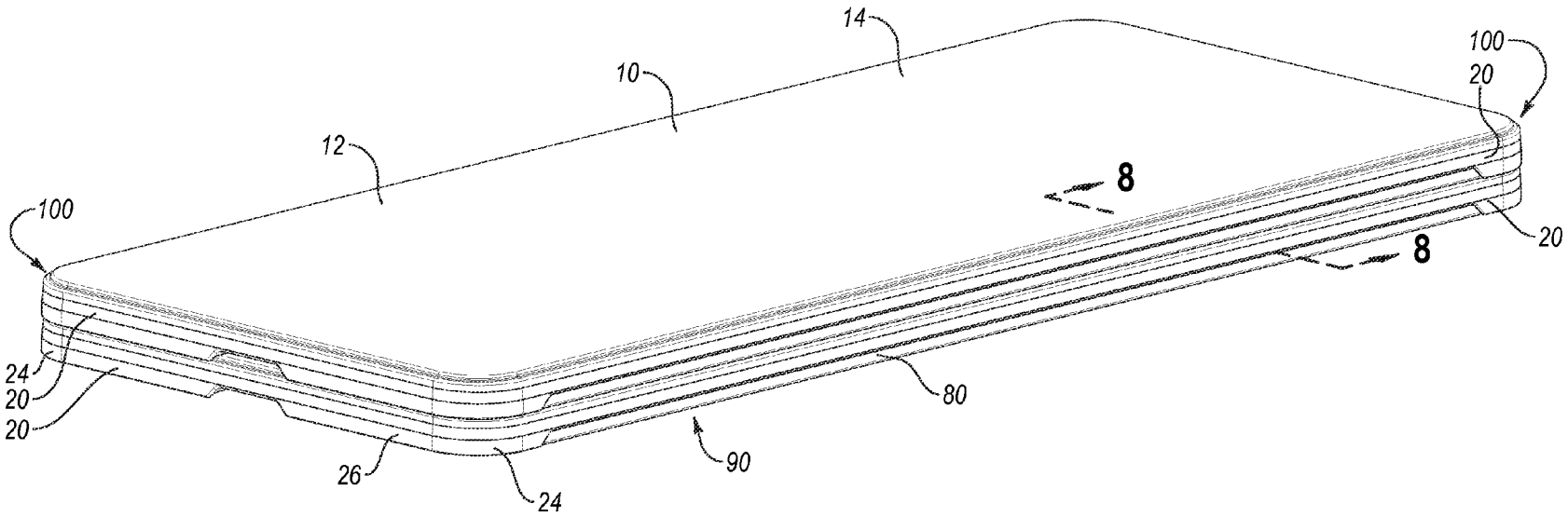
FIG. 7 is an upper perspective view of two exemplary tables disposed in a nested and stacked configuration.

As discussed above, the side rails 42, 44 of the frame 36 may assist in stacking and nesting of the tables 10. For example, as shown in FIG. 7, two tables 10 may be stacked and nested together. Advantageously, if the tables 10 are nested together, this may reduce the height of the stacked tables. For instance, if twenty-one (21) tables can be stacked on a conventional pallet, then 798 conventional tables may be loaded into a conventional forty foot high-capacity container. The nested tables 10 shown in the accompanying figures, however, may allow twenty-six (26) tables to be loaded on a conventional pallet. Significantly, this may allow 988 tables to be loaded in the same forty foot high-capacity container. Thus, the nesting tables 10 allow 190 more tables to be shipped in each container. Therefore, approximately twenty-five percent (25%) more tables can be shipped in the same size container, which may considerably reduce shipping costs.

Figure 8:
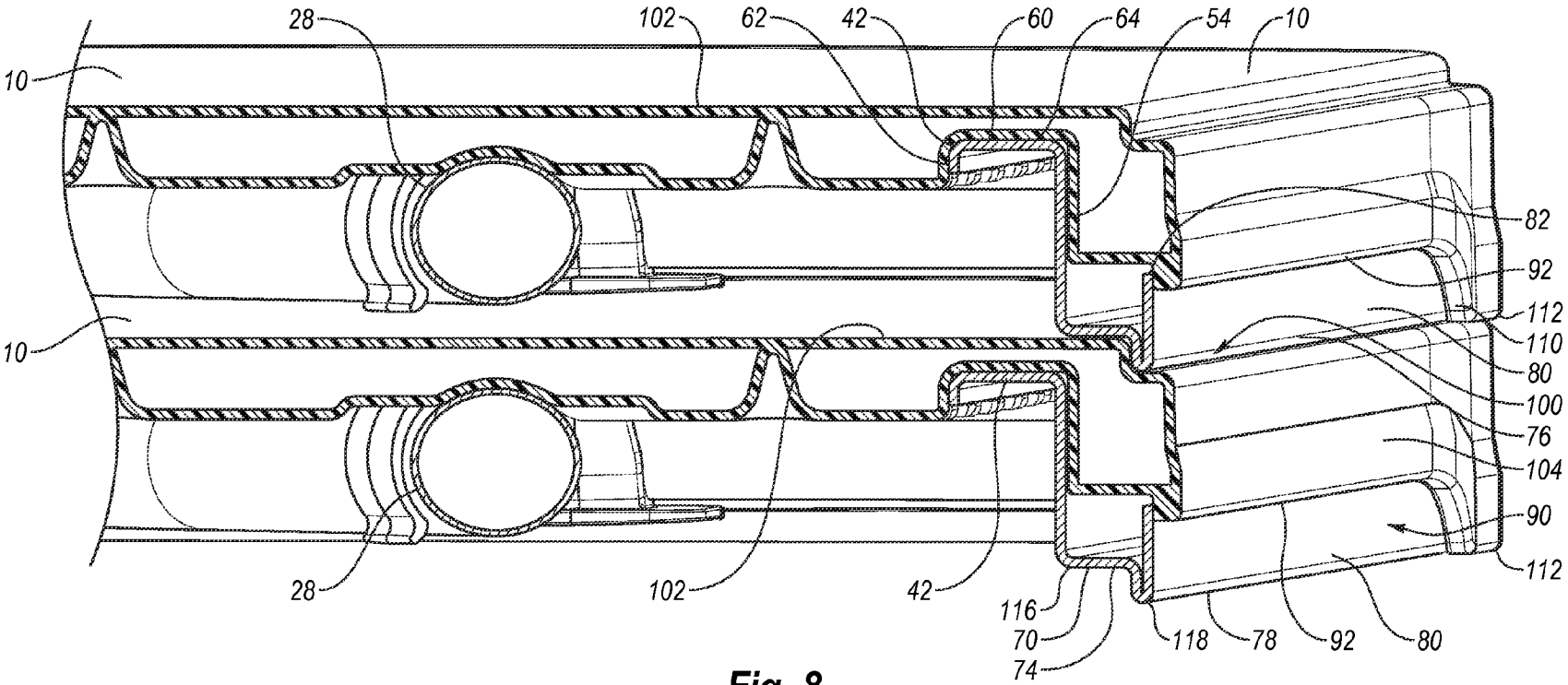
FIG. 8 is a cross-sectional side view along section line 8-8 of a portion of the tables shown in FIG. 7.
Figure 9:
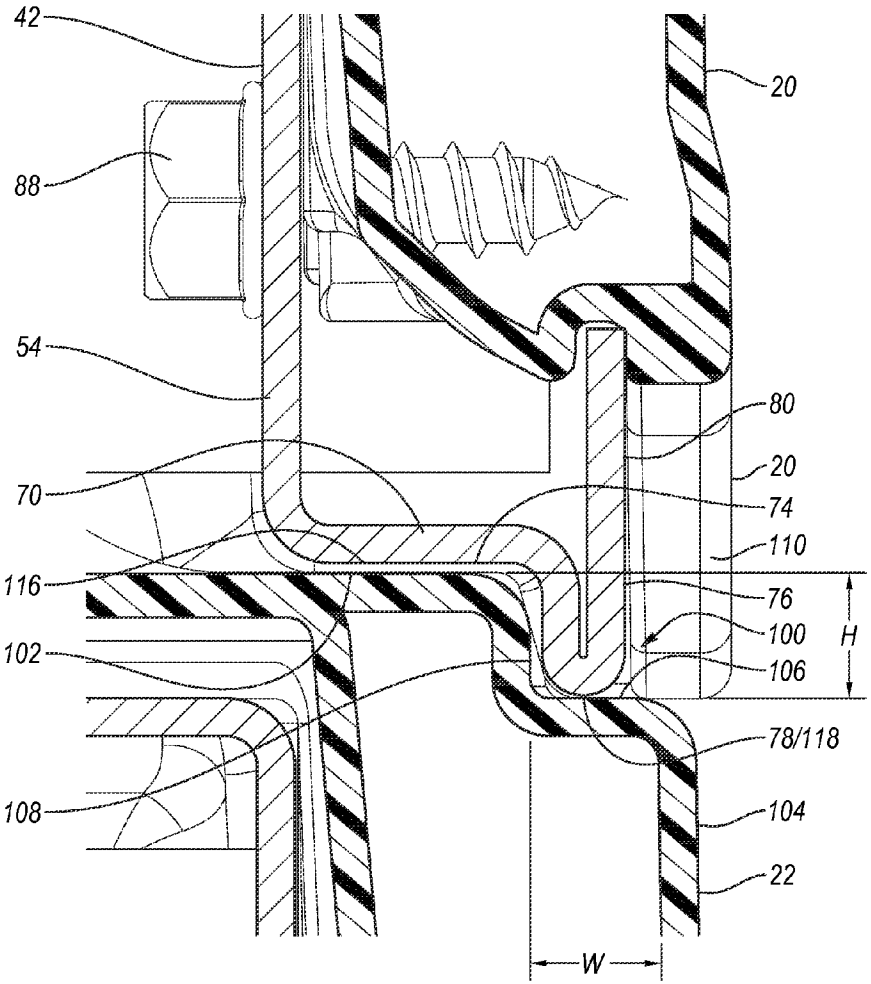
FIG. 9 is an enlarged side view of a portion of the table shown in FIG. 8, illustrating a side rail of the frame and a portion of a table top disposed in a nesting portion in an adjacent, nested table.

As shown in FIGS. 7-9, the tables 10 may include a nesting portion 100 that is sized and configured to facilitate nesting of the tables. The nesting portion 100 is preferably disposed about the perimeter 18 of the table top 12. In particular, the nesting portion 100 is preferably disposed about the entire perimeter 18 of the table top 12 including the sides 22, the corners 24 and the ends 26. The nesting portion 100 may be at least partially disposed in an upper surface 102 and sidewall 104 of the table top 12. Desirably, the nesting portion 100 may be disposed below a plane aligned with the upper surface 102 of the table top 12. The nesting portion 100 is preferably sized and configured to receive the engaging portion 76 of an adjacent table in the nested configuration. The nesting portion 100 may be integrally formed with the table top 12 as part of a unitary, one-piece construction during the molding process, if the table top is constructed from molded plastic.

In greater detail, the nesting portion 100 may be disposed at least proximate the intersection of the upper surface 102 and the side wall 104. Additionally, the nesting portion 100 may have a generally L-shaped configuration that is open on two sides, which may help facilitate alignment and nesting of the tables 10. As shown in FIG. 9, the nesting portion 100 may be a groove or channel with a height H and a width W. The height H is preferably between about 0.25 inches and about 0.5 inches, such as about 0.3 inches or 0.4 inches, and the width W may be larger than the height by a factor such as two, three or more. For example, the width W may be approximately two times the height H such that, in this exemplary embodiment, if the height is about 0.25 inches, then the width may be about 0.5 inches. The height H and the width W may also be approximately the same. For instance, if the height H is about 0.5 inches, then the width W may also be about 0.5 inches. It will also be appreciated that the width W may be smaller than the height H. Thus, for example, if the height H is about 0.4 inches, then the width W may be about 0.3 inches or less. It will be understood that the height H and/or the width W may vary depending, for example, upon the intended use of the table 10.

As discussed above, the nesting portion 100 may be sized and configured to receive the engaging portion 76 of the frame 36. In particular, the engagement surface 78 of the engaging portion 76 may contact or abut a lower surface 106 and/or a sidewall 108 of the nesting portion. The nesting portion 100 may also be sized and configured to receive a portion of the table top 12. For example, a lower portion of the corners 24 may be disposed in the nesting portion 100. Additionally, a lower portion of the ends 26 of the table top 12 may be disposed in the nesting portion 100. Thus, the table top 12 may include one or more engaging portions that are sized and configured to be disposed in the nesting portion 100. Therefore, the nesting portion 100 may receive one or more engaging portions 76 of the frame 36 and/or engaging portions of the table top 12.

The engaging portions of the table top 12 may include an engaging portion 110 of the lip 20. For instance, as seen in FIGS. 8 and 9, the engaging portion 110 of the lip 20 may be disposed along the side 22 of the table top 12 and it may be disposed in the nesting portion 100 alongside or proximate the engaging portion 76 of the frame 36. In addition, the corner 24 may include an engaging portion 112 and the end 26 may include an engaging portion 114 which are sized and configured to be disposed in the nesting portion 100. This may allow the engaging portion 76 of the frame 36 to be disposed in the nesting portion 100 along the sides 22 of the table top 12, the engaging portion 112 to be disposed in the nesting portion in the corners 24, and the engaging portion 114 to be disposed in the nesting portion along the ends 26 of the adjacent table top. Therefore, the engaging portions disposed in the nesting portion 100 may include a combination of one or more portions of the frame 36 and/or table top 12.

As discussed above, the engaging portion 76 of the frame 36 may have a double wall thickness. In addition, the engaging portions 110, 112, 114 of the table top 12 may have a double wall thickness because, for example, these portions of the table top may include a compression edge. The compression edge may have a double wall thickness because the outer wall may be folded back upon itself such that the inner surfaces of the outer wall contact or abut. In addition, as indicated above, the openings or recesses 90 in the lip 20 may include a compression edge 92. Therefore, if desired, the compression edge may extend about all or a majority of the lower portion 16 of the table top 12 such as the lip 20, the sides 22, the corners 24 and/or the ends 26. Further, as shown in the accompanying figures, the compression edges 92, 110, 112, 114 may have different heights. For example, the compression edge 92 in the opening 90 may have a smaller height than the compression edge 110 of the lip 20, the compression edge 112 of the corner 24 and/or the compression edge 114 of the end 26. In addition, the compression edge 112 of the corner 24 may have a greater height than the compression edges 92, 110, or 114. The compression edges 92, 110, 112, 114, however, preferably have a generally constant thickness. Advantageously, the double wall thickness of the engaging portion 76 and the compression edges may provide increased strength, rigidity, structural integrity and/or impact resistance, which may create a table top 12 that is more robust, durable and less likely to be damaged. The double wall thickness of the engaging portion 76 and the compression edges may also create relatively thin structures that allow the size of the nesting portion 100 to be minimized.

As shown in FIGS. 8 and 9, the side rail 42 of the frame 36 may have multiple contact surfaces or areas that are sized and configured to contact an adjacent, nested table. For example, the lower surface 74 of the connecting portion 70 of the side rail 42 may have a generally planar contact surface 116 that is sized and configured to contact or abut the upper surface 102 of an adjacent, nested table 10. The contact surface 116 may have a width of about 0.25 inches, about 0.5 inches or about 1.0 inches, or more, and may extend substantially the entire length of the table top 12. In addition, the engagement surface 78 of the engaging portion 76 of the frame 36 may form at least a portion of a contact surface 118 that is sized and configured to contact or abut the lower surface 106 and/or the sidewall 108 of the nesting portion 100. Further, the compression edges 92, 110, 112, 114 may be sized and configured to contact or abut the lower surface 106 and/or sidewall 108 of the nesting portion 100. Advantageously, this may allow a load or force to be shared or distributed over multiple areas when the tables 10 are nested. Thus, load bearing surfaces may be formed by the surface 116, the surface 118 and/or the compression edges 92, 110, 112, 114. In particular, the surface 116 may be a first load bearing surface 116 and the surface 118 may be a second load bearing surface. These multiple load bearing surfaces may allow the tables 10 to support more weight and permit additional tables to be stacked and nested, and may help prevent damage to the tables 10.

Therefore, the frame 36 may provide multiple load bearing surfaces between adjacent, stacked tables 10 and this may allow a greater number of tables to be nested together without damage. The frame 36 may also facilitate alignment and positioning of the tables 10 in the nested configuration. In addition, the frame 36 may help maintain the tables 10 in the nested configuration because a friction or interfere engagement with an adjacent, nested table may be created. Additionally, the frame 36 may protect the table top 12 from damage because it may extend below a least a portion of the lip 20 and, if the engaging portion 76 has a double wall thickness, the frame may be stronger and have increased impact resistance. Further, the frame 36 may facilitate nesting of the tables 10, which may significantly reduce the height of a plurality of nested tables, and this may be particularly advantageous when manufacturing, shipping, storing and displaying of the tables. Finally, the frame 36 may allow the table 10 to have the same general size, configuration and appearance as a conventional table, but much less area may be required when the tables are nested together.

Another exemplary embodiment of a table 200 is shown in FIGS. 10-18. The table 200 may have generally the same shape, size, configuration and arrangement as the table 10. In addition, the table 200 may have one or more features and/or aspects of the table 10. Therefore, it will be understood the table 200 may include one or more similarities with the table 10 and, for convenience and brevity, the same reference numbers may be used to refer to the same or similar parts.

Figure 12:
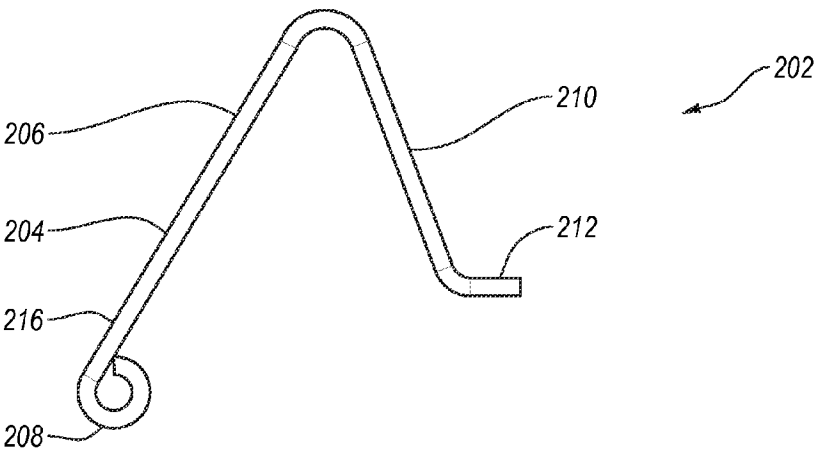
FIG. 12 is an enlarged side view of a portion of the table shown in FIG. 10, illustrating a side rail of a frame.

The table 200 may include a frame 202 with a generally V-shaped configuration. For example, as shown in FIG. 12, the frame 202 may include a side rail 204 that is disposed along a side of the table top 12. The side rail 204 may include an outer portion 206 that is disposed towards an outer surface or perimeter 18 of the table top 12. The outer portion 206 may have a generally planar outer surface and may be disposed in the opening 90 in the lip 20 of the table top 12. The end 208 of the outer portion 206 may be curved or rounded and it may be sized and configured to be disposed in the nesting portion 100 of an adjacent, nested table. The side rail 204 may also include an inner portion 210 that is disposed towards an inner portion of the table top 12. The inner portion 210 may also include an inwardly extending flange 212.

Figure 13:
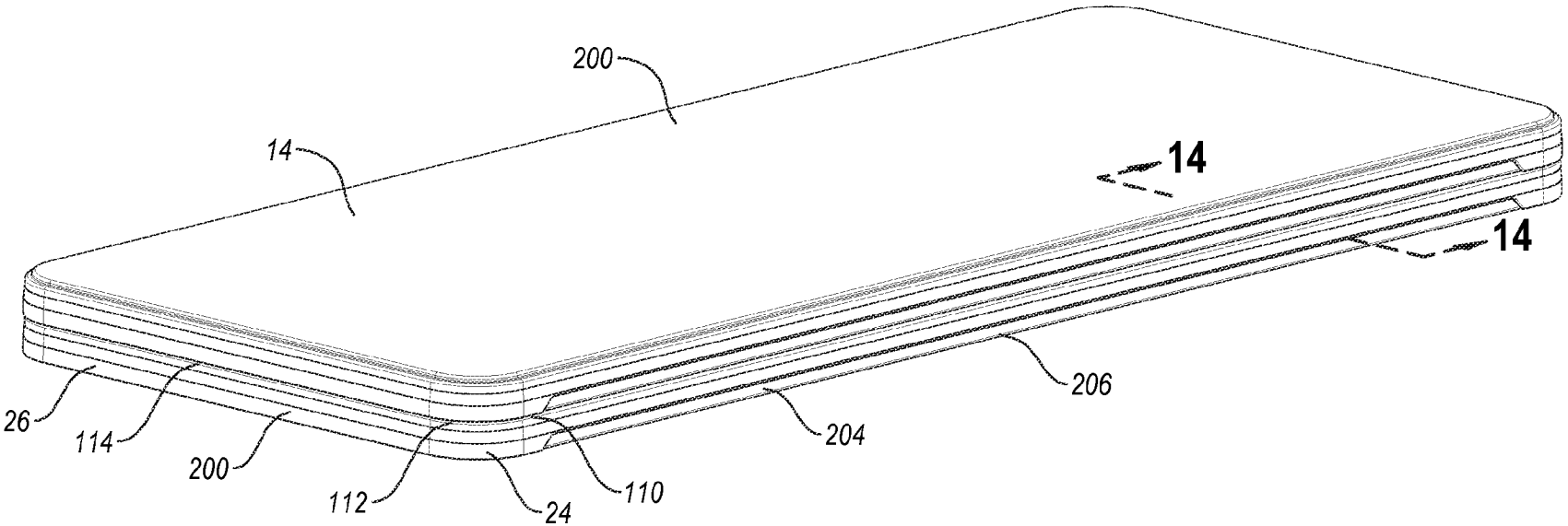
FIG. 13 is an upper perspective view of two exemplary tables disposed in a stacked and nested configuration.
Figure 14:
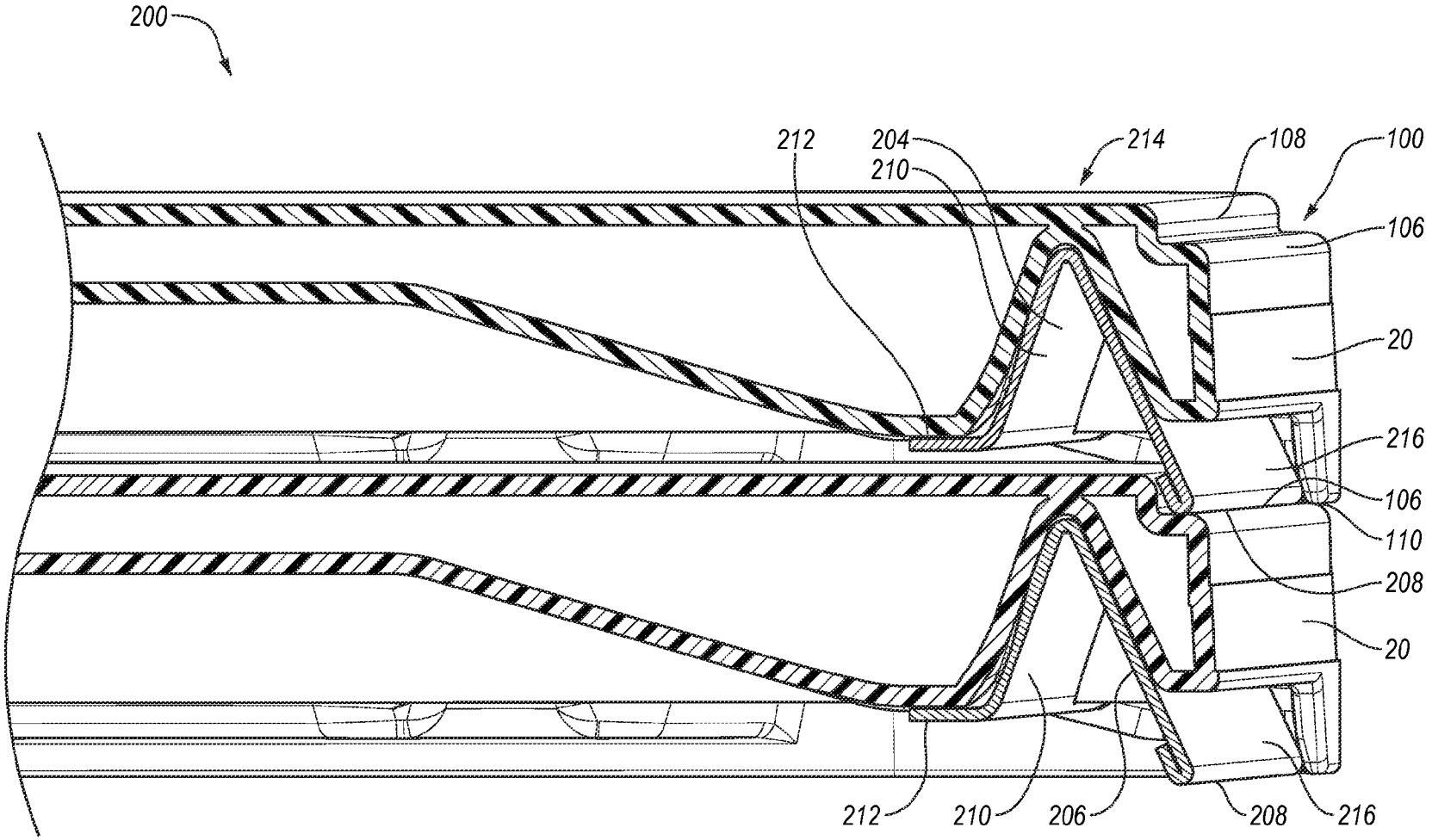
FIG. 14 is an enlarged cross-sectional side view along lines 14-14 of a portion of the tables shown in FIG. 13.

As shown in FIG. 13, the tables 200 may be disposed in a nested configuration in which an upper portion of the lower table is nested within a lower portion of the upper table. In greater detail, as shown in FIG. 14, the table top 12 may include a frame receiving portion 214 that is generally V-shaped and the frame 202 may be at least partially disposed within the frame receiving portion. Advantageously, this may help position the side rail 204 in the desired location and prevent the side rail from inadvertently moving or bending. The end 208 of the side rail 204 may be disposed in the nesting portion 100 of an adjacent table when the tables are nested together.

In greater detail, the end 208 of the side rail 204, which may have a double wall thickness because the end is bent back upon itself (such as shown in FIG. 12) or folded at a 180° angle (such as shown in FIG. 14). The end 208 may be disposed in the nesting portion 100 of an adjacent table in the nested configuration. In particular, the end 208 of the side rail 204 may contact the lower surface 106 and/or the sidewall 108 of the nesting portion 100. Additionally, if the outer portion 206 of the side rail 204 is disposed in the opening 90 in the sides of the table top 12, then an exposed surface 216 of the side rail may be readily visible when viewing the side of the table top.

Figure 15:
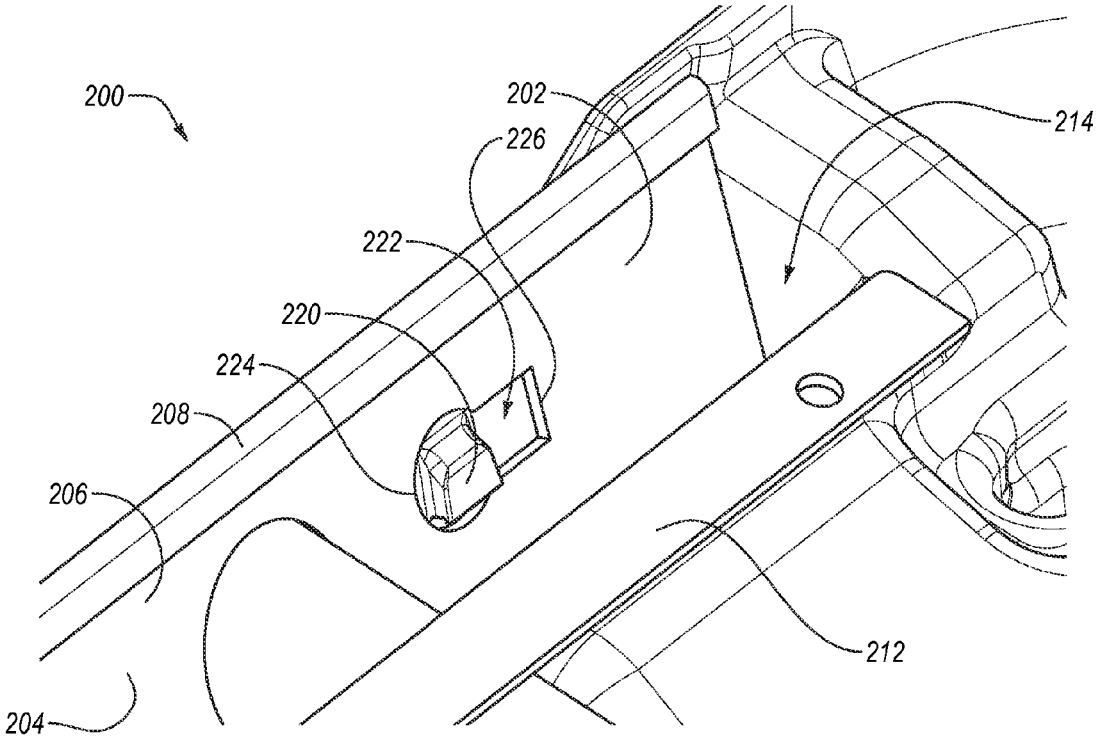
FIG. 15 is an enlarged perspective view of a portion of the table shown in FIG. 13, illustrating an exemplary connection of the frame and table top.
Figure 16:
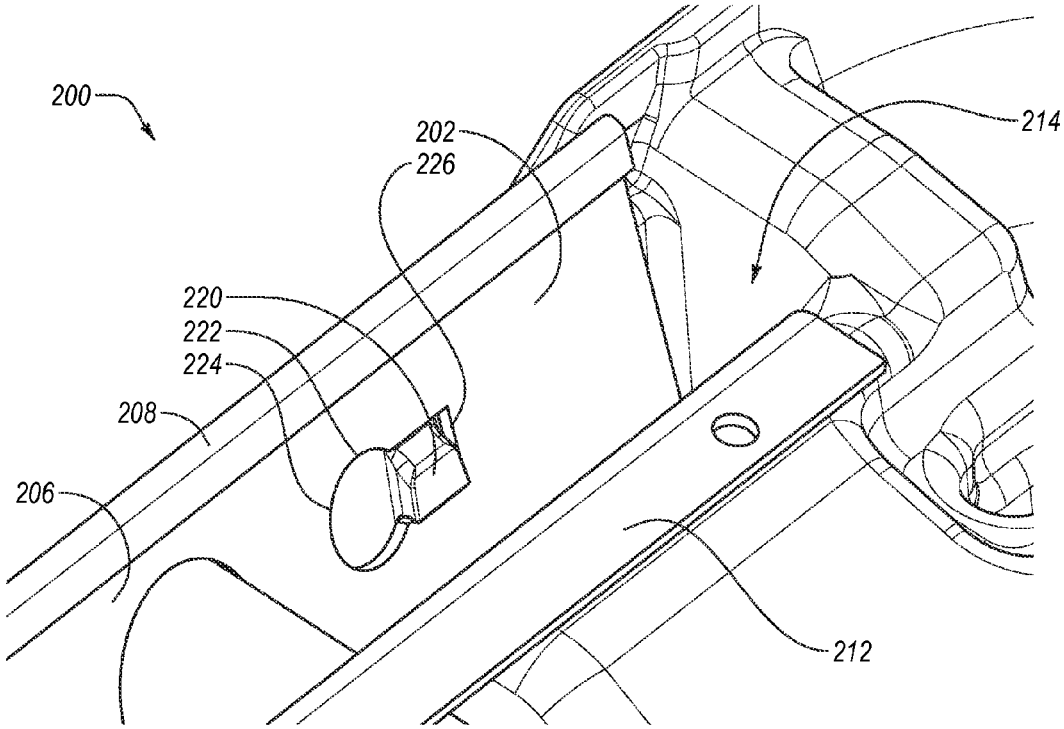
FIG. 16 is another enlarged perspective view of a portion of the table shown in FIG. 13, illustrating the exemplary connection of the frame and table top.
Figure 17:
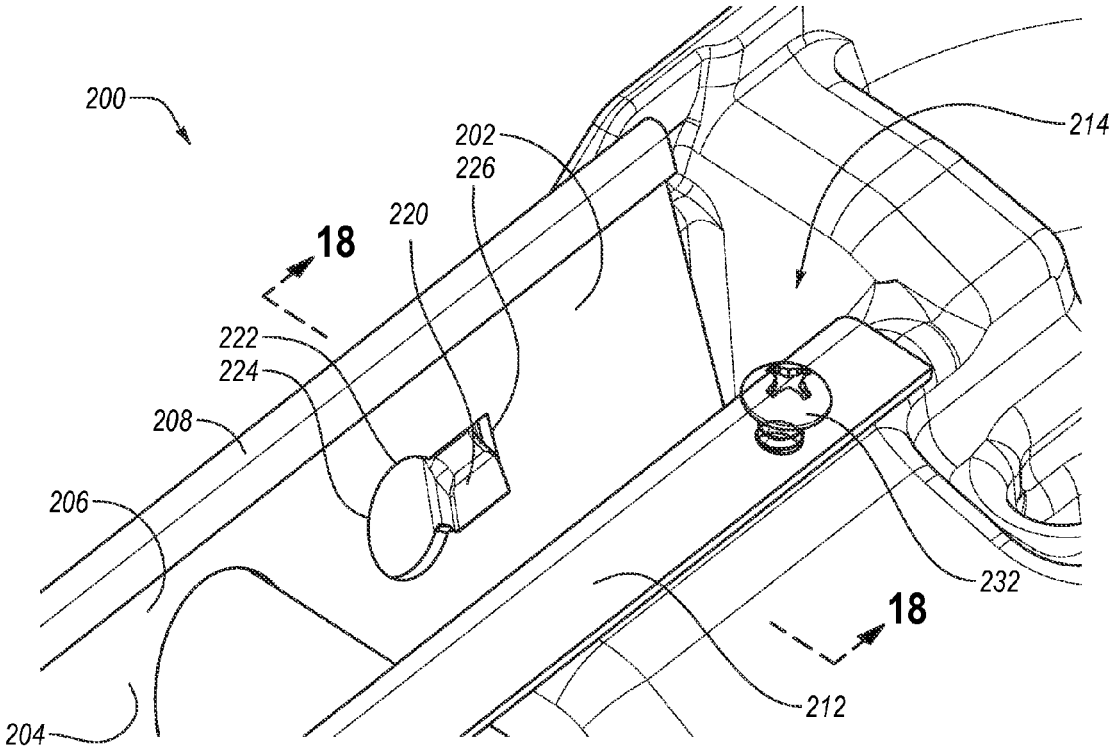
FIG. 17 is yet another enlarged perspective view of a portion of the table shown in FIG. 13, illustrating the exemplary connection of the frame and table top.
Figure 18:
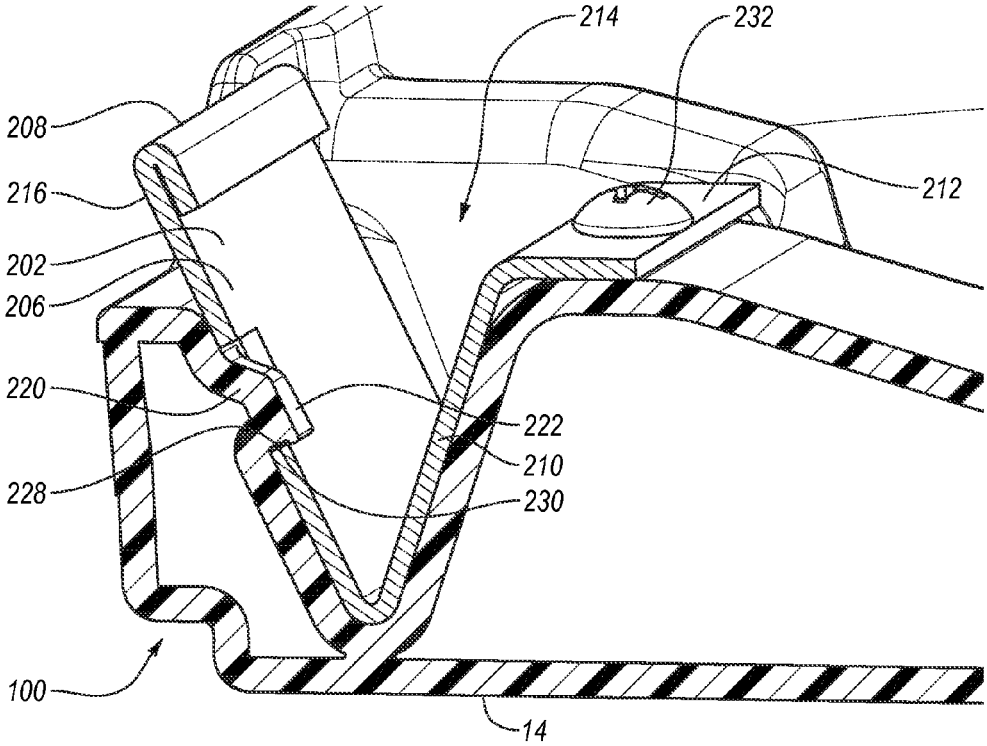
FIG. 18 is a cross-sectional side view along lines 18-18 of a portion of the table shown in FIG. 17.
Figure 19:
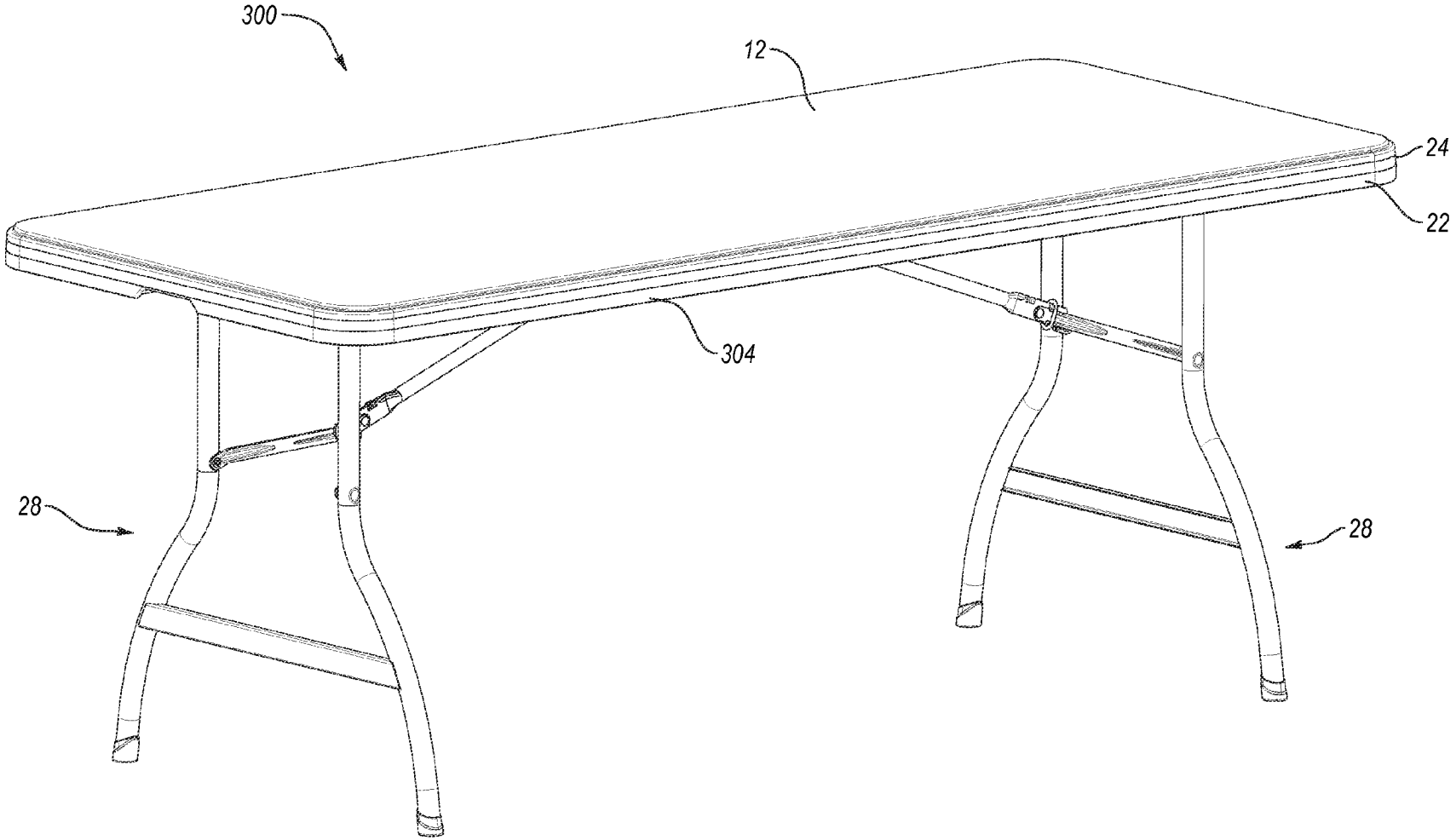
FIG. 19 is a perspective view an yet another exemplary table.

As shown in FIGS. 15-18, the side rail 204 may be connected to the table top 12 by disposing an engaging portion 220 of the table top 12 within a receiving portion 222 of the side rail 204. For instance, as shown in FIG. 15, the engaging portion 220 may be disposed in an enlarged portion 224 of the receiving portion 222, which may have a generally key-shaped configuration. As shown in FIG. 16, the side rail 204 may be slid or moved so that the engaging portion 220 is now disposed in a smaller portion 226 of the receiving portion 222. As best seen in FIG. 18, the engaging portion 220 may include a receiving portion, such as undercut 228, that is sized and configured to receive an edge 230 of the receiving portion 222. Advantageously, the undercut 228 and edge 230 may help secure the 204 in a fixed position within the frame receiving portion 214. For example, the undercut 228 and the edge 230 may create a friction or interference fit between the engaging portion 220 and the receiving portion 222. This exemplary configuration may allow the frame 202 to be connected to the table top 12 without requiring any additional components, fasteners, or the like. One or more fasteners, such as a fastener 232, however, may be used to maintain the side rail 204 in a fixed position and/or attach the side rail to the table top 12.

Advantageously, if the side rail 204 of the frame 36 is connected to the table top 12 by the engaging and receiving portions 220, 222, then fasteners may not be used to primarily secure the frame to the table top. Instead, fasteners may be used to simply prevent the frame 36 from moving relative to the table top 12. Thus, fewer fasteners may be used and the table top 12 may be less likely to be damaged because fasteners may not be load bearing or supporting members. It will be understood this exemplary embodiment of attaching the table top 12 and frame 36 may be used in connection with any of the tables disclosed herein. It will also be understood the tables may include any suitable number or combination of features, aspects, characteristics and the like disclosed herein depending, for example, upon the intended use of the tables. Further, it will be understood that while the tables may have similar aspects, features, characteristics and the like, the tables may also have other or different aspects, features, characteristics and the like.

For example, the frame 202 may facilitate alignment and positioning of the tables 200. The frame 202 may also protect the table top 12 from damage because it may extend below a portion of the lip 20 and the double wall thickness of the end 208 may provide increased strength and impact resistance. Additionally, the frame 202 may facilitate nesting of the tables 200 and that may significantly reduce the height of a plurality of stacked, nested tables. Further, because the table 200 may have the same general size, configuration and appearance as a conventional table and/or a portion of the frame 202 may be exposed, consumers may immediately assume the table 200 has the same strength and structural integrity as a conventional table. It will be understood the table 200, and the other tables disclosed herein, may include any suitable combination of these aspects, features, characteristics and the like.

Another exemplary embodiment of a table is shown in FIGS. 19-22. In this configuration, the table 300 may include a frame 302 with a generally S-shaped side rail 304. In greater detail, the side rail 304 may include an outer portion 306 with an end 308 and an inner portion 310 with a flange 312. The inner portion 310 of the side rail 304 may be disposed within a frame receiving portion 314 in the lower portion 16 of the table top 12. The end 308 of the outer portion of the side rail 304 may be disposed in a receiving portion 316, such as a groove or channel, which may be disposed in a lower portion of the lip 20.

Figure 20:
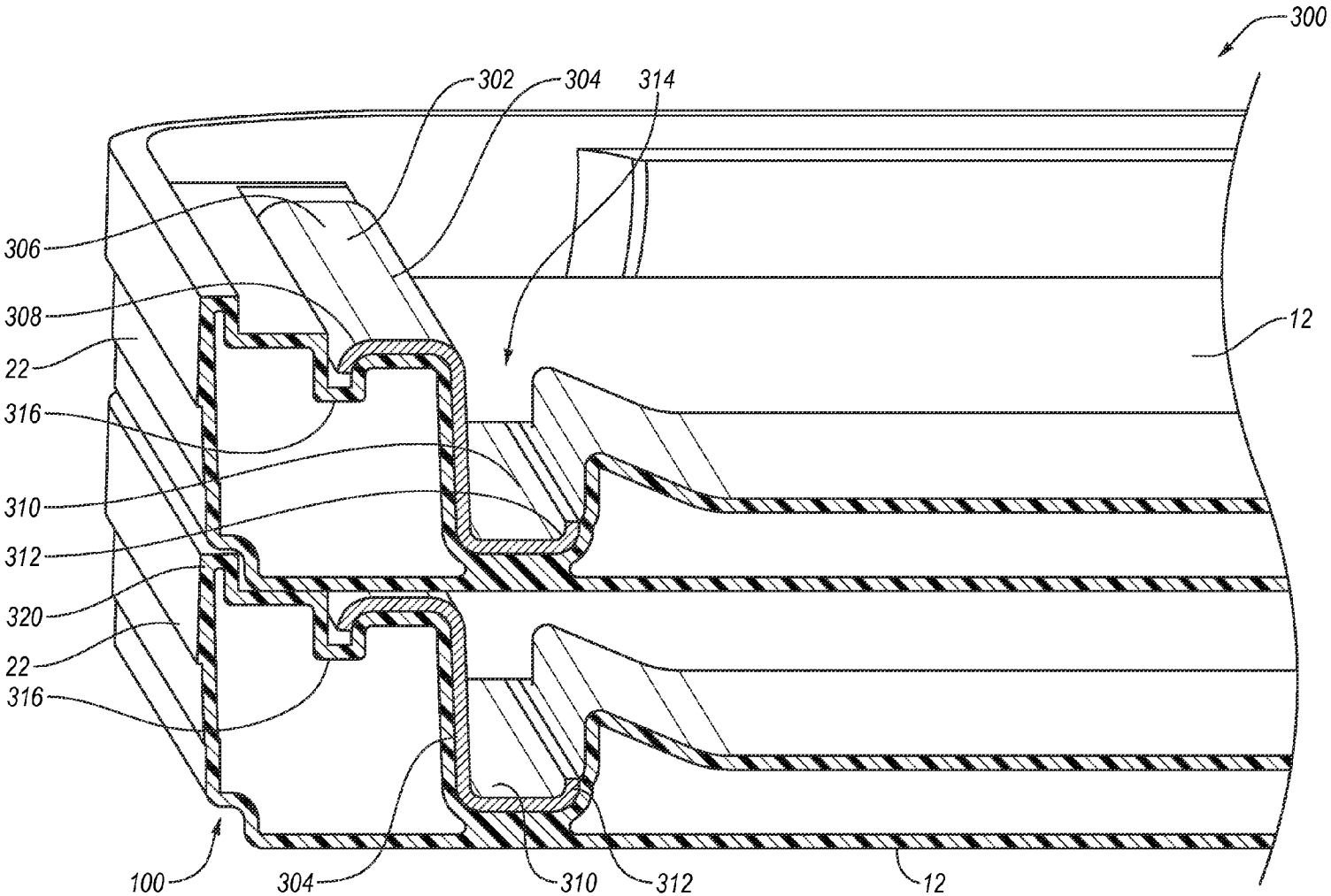
FIG. 20 is a cross-sectional view of a portion of the table shown in FIG. 19, illustrating two tables in a stacked and nested configuration.
Figure 21:
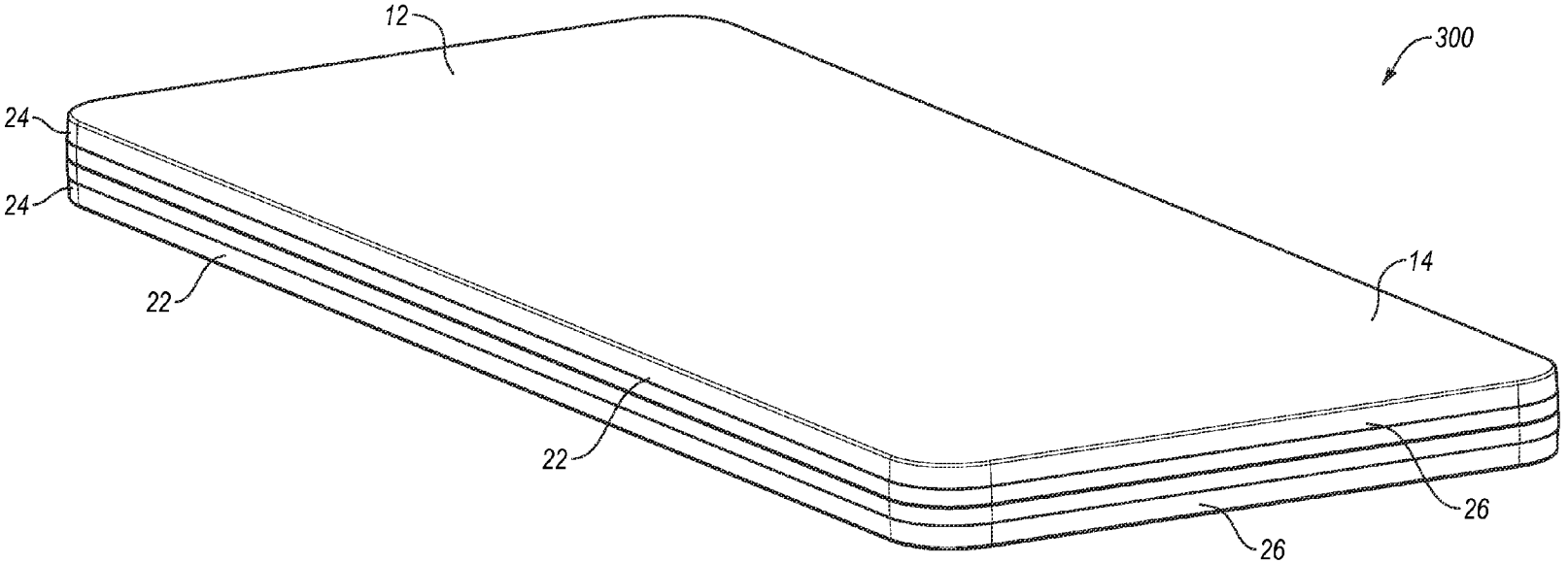
FIG. 21 is a perspective view a further exemplary table, illustrating two tables in a stacked and nested configuration.

As best seen in FIG. 20, when the tables 300 are nested together, the side rails 304 of the frame 302 may be generally aligned, which may allow the tables in the nested configuration to support a considerable amount of weight. In addition, a downwardly extending portion 320 of the lip 20, such as a compression edge, may be disposed along the side 22 of the table top 12. The downwardly extending portion 320 of the lip 20 may be disposed in the nesting portion 100 of the adjacent, nested table. Similar to the tables discussed above, the nested tables 300 may significantly reduce the height of a plurality of stacked tables. Advantageously, the reduced height may save space during the manufacturing process, reduce transportation costs, decrease the amount of required storage space and allow the tables to be more easily displayed and stored.

Figure 22:
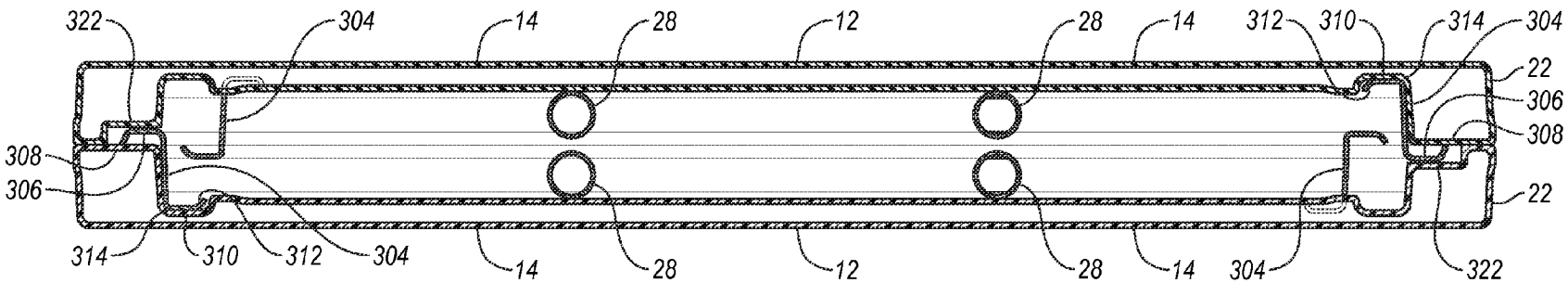
FIG. 22 is a cross-sectional view of a portion of the tables shown in FIG. 21.

As shown in FIG. 22, the tables 300 could have a different configuration in which the side rails 304 are offset or disposed a different distance from the sides 22 of the table top 12. In this configuration, the offset side rails 304 may allow the tables 300 to be stacked with lower portions 16 of the tables contacting and abutting. In greater detail, the outer portion 306 of the side rail 304 may be disposed proximate the lip 20 and within a receiving portion 322 formed in the lower surface of the lip of the adjacent, nested table.

When the tables 300 are stacked as shown in FIG. 22, a lower portion of one table is nested with a lower portion of the adjacent, nested table. In this configuration, the outer portion 306 of the frame 302 on one side of the lower table 300 is disposed in the receiving portion 322 in the lower portion of the lip 20 of the upper table. The outer portion 306 of the frame 302 on the other side of the upper table 300 is disposed in the receiving portion 322 in the lower portion of the lip 20 of the lower table. Therefore, because the side rails 304 of the frame 302 are offset, the orientation of the tables 300 may alternate when the tables are disposed in the stacked, nested configuration. Advantageously, because the lower portions of the tables 300 are nested together, the upper portions of the tables may be less susceptible to damage. Further, because the upper surfaces of the tables 300 are preferably generally planar and the upper surface of one table may contact the upper surface of another table when multiple tables are stacked together, a load or force on the tables may be distributed over a large area which may help prevent the tables from being damaged.

Figure 23:
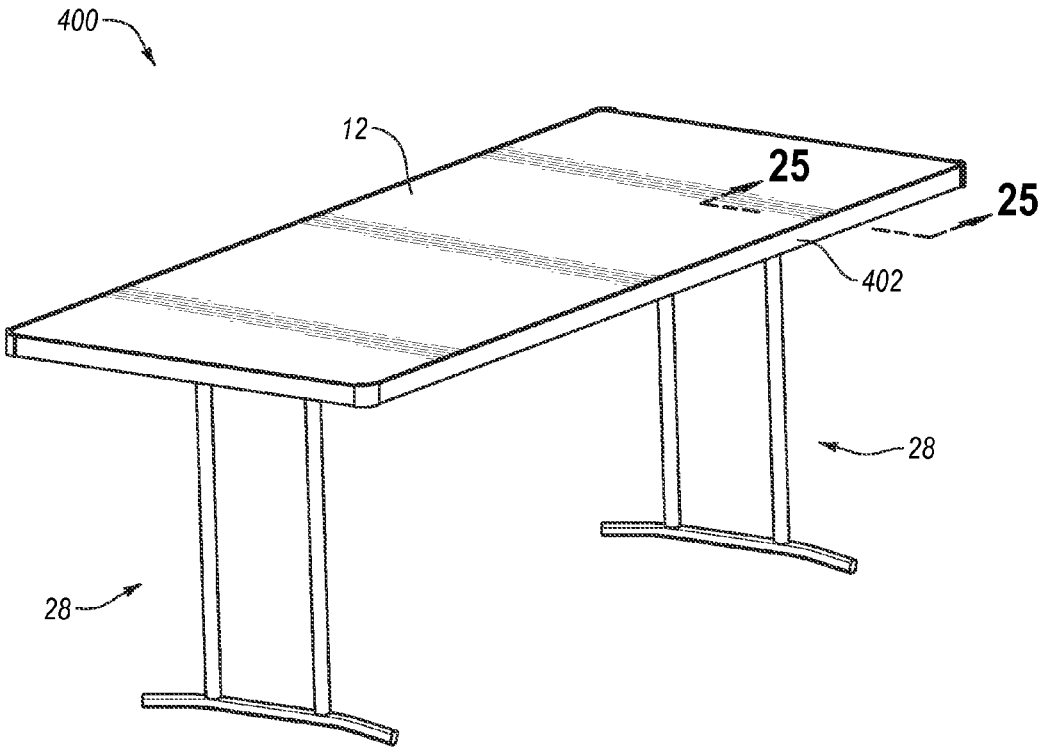
FIG. 23 is perspective view of yet another further exemplary table.
Figure 24:
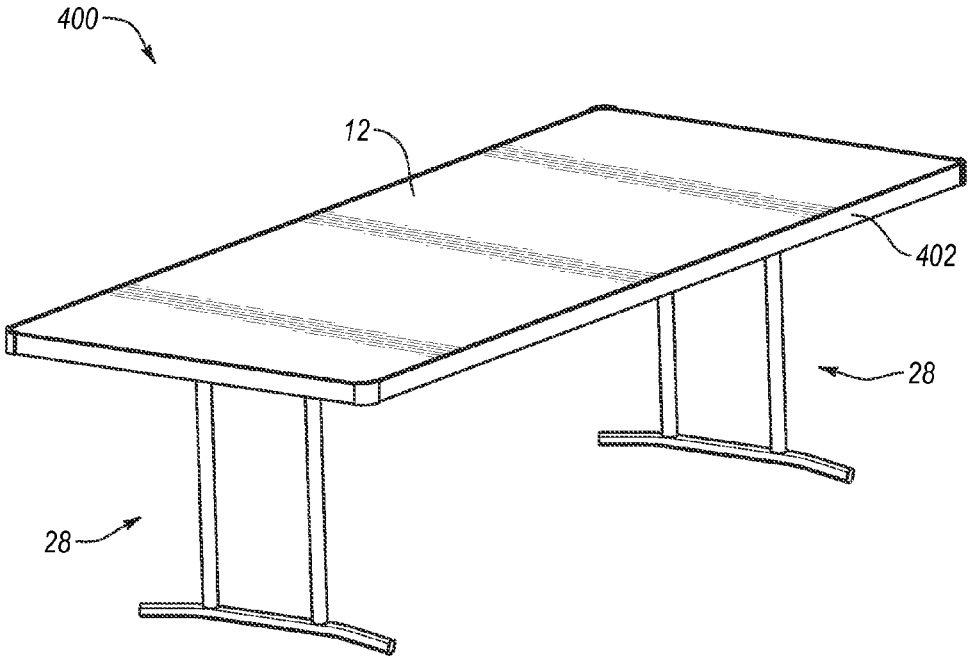
FIG. 24 is a perspective view of a still further exemplary table.
Figure 25:
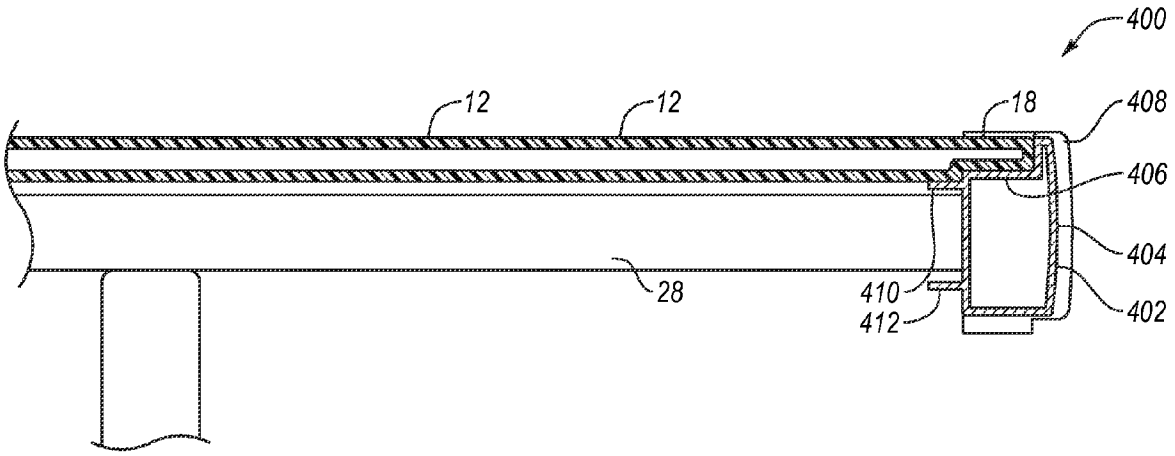
FIG. 25 is a cross-sectional side view along lines 25-25 of a portion of the table shown in FIG. 23.
Figure 27:
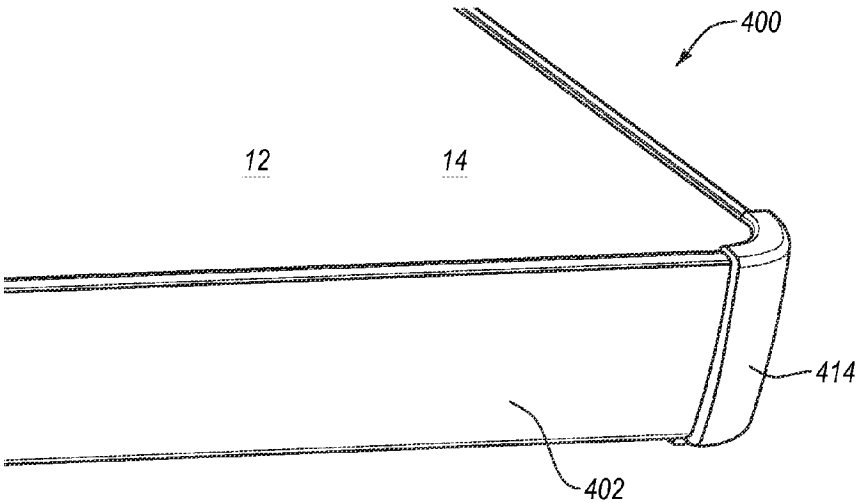
FIG. 27 is an enlarged perspective view of another portion of the table shown in FIG. 23.
Figure 26:
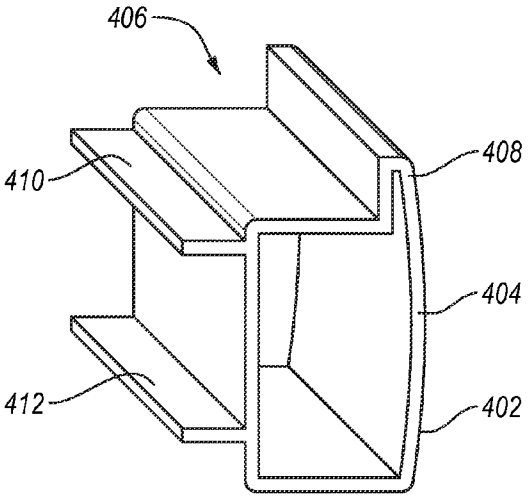
FIG. 26 is an enlarged perspective view of a portion of the table shown in FIG. 23.
Figure 28:
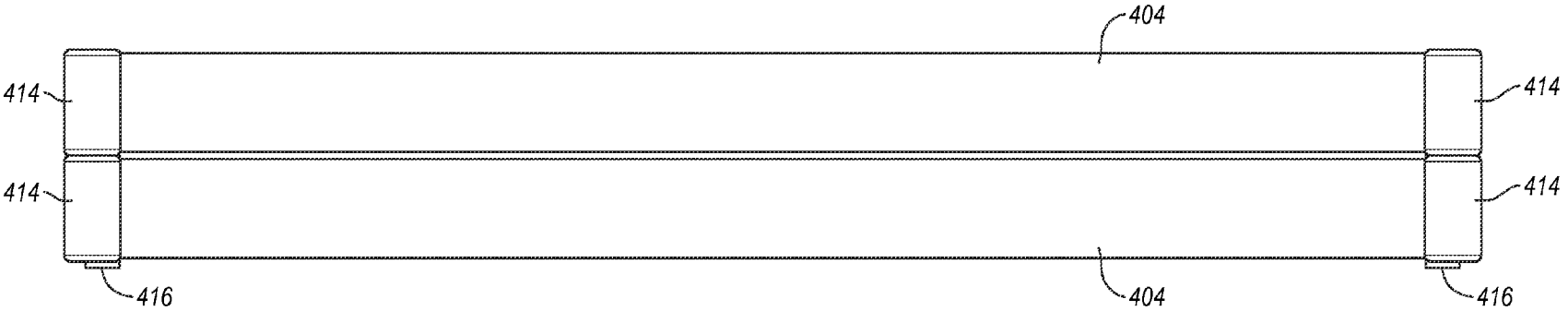
FIG. 28 is an end view of two exemplary stacked tables.
Figure 29:
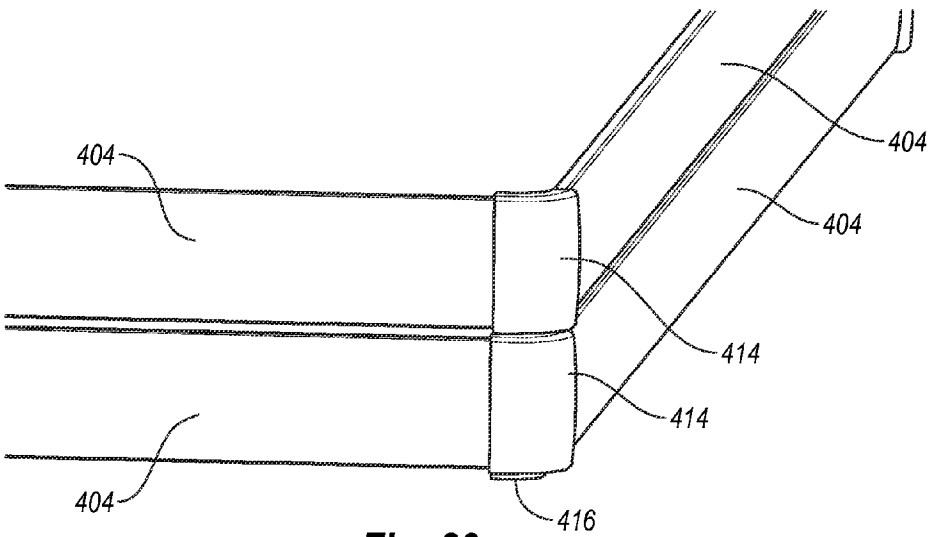
FIG. 29 is a perspective view of a portion of the two stacked tables shown in FIG. 29.
Figure 30:
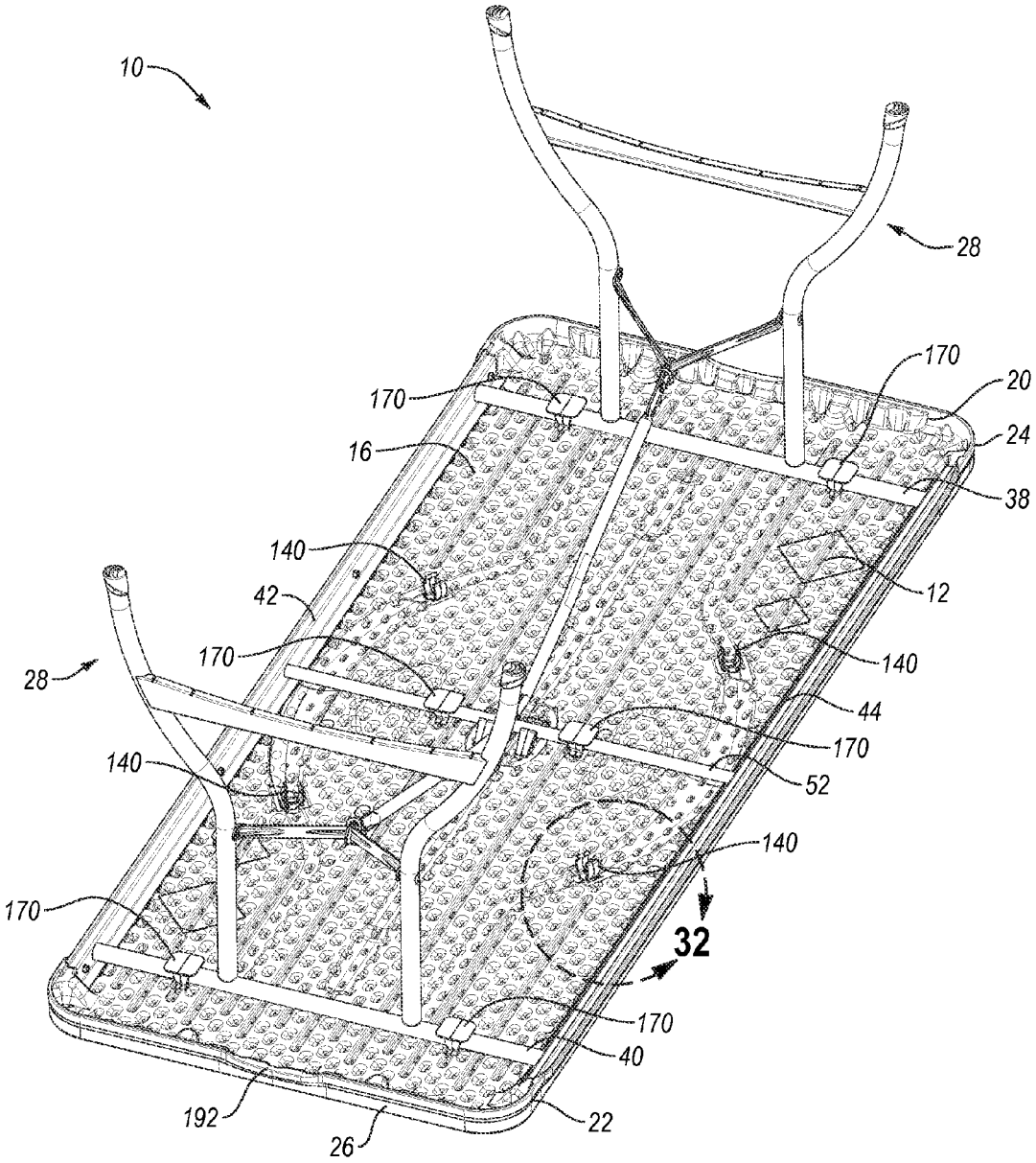
FIG. 30 is a lower perspective view of an exemplary table, illustrating leg clips that may be used to secure support structures in a fixed position.
Figure 31:
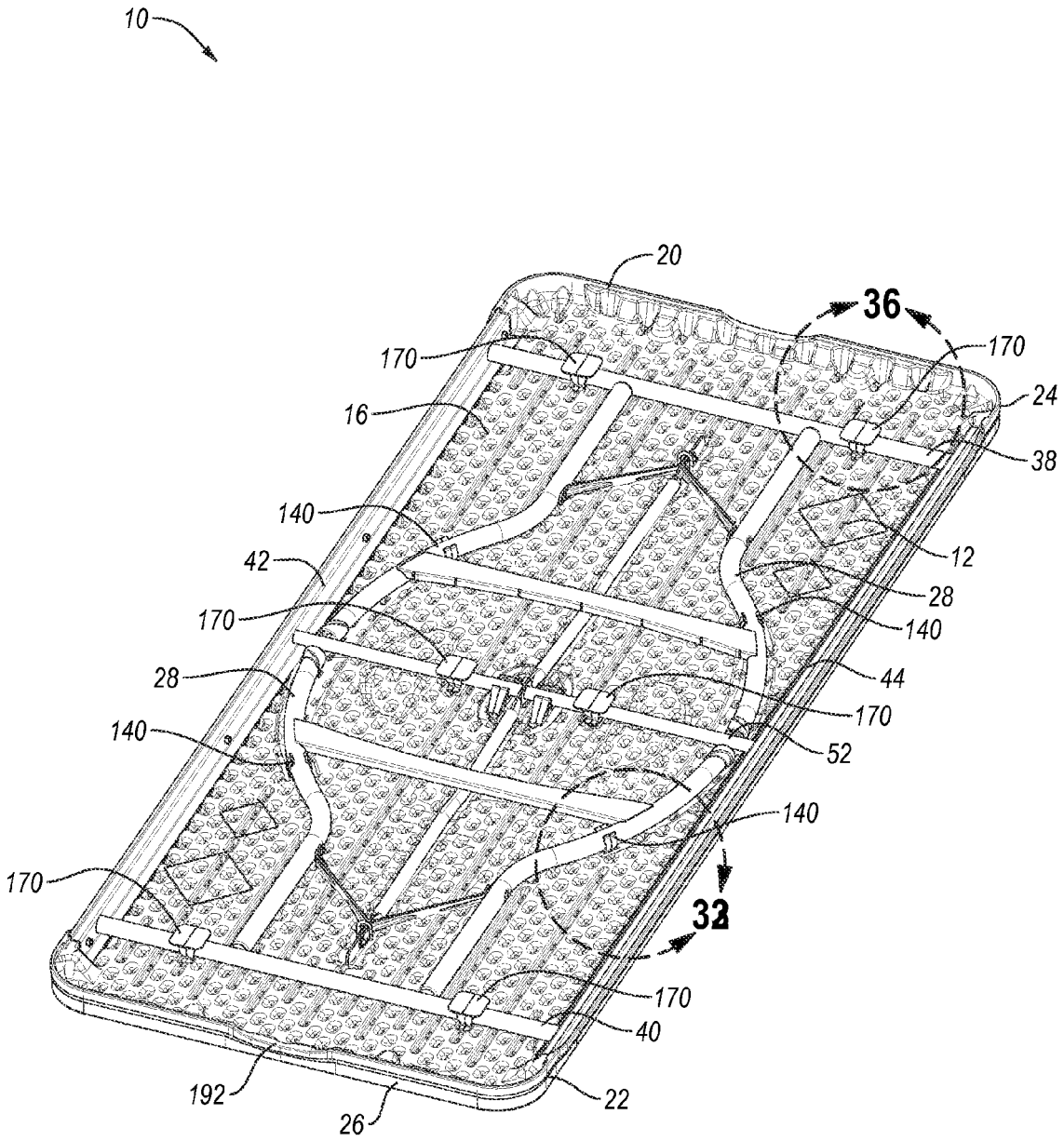
FIG. 31 is a lower perspective view of the table shown in FIG. 30, illustrating leg clips attached to support structures.

Another exemplary embodiment is shown in FIGS. 23-29 in which the table 400 may include a frame 402 that is attached to the perimeter 18 of the table top 12. For example, as seen in FIGS. 23 and 24, the table 400 may have generally the same size, shape, configuration and arrangement as the tables 10, 200 and 300. The frame 402, however, may include side rails 404 that include a receiving portion 406 that is sized and configured to receive an edge of the table top 12. The side rails 404 may also include an outer edge or flange 408 with an upper surface that is generally aligned with the upper portion 14 of the table top 12. Advantageously, the receiving portion 406 and flange 408 may help protect the table top 12 from damage. The side rails 404 may also include one or more inwardly extending flanges 410, 412, which may be sized and configured to allow the support structures 28 to be connected to the table 400. Further, the table 400 may include corners 414, which may help protect the frame 402 and/or table top 12 from damage. If desired, the corners 414 may be connected to the frame 402. On the other hand, the corners 414 may be used to connect the frame 402 to the table 400. In addition, as shown in FIGS. 28 and 29, the corners 414 may include a downwardly extending projection 416 that may be sized and configured to facilitate stacking and/or alignment of the tables 400.

As discussed above, the tables may include any suitable number of features, which may be freely combined depending, for example, upon the intended use of the table. Additional features such as leg clips, spacers, inserts, pads, foot caps and handles, are described in more detail below. While the tables may include any number of features, none of the features are required.

Figure 33:
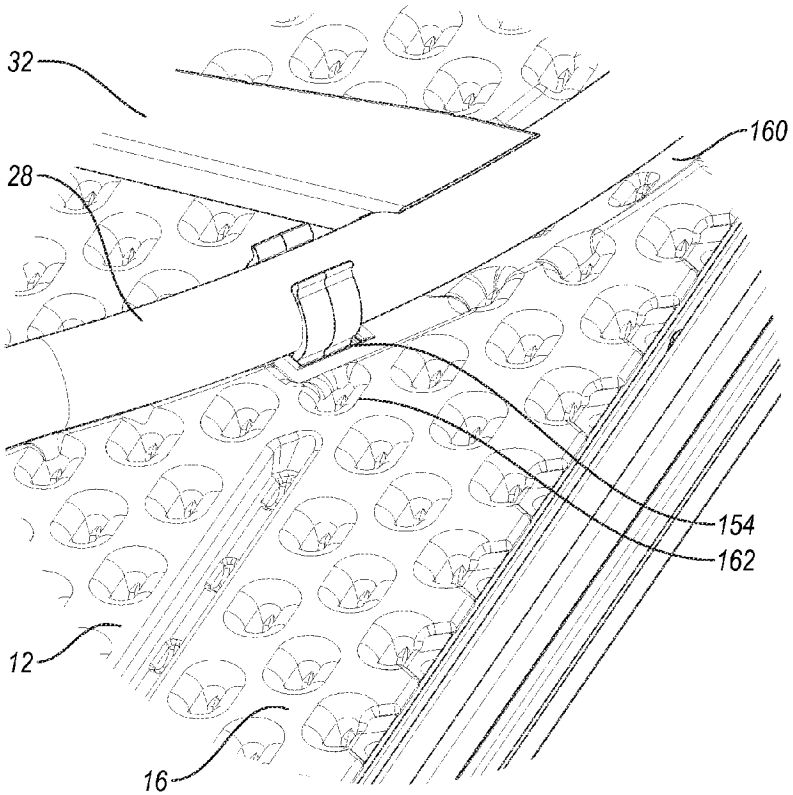
FIG. 33 is an enlarged perspective view of a portion of the table shown in FIG. 31, illustrating a leg clip attached to a support structure.
Figure 35:
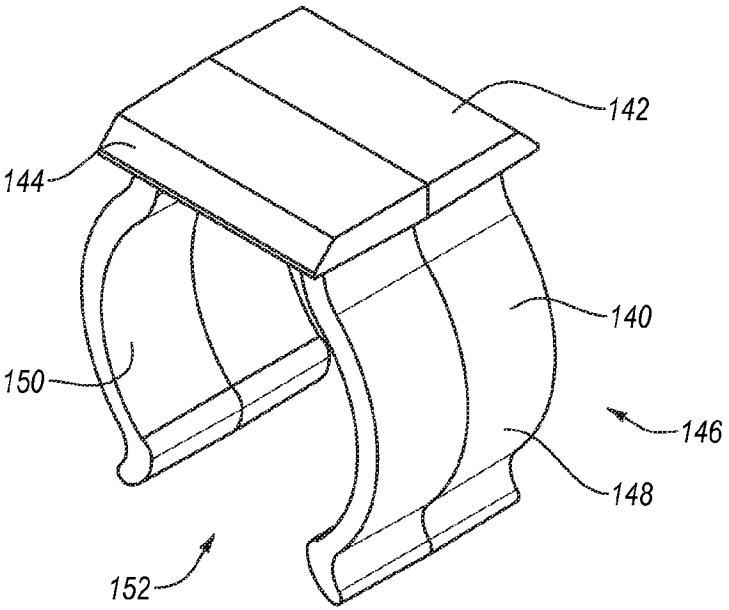
FIG. 35 is an enlarged lower perspective view of the leg clip.
Figure 34:
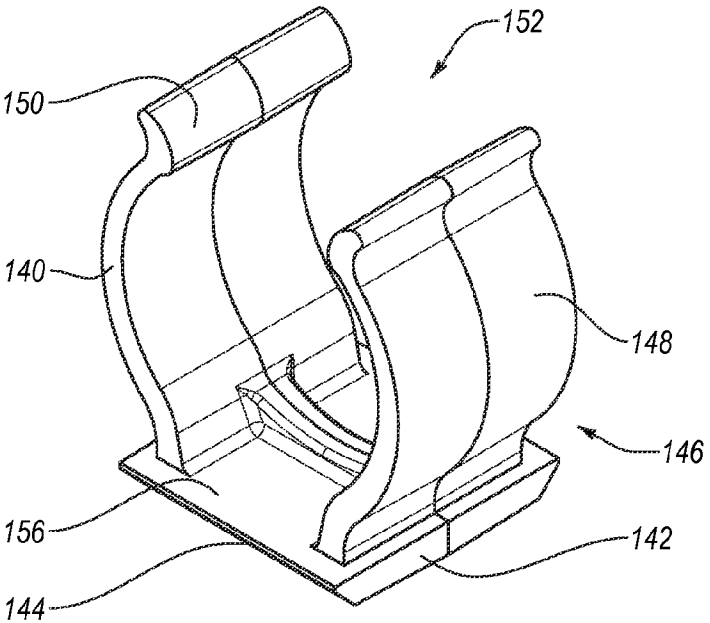
FIG. 34 is an enlarged upper perspective view of the leg clip.
Figure 36:
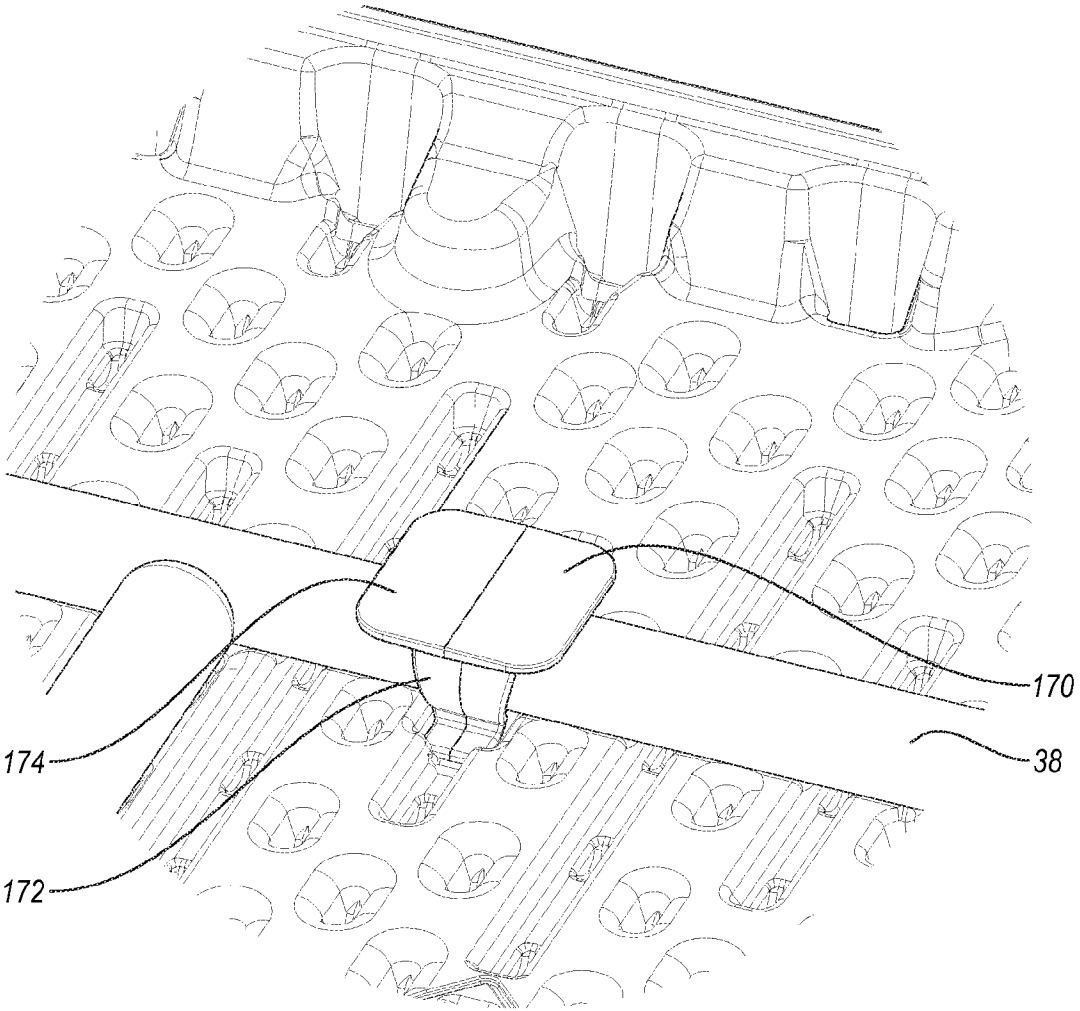
FIG. 36 is an enlarged perspective view of a portion of the table shown in FIG. 31, illustrating a support clip.
Figure 38:
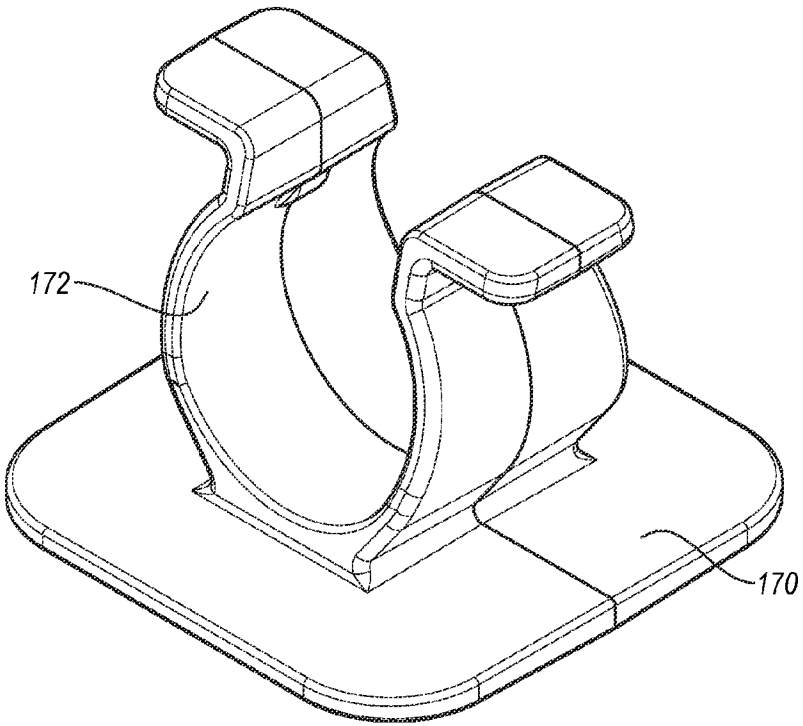
FIG. 38 is an enlarged lower perspective view of the support clip.
Figure 37:
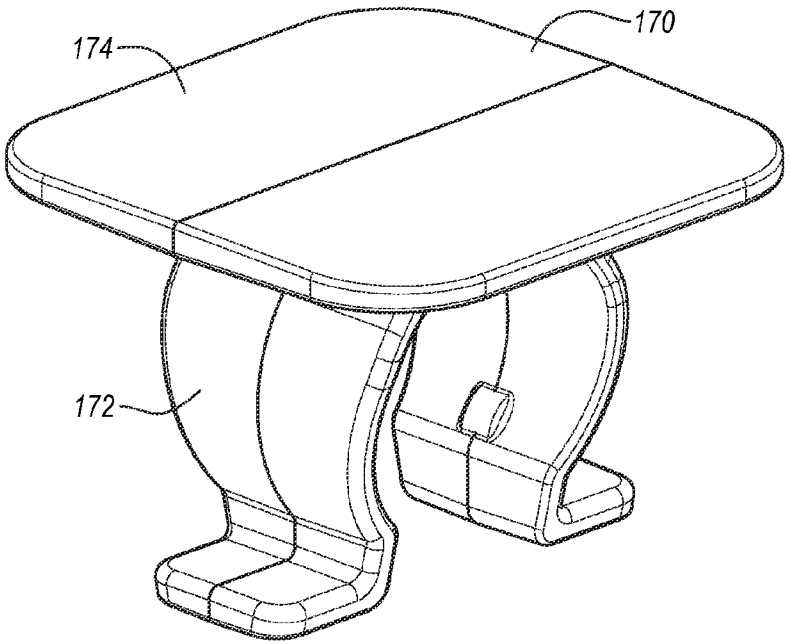
FIG. 37 is an enlarged upper perspective view of the support clip.
Figure 39:
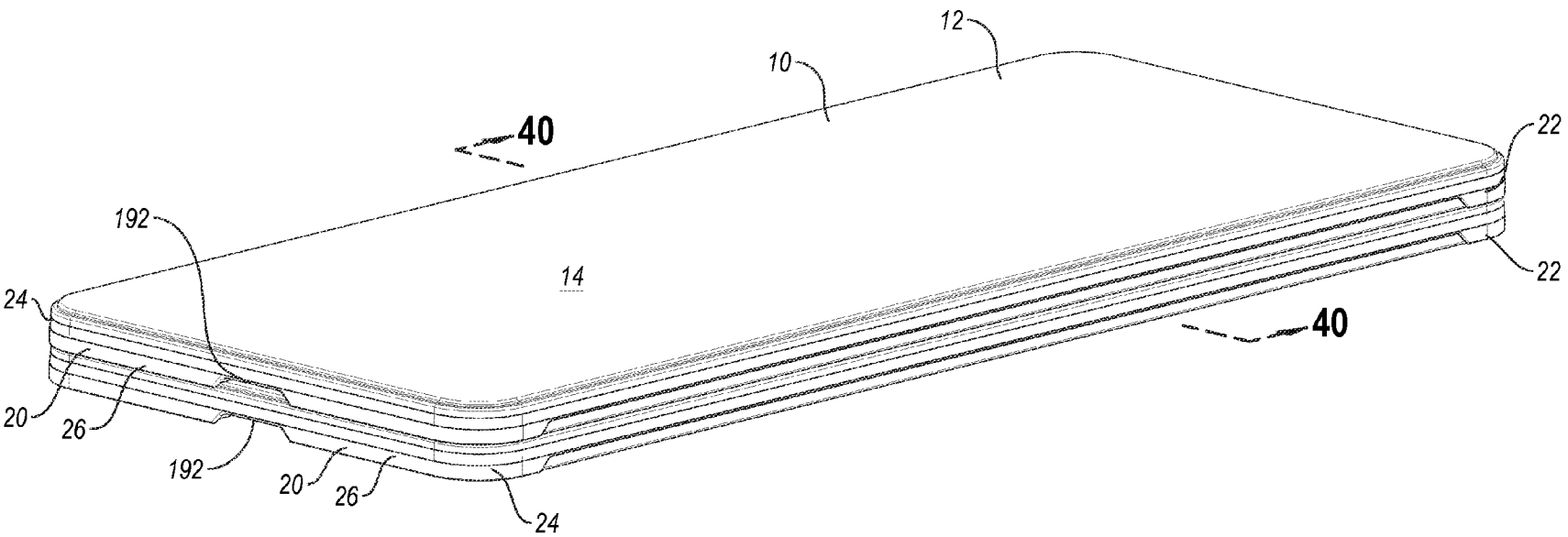
FIG. 39 is a perspective view of two exemplary tables in a nested configuration.
Figure 40:
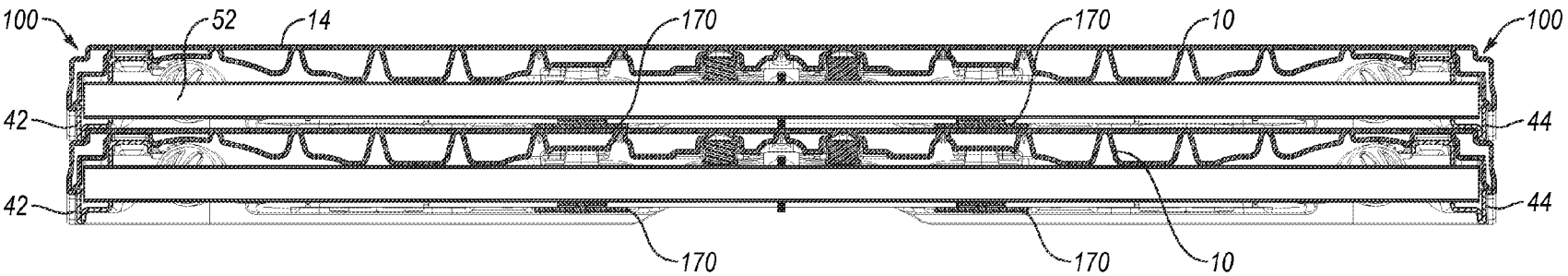
FIG. 40 is a cross-sectional side view along lines 40-40 of the table shown in FIG. 39.
Figure 41:
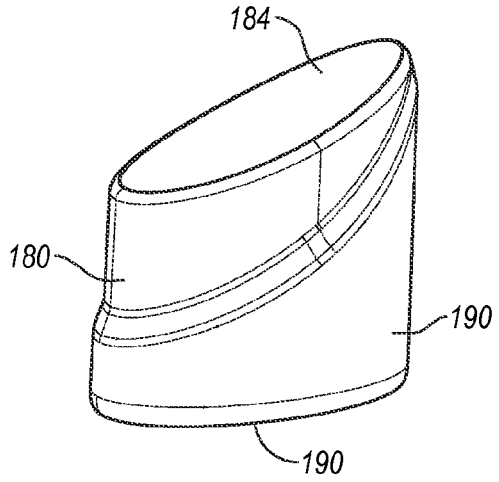
FIG. 41 is a perspective view of an exemplary end cap.

As seen in FIGS. 30-36, the table 10 may include a leg clip 140 that is sized and configured to secure the support structure 28 and/or leg 30 in a fixed position relative to the table top 12 when the support structure 28 is in a collapsed position. For example, as best seen in FIGS. 34 and 35, the leg clip 140 may include a base 142 with a generally square or rectangular configuration with tapered edges 144. The leg clip 140 may also include a receiving portion 146 with two upwardly extending arms 148, 150. The arms 148, 150 may move or elastically deform when a portion of the support structure 28 is inserted into the opening 152 disposed between the ends of the arms. When the support structure 28 is disposed between the arms 148, 150, the arms may resiliently return to their previous configuration to maintain the support structure 28 in a fixed position.

Figure 32:
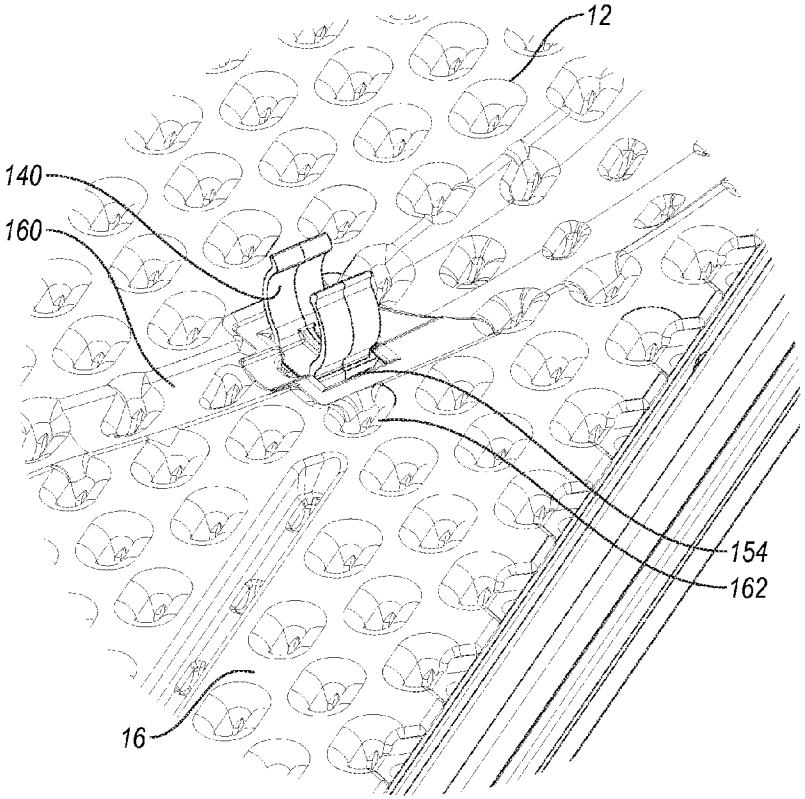
FIG. 32 is an enlarged perspective view of a portion of the table shown in FIG. 30, illustrating a leg clip attached to a lower portion of the table top.

The base 142 may be at least partially attached to and/or disposed in a depression or receiving portion 154 in the lower portion 16 of the table top 12. For example, the receiving portion 154 may include an opening that is slightly smaller than the base 142 so that once the base is inserted into the opening, the base may be securely disposed within the receiving portion. In addition, the base 142 may include an upper surface 156 that is generally aligned within or disposed below the lower surface 16 of the table top 12. Additionally, as shown in FIGS. 32 and 33, the leg clip 140 may be at least partially disposed within a groove or channel 160 in the lower surface 16 of the table top 12. For instance, the channel 160 may be formed in the lower surface 16 of the table top 12 to receive a portion of the support structure 28 in the collapsed position. As shown in the accompanying figures, the leg clip 140 may be at least partially disposed within the channel 160. If desired, the base 142 may be disposed at least partially disposed in a depression 162 formed in the lower surface 16 of the table top 12. The base 142 may also be disposed at an angle relative to the depressions 162. Further, one or more of the depressions 162 may be formed in the channel 160 and the leg clip 140 may be at least partially disposed in a depression in the channel.

As shown in FIGS. 31 and 36-40, the table 10 may include spacers, inserts or pads 170, which may facilitate stacking of the tables. For example, when tables 10 are stacked and/or nested for manufacturing, transportation, storage, display and the like, a significant amount of weight or force may be applied to the tables. The weight or force may be particularly significant for the tables 10 disposed towards the lower portion of the stack. The pads 170 may include a clip 172 that is sized and configured to be attached to a portion of the frame 36, such as cross members 38, 40, 52, support structures 28 and/or other suitable portion of the table 10. The pad 170 may include a generally planar contact surface 174 that is sized and configured to contact an upper surface 14 of a nested table. The pad 170 may help distribute weight or force more equally, evenly and/or over a larger surface area of the adjacent table. Advantageously, because the pad 170 may be attached by the clip 172, that may allow the pad to be easily and quickly attached and/or removed by the manufacturer, retailer and/or consumers. In addition, the number of pads 170 may depend upon the number of tables 10 to be stacked. For instance, a larger number of pads 170 may be used if a greater number of tables 10 are to be stacked or if the tables have to support a larger weight or force.

Still another aspect is a table 10 that may include one or more foot caps 180 attached to feet 182 of the support structures 28 and/or legs 30. For example, the table 10 may include the support structure 28 wherein the legs are elongated members 30 connected by a connecting member 32. The elongated members 30 may be constructed from tubular pieces of metal with a generally circular, oval, oblong, rectangular or other suitable cross-sectional configuration. The elongated members 30 may be bent or curved such that the upper portions of the elongated members are spaced closer together than the lower portions of the elongated members. The bending the elongated members 30 into the desired shape or configuration may cause the ends of the elongated members to be disposed at an angle X, such as about 8°. The foot caps 180 are preferably sized and configured to be attached to the ends of the support members 30 and include a lower surface that is disposed parallel to the floor. In particular, the foot caps 180 desirably compensate for the angled end of the elongated members 30 so that the table 10 rests securely and in a stable position relative to the floor.

As seen in FIGS. 41-47, the elongated member 30 may be inserted into an upper portion 184 of the foot cap 180. The elongated members 30 and the foot cap 180 may include alignment members to help ensure the foot cap is correctly positioned. For instance, the elongated member 30 may include an alignment member 186, such as a notch, cutout, groove, indentation or the like; and the foot cap 180 may include a corresponding alignment member 188, such as a projection, protrusion, protuberance or the like. The alignment members 186, 188 may help ensure the elongated members 30 and foot caps 180 are correctly orientated. The foot caps 180 may further include a lower portion 190 that may be sized and configured to contact a support surface such as the ground or floor.

Figure 48:
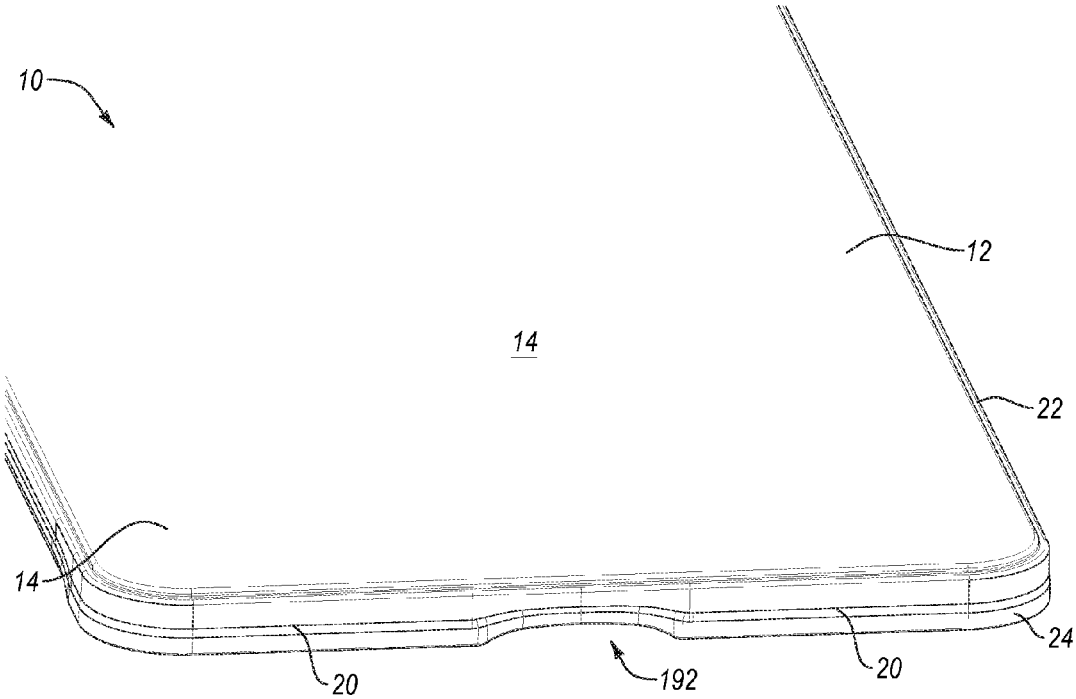
FIG. 48 is an upper perspective view of a portion of an exemplary table, illustrating a handle.
Figure 49:
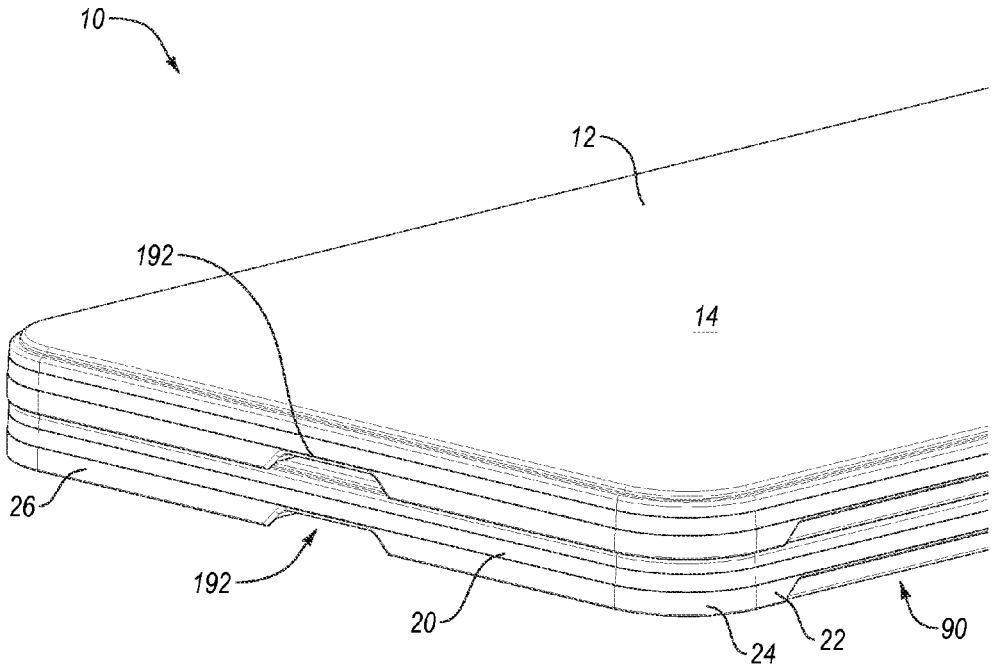
FIG. 49 is an upper perspective view of two exemplary tables disposed in a nested configuration.

As shown in FIGS. 48 and 49, the table 10 may include a handle 192 that is disposed at one or both ends 26 of the table top 12. The handle 192 is preferably sized and configured to facilitate moving and transporting the table 10. In addition, the handle 192 may assist in separating the tables 10 in the nested configuration. The handle 192 may consist of a recess or opening in the downwardly lip 20 of a table top 12 and the handle may be integrally formed with the table top as part of a unitary, one-piece construction. Thus, the table 10 may include handles 192 disposed in both ends 26 of the table top 12 and openings 90 disposed in the sides 22 of the table top. Therefore, the lip 20 in each side of the table top 12 may include an opening or recess. The openings 90 along the sides 22 of the table top 12, however, may be much longer than the handles 192 in the ends 26 of the table top, by a factor such as five, ten, twenty or more.

One of ordinary skill in the art may appreciate after reviewing this disclosure that the tables disclosed herein may have a number of different aspects, features, characteristics and configurations. Further, a table may have any suitable number of aspects, features, characteristics and configurations depending, for example, upon the intended use of the table.

For example, the depressions may have other suitable shapes, sizes, configurations and arrangements, such as disclosed in Assignee's U.S. Pat. No. 7,069,865, entitled HIGH-STRENGTH, LIGHTWEIGHT BLOW-MOLDED PLASTIC STRUCTURES, issued Jul. 4, 2006, which is incorporated by reference in its entirety. In addition, the table may have other suitable features and configurations, such as disclosed in Assignee's U.S. patent application Ser. No. 11/372,515, entitled HIGH-STRENGTH, LIGHTWEIGHT BLOW-MOLDED PLASTIC STRUCTURES, filed Mar. 9, 2006, currently pending, which is incorporated by reference in its entirety.

It will be understood that the table 10 may include other suitable features, aspects, configurations and the like, such as disclosed in Assignee's and U.S. patent application Ser. No. 13/455,041, entitled TABLE WITH NESTING TABLE TOPS, filed Apr. 24, 2012; U.S. patent application Ser. No. 13/455,055, entitled FRAME FOR A TABLE, filed April 24, 2012; U.S. patent application Ser. No. 13/455,073, entitled TABLE WITH MOLDED PLASTIC TABLE TOP, filed Apr. 24, 2012; U.S. patent application Ser. No. 13/455,076, entitled TABLE WITH MOLDED PLASTIC TABLE TOP, filed Apr. 24, 2012; and U.S. patent application Ser. No. 13/455,081, entitled TABLE TOP, filed Apr. 24, 2012. Each of these patents and applications are incorporated by reference in its entirety.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A table sized and configured to nest with one or more adjacent tables to reduce a height of the table in a nested configuration, the table comprising:

a table top constructed from molded plastic, the table top comprising:

an upper portion;

a receiving portion disposed at least proximate the upper portion, the receiving portion sized and configured to receive an engaging portion of a frame of a first adjacent table when the table and the first adjacent table are in a nested configuration;

a lower portion;

a lip disposed at least proximate a perimeter of the table top, the upper portion, the receiving portion, the lower portion and the lip being integrally formed as part of a unitary, one-piece construction;

a metal frame connected to the table top, the frame comprising:

a body disposed at least proximate the lip of the table top; and an engaging portion sized and configured to be disposed in a receiving portion of a second adjacent table when the table and the second adjacent table are in a nested configuration, the engaging portion disposed at least proximate the lip;

a first support structure movable between an extended position and a collapsed position relative to the table top; and a second support structure movable between the extended position and the collapsed position relative to the table top;

wherein a height of the table in a nested configuration is reduced by about twenty percent (20%) or more in comparison to a height of the table in an un-nested configuration.

2. The table as in claim 1, wherein an engaging surface of the engaging portion is sized and configured to contact an engaging surface of the receiving portion when the table and the second adjacent table are in a nested configuration.

3. The table as in claim 1, wherein the table, the first adjacent table and the second adjacent table are substantially identical.

4. The table as in claim 1, further comprising a frame receiving portion integrally formed in the table top as part of the unitary, one-piece construction, a sidewall of the frame receiving portion generally aligned and coplanar with an inner wall of the lip;

wherein a portion of the frame is disposed in the frame receiving portion; and wherein a portion of the frame contacts the lip.

5. The table as in claim 1, further comprising a recess in the lip, the engaging portion of the frame being at least partially disposed in the recess in the lip.

6. The table as in claim 1, further comprising a recess in the lip, at least a portion of the engaging portion of the frame being generally aligned and coplanar with the recess in the lip.

7. The table as in claim 1, further comprising a handle integrally formed in a first end of the table top, the handle sized and configured to facilitate movement of the table and separate the table from the second adjacent table when the table and the second adjacent table are in the nested configuration.

8. The table as in claim 1, further comprising an upwardly extending portion of the frame that contacts a lower portion of the lip, the upwardly extending portion of the frame at least partially disposed in the recess in the lip.

9. The table as in claim 1, wherein the molded plastic table top has a wall thickness;

wherein at least a portion of the lip has substantially a double wall thickness that is at least substantially twice the wall thickness of the molded plastic table top; and wherein at least a portion of the frame contacts the portion of the lip with the substantially double wall thickness.

10. The table as in claim 1, further comprising a support surface of the receiving portion of the table top sized and configured to contact an engagement surface of the engaging portion of the first adjacent table when the table and the first adjacent table are in the nested configuration.

11. The table as in claim 1, wherein the table top and the frame are sized and configured to allow a height of the table in a nested configuration to be reduced by about twenty-five percent (25%) or more in comparison to a height of the table in an un-nested configuration.

12. The table as in claim 1, further comprising:

a frame receiving portion integrally formed with the table top as part of the unitary, one-piece construction; and a first portion of the frame disposed in the frame receiving portion, the first portion of the frame sized and configured to facilitate attachment of the frame to the table top.

13. The table as in claim 12, wherein the receiving portion has a generally L-shaped configuration with a sidewall and a lower surface; and wherein an engaging surface of the engaging portion of the frame is sized and configured to engage the receiving portion when the table and the first adjacent table are in a nested configuration.

14. The table as in claim 1, further comprising:

a first load bearing surface of the frame sized and configured to contact a generally planar upper surface of the second adjacent table when the table is nested with the second adjacent table, the first load bearing surface having a generally planar configuration; and a second load bearing surface of the engaging portion of the frame sized and configured to contact a receiving portion of the second adjacent table when the table is nested with the second adjacent table.

15. The table as in claim 1, wherein the frame has a wall thickness measured between an inner surface and an outer surface; and wherein the engaging portion of the frame has a thickness that is at least substantially equal to twice the wall thickness.

16. The table as in claim 1, wherein a lower surface of the engaging portion is generally aligned and coplanar with a lower surface of a side of the table top;

wherein the lower surface of the engaging portion is generally aligned and coplanar with a lower surface of a corner of the table top; and wherein the lower surface of the engaging portion is generally aligned and coplanar with a lower surface of an end of the table top.

17. The table as in claim 1, further comprising a lower portion of the lip, the lower portion of the lip and the engaging portion of the frame sized and configured to be simultaneously disposed in the receiving portion of the second adjacent table when the table is nested with the second adjacent table.

18. The table as in claim 17, wherein the table top has a wall thickness measured between an inner surface and an outer surface of an outer wall;

wherein the lip portion of the lip sized and configured to be disposed in the receiving portion has a thickness generally equal to or larger than twice the wall thickness of the table top;

wherein the metal frame has a wall thickness measured between an inner surface and an outer surface of the frame; and wherein the engaging portion of the frame has a thickness generally equal to or larger than twice the wall thickness of the metal frame.

19. A table top for a table sized and configured to nest with one or more adjacent tables to reduce a height of the table when the tables are in a nested configuration, the table top constructed from blow-molded plastic, the table top comprising:

an upper portion;

a receiving portion disposed about the upper portion, the receiving portion sized and configured to receive an engaging portion of a frame of an adjacent table when the table is nested with the adjacent table;

a lower portion;

a hollow interior portion disposed between the upper portion and the lower portion; and a lip downwardly extending from the lower portion of the table top, the upper portion, the receiving portion, the lower portion, the hollow interior portion and the lip integrally formed as part of a unitary, one-piece construction during a blow-molding process; and a metal frame connected to the table top, the frame comprising:

an elongated body disposed at least proximate the lip of the table top; and an engaging portion sized and configured to be disposed in a receiving portion of an adjacent table when the table is nested with the adjacent table;

wherein the table and the adjacent table are at least substantially identical; and wherein the table top and the frame are sized and configured to allow a height of a table in a nested configuration to be reduced by about twenty percent (20%) or more in comparison to a height of the table in an un-nested configuration.

20. A table sized and configured to nest with one or more adjacent tables to reduce a height of the table in a nested configuration, the table comprising:

a table top constructed from molded plastic, the table top comprising:

an upper portion;

a receiving portion disposed at least proximate the upper portion, the receiving portion sized and configured to receive an engaging portion of a frame of a first adjacent table when the table and the first adjacent table are in a nested configuration;

a lower portion;

a lip disposed at least proximate a perimeter of the table top, the upper portion, the receiving portion, the lower portion and the lip being integrally formed as part of a unitary, one-piece construction;

a metal frame connected to the table top, the frame comprising:

a body disposed at least proximate the lip of the table top; and an engaging portion sized and configured to be disposed in a receiving portion of a second adjacent table when the table and the second adjacent table are in a nested configuration, the engaging portion disposed at least proximate the lip;

a first support structure movable between an extended position and a collapsed position relative to the table top; and a second support structure movable between the extended position and the collapsed position relative to the table top;

wherein the table top and the frame are sized and configured to allow a height of the table in a nested configuration to be reduced by about twenty-five percent (25%) or more in comparison to a height of the table in an un-nested configuration.

21. The table as in claim 20, wherein an engaging surface of the engaging portion is sized and configured to contact an engaging surface of the receiving portion when the table and the second adjacent table are in a nested configuration.

22. The table as in claim 20, wherein the receiving portion of the table top has a generally L-shaped configuration with a sidewall and a lower surface; and wherein an engaging surface of the engaging portion of the frame is sized and configured to engage the receiving portion of the table top when the table and the first adjacent table are in a nested configuration.

23. The table as in claim 20, further comprising:

a first load bearing surface of the frame sized and configured to contact a generally planar upper surface of the second adjacent table when the table is nested with the second adjacent table, the first load bearing surface having a generally planar configuration; and a second load bearing surface of the engaging portion of the frame sized and configured to contact a receiving portion of the second adjacent table when the table is nested with the second adjacent table.

24. The table as in claim 20, wherein the frame has a wall thickness measured between an inner surface and an outer surface; and wherein the engaging portion of the frame has a thickness that is at least substantially equal to twice the wall thickness.

25. The table as in claim 20, wherein a lower surface of the engaging portion is generally aligned and coplanar with a lower surface of a side of the table top;

wherein the lower surface of the engaging portion is generally aligned and coplanar with a lower surface of a corner of the table top; and wherein the lower surface of the engaging portion is generally aligned and coplanar with a lower surface of an end of the table top.

26. A table sized and configured to nest with one or more adjacent tables to reduce a height of the table in a nested configuration, the table comprising:

a table top constructed from molded plastic, the table top comprising:

an upper portion;

a receiving portion disposed at least proximate the upper portion, the receiving portion sized and configured to receive an engaging portion of a frame of a first adjacent table when the table and the first adjacent table are in a nested configuration;

a lower portion;

a lip disposed at least proximate a perimeter of the table top, the upper portion, the receiving portion, the lower portion and the lip being integrally formed as part of a unitary, one-piece construction;

a metal frame connected to the table top, the frame comprising:

a body disposed at least proximate the lip of the table top; and an engaging portion sized and configured to be disposed in a receiving portion of a second adjacent table when the table and the second adjacent table are in a nested configuration, the engaging portion disposed at least proximate the lip;

a first support structure movable between an extended position and a collapsed position relative to the table top; and a second support structure movable between the extended position and the collapsed position relative to the table top;

wherein the receiving portion of the table top has a generally L-shaped configuration with a sidewall and a lower surface; and wherein an engaging surface of the engaging portion of the frame is sized and configured to engage the receiving portion of the table top when the table and the first adjacent table are in a nested configuration.

27. The table as in claim 26, wherein an engaging surface of the engaging portion is sized and configured to contact an engaging surface of the receiving portion when the table and the second adjacent table are in a nested configuration.

28. The table as in claim 26, wherein a height of the table in a nested configuration is reduced by about twenty percent (20%) or more in comparison to a height of the table in an un-nested configuration.

29. The table as in claim 26, wherein the table top and the frame are sized and configured to allow a height of the table in a nested configuration to be reduced by about twenty-five percent (25%) or more in comparison to a height of the table in an un-nested configuration.

30. The table as in claim 26, further comprising:

a first load bearing surface of the frame sized and configured to contact a generally planar upper surface of the second adjacent table when the table is nested with the second adjacent table, the first load bearing surface having a generally planar configuration; and a second load bearing surface of the engaging portion of the frame sized and configured to contact a receiving portion of the second adjacent table when the table is nested with the second adjacent table.

31. The table as in claim 26, wherein the frame has a wall thickness measured between an inner surface and an outer surface; and wherein the engaging portion of the frame has a thickness that is at least substantially equal to twice the wall thickness.

32. The table as in claim 26, wherein a lower surface of the engaging portion is generally aligned and coplanar with a lower surface of a side of the table top;

wherein the lower surface of the engaging portion is generally aligned and coplanar with a lower surface of a corner of the table top; and wherein the lower surface of the engaging portion is generally aligned and coplanar with a lower surface of an end of the table top.

33. A table sized and configured to nest with one or more adjacent tables to reduce a height of the table in a nested configuration, the table comprising:

a table top constructed from molded plastic, the table top comprising:

an upper portion;

a receiving portion disposed at least proximate the upper portion, the receiving portion sized and configured to receive an engaging portion of a frame of a first adjacent table when the table and the first adjacent table are in a nested configuration;

a lower portion;

a lip disposed at least proximate a perimeter of the table top, the upper portion, the receiving portion, the lower portion and the lip being integrally formed as part of a unitary, one-piece construction;

a metal frame connected to the table top, the frame comprising:

a body disposed at least proximate the lip of the table top;

an engaging portion sized and configured to be disposed in a receiving portion of a second adjacent table when the table and the second adjacent table are in a nested configuration, the engaging portion disposed at least proximate the lip;

a first load bearing surface of the frame sized and configured to contact a generally planar upper surface of the second adjacent table when the table is nested with the second adjacent table, the first load bearing surface having a generally planar configuration; and a second load bearing surface of the engaging portion of the frame sized and configured to contact a receiving portion of the second adjacent table when the table is nested with the second adjacent table;

a first support structure movable between an extended position and a collapsed position relative to the table top; and a second support structure movable between the extended position and the collapsed position relative to the table top.

34. The table as in claim 33, wherein a height of the table in a nested configuration is reduced by about twenty percent (20%) or more in comparison to a height of the table in an un-nested configuration.

35. The table as in claim 33, wherein the table top and the frame are sized and configured to allow a height of the table in a nested configuration to be reduced by about twenty-five percent (25%) or more in comparison to a height of the table in an un-nested configuration.

36. The table as in claim 33, wherein the receiving portion of the table top has a generally L-shaped configuration with a sidewall and a lower surface; and wherein an engaging surface of the engaging portion of the frame is sized and configured to engage the receiving portion of the table top when the table and the first adjacent table are in a nested configuration.

37. The table as in claim 33, wherein the frame has a wall thickness measured between an inner surface and an outer surface; and wherein the engaging portion of the frame has a thickness that is at least substantially equal to twice the wall thickness.

38. The table as in claim 33, wherein a lower surface of the engaging portion is generally aligned and coplanar with a lower surface of a side of the table top;

wherein the lower surface of the engaging portion is generally aligned and coplanar with a lower surface of a corner of the table top; and wherein the lower surface of the engaging portion is generally aligned and coplanar with a lower surface of an end of the table top.

39. A table sized and configured to nest with one or more adjacent tables to reduce a height of the table in a nested configuration, the table comprising:

a table top constructed from molded plastic, the table top comprising:

an upper portion;

a receiving portion disposed at least proximate the upper portion, the receiving portion sized and configured to receive an engaging portion of a frame of a first adjacent table when the table and the first adjacent table are in a nested configuration;

a lower portion of the table top;

a lip disposed at least proximate a perimeter of the table top, the upper portion, the receiving portion, the lower portion and the lip being integrally formed as part of a unitary, one-piece construction;

a lower portion of the lip, the lower portion of the lip and the engaging portion of the frame sized and configured to be simultaneously disposed in the receiving portion of the second adjacent table when the table is nested with the second adjacent table;

a metal frame connected to the table top, the frame comprising:

a body disposed at least proximate the lip of the table top; and an engaging portion sized and configured to be disposed in a receiving portion of a second adjacent table when the table and the second adjacent table are in a nested configuration, the engaging portion disposed at least proximate the lip;

a first support structure movable between an extended position and a collapsed position relative to the table top; and a second support structure movable between the extended position and the collapsed position relative to the table top;

wherein a lower portion of the lip and the engaging portion of the frame are sized and configured to be simultaneously disposed in the receiving portion of the second adjacent table when the table is nested with the second adjacent table.

* * * * *

UNITED STATES PATENT AND TRADEMARK OFFICE

CERTIFICATE OF CORRECTION

PATENT NO. : 8,857,349 B2
APPLICATION NO. : 13/735913
DATED : October 14, 2014
INVENTOR(S) : Peery et al.

It is certified that error appears in the above-identified patent and that said Letters Patent is hereby corrected as shown below:

On Title Page 3, in Item [56] under "OTHER PUBLICATIONS", in Column 2, Lines 5-6, delete "2014 (copy." and insert -- 2014. --, therefor.

On Title Page 3, in Item [56] under "OTHER PUBLICATIONS", in Column 2, Lines 1-2, delete "2014 (copy." and insert -- 2014. --, therefor.

In the Specification

Figure 10:
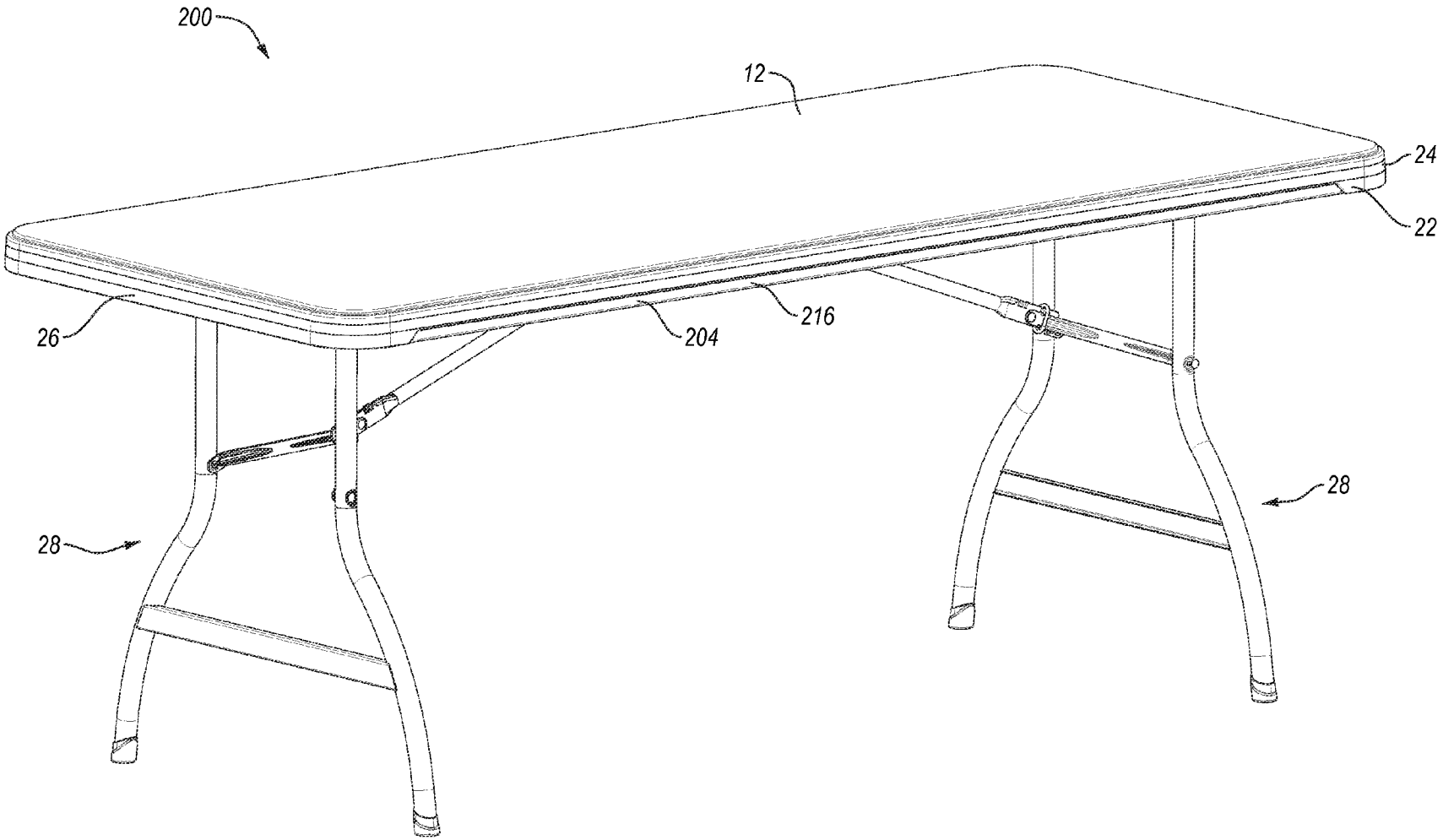
FIG. 10 is perspective view of another exemplary table.
Figure 11:
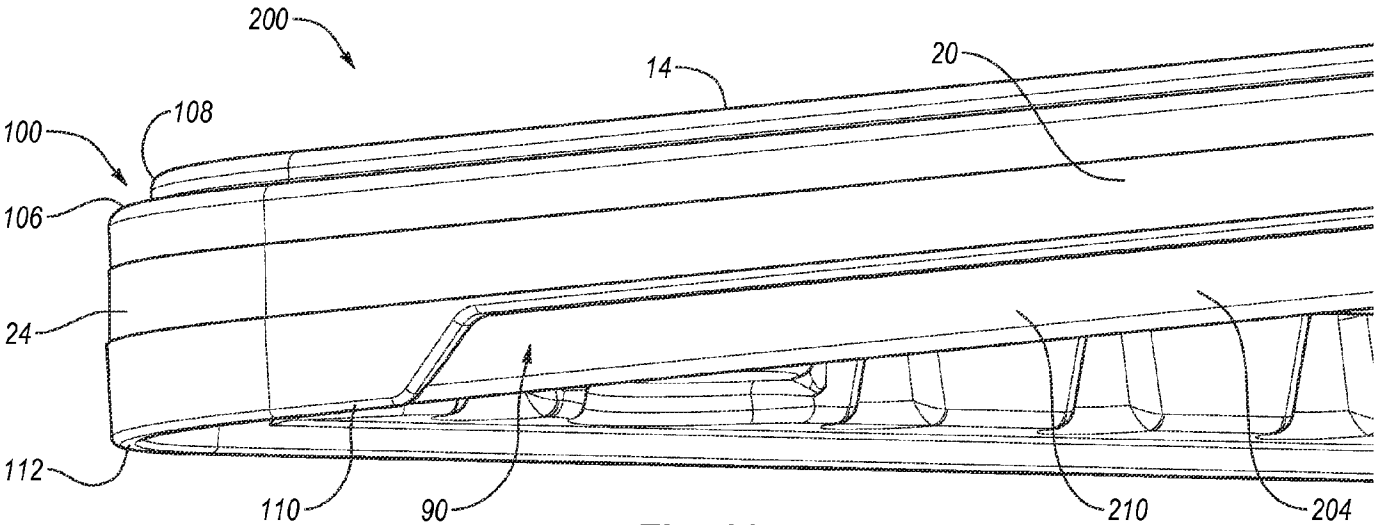
FIG. 11 is an enlarged lower perspective view of a portion of the table shown in FIG. 10.

Column 18, Line 1, delete "FIG. 10 is perspective" and insert -- FIG. 10 is a perspective --, therefor.

Column 18, Line 30, delete "FIG. 23 is perspective" and insert -- FIG. 23 is a perspective --, therefor.

Figure 42:
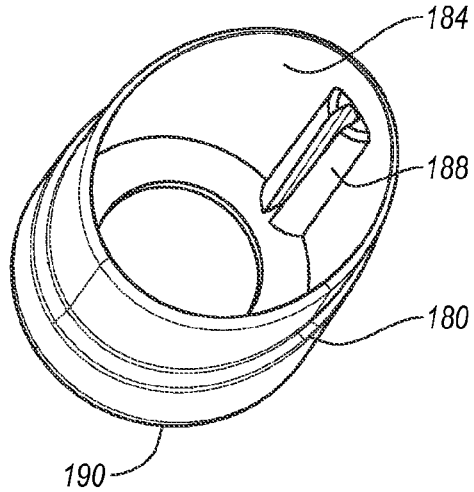
FIG. 42 is a another perspective view of the end cap shown in FIG. 41.
Figure 43:
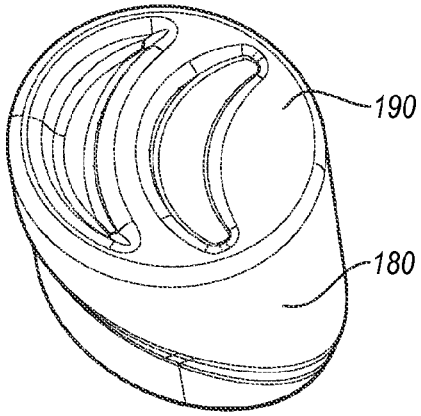
FIG. 43 is a still another perspective view of the end cap shown in FIG. 41.
Figure 44:
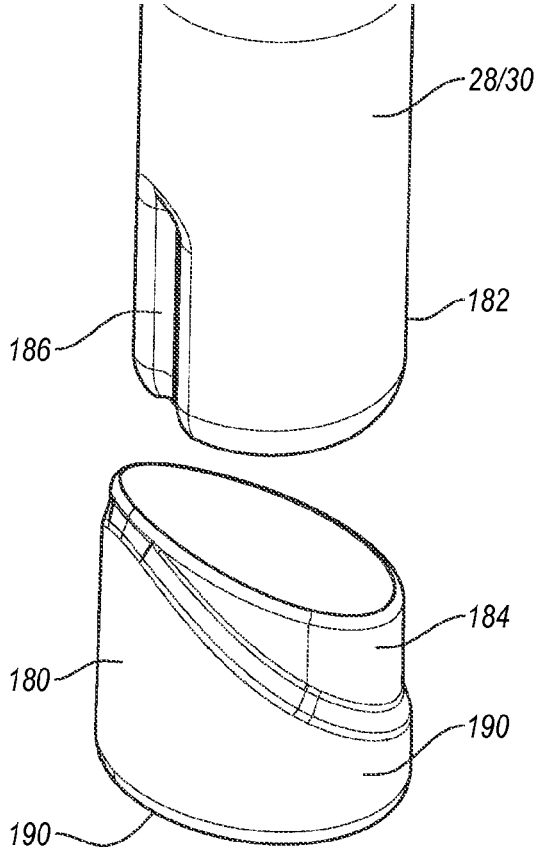
FIG. 44 is a yet another perspective view of the end cap shown in FIG. 41 and a lower portion of a support structure.
Figure 46:
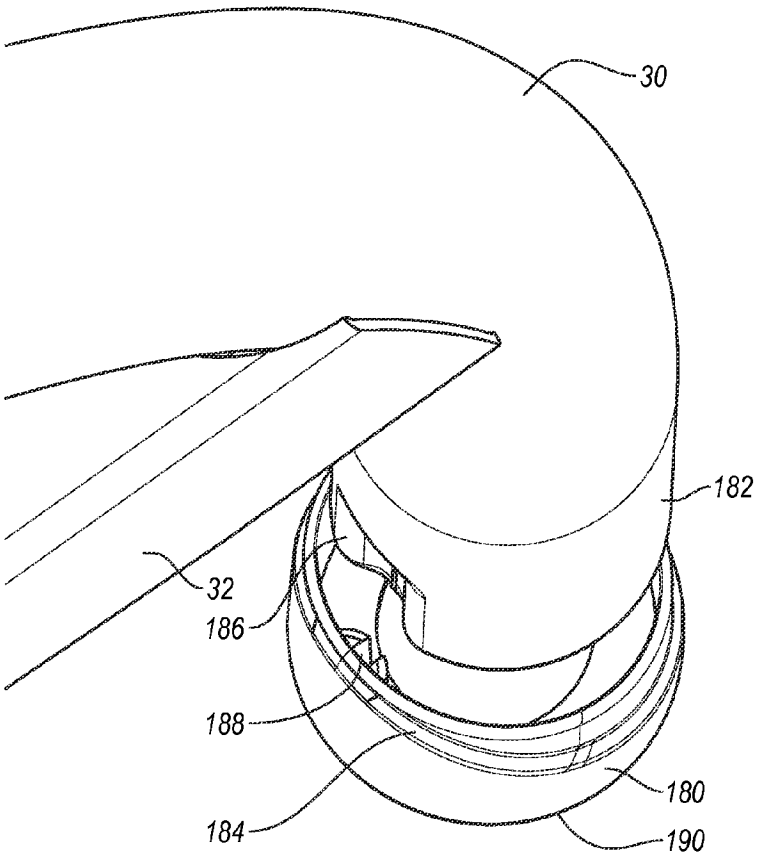
FIG. 46 is an enlarged perspective view of a portion of the support structure and end cap shown in FIG. 45.
Figure 45:
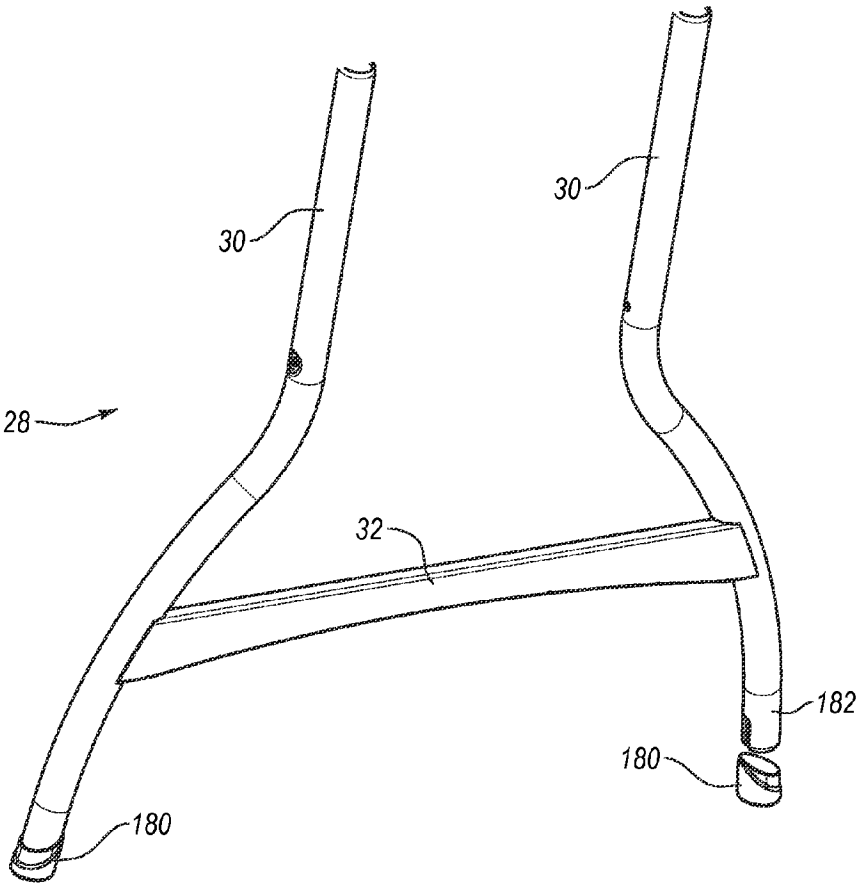
FIG. 45 is a perspective view of an exemplary support structure and end cap.
Figure 47:
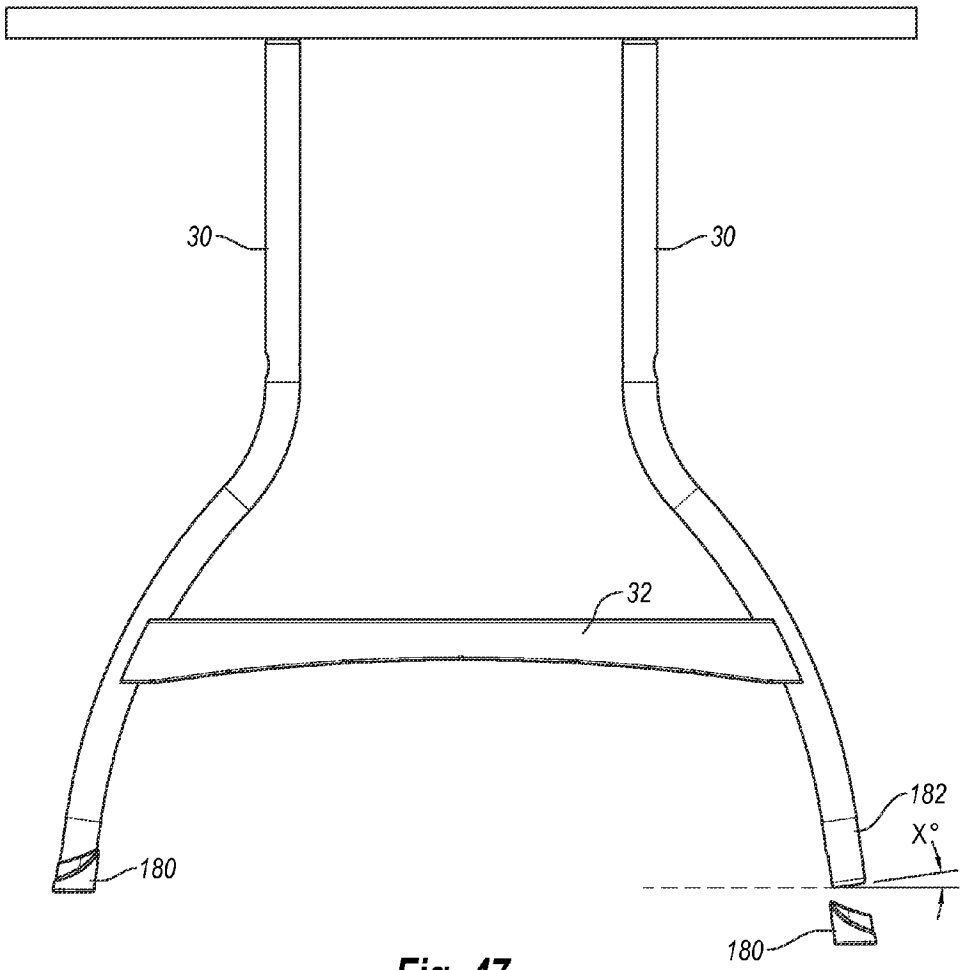
FIG. 47 is a side view of a portion of the support structure and end cap shown in FIG. 45.

Column 19, Line 2, delete "FIG. 42 is a another" and insert -- FIG. 42 is another --, therefor.

Signed and Sealed this
Tenth Day of February, 2015

Michelle K. Lee

Michelle K. Lee
*Deputy Director of the United States Patent and Trademark Office*